US009568887B2

(12) United States Patent
Kawauchiya et al.

(10) Patent No.: US 9,568,887 B2
(45) Date of Patent: Feb. 14, 2017

(54) OPERATION STABILIZING MECHANISM, MOVEMENT, AND MECHANICAL TIMEPIECE

(71) Applicant: SEIKO INSTRUMENTS INC., Chiba-shi, Chiba (JP)

(72) Inventors: Takuma Kawauchiya, Chiba (JP); Masahiro Nakajima, Chiba (JP); Takashi Niwa, Chiba (JP); Masayuki Koda, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 15/059,133

(22) Filed: Mar. 2, 2016

(65) Prior Publication Data

US 2016/0266547 A1 Sep. 15, 2016

(30) Foreign Application Priority Data

Mar. 9, 2015 (JP) ..... 2015-046230
Dec. 9, 2015 (JP) ..... 2015-240647

(51) Int. Cl.

| | |
|---|---|
| ***G04B 15/10*** | (2006.01) |
| ***G04B 15/12*** | (2006.01) |
| ***G04B 15/14*** | (2006.01) |
| ***G04B 17/28*** | (2006.01) |
| *G04B 1/22* | (2006.01) |

(52) U.S. Cl.

CPC ..... *G04B 15/14* (2013.01); *G04B 15/10* (2013.01); *G04B 15/12* (2013.01); *G04B 17/285* (2013.01); *G04B 1/225* (2013.01)

(58) Field of Classification Search

CPC ..... G04B 1/225; G04B 1/10; G04B 15/12; G04B 15/14; G04B 17/285

See application file for complete search history.

(56) References Cited

U.S. PATENT DOCUMENTS

| | | | | |
|---|---|---|---|---|
| 6,948,845 | B2 | 9/2005 | Journe | 368/127 |
| 6,997,602 | B2 * | 2/2006 | Mojon | G04F 7/08 368/127 |
| 7,473,027 | B2 * | 1/2009 | Goeller | G04B 1/225 368/124 |
| 8,038,340 | B2 * | 10/2011 | Schneider | G04B 15/10 368/124 |

(Continued)

FOREIGN PATENT DOCUMENTS

| | | |
|---|---|---|
| EP | 1465024 | 10/2006 |
| WO | 2004077171 | 9/2004 |

*Primary Examiner* — Vit W Miska
(74) *Attorney, Agent, or Firm* — Adams & Wilks

(57) ABSTRACT

To provide an operation stabilizing mechanism, a movement, and a mechanical timepiece allowing a reduction in size while achieving an enhancement in rate precision. An operation stabilizing mechanism includes: an outer carriage and an inner carriage provided so as to be mutually rotatable; a constant-force spring provided between the outer carriage and the inner carriage and configured to impart a rotational force to the inner carriage such that the inner carriage rotates with respect to the outer carriage; a stop wheel provided on the outer carriage; and a stopper configured to perform engaging and releasing operations on the stop wheel upon the rotation of the inner carriage, wherein the rotational axis of the outer carriage and the rotation axis of the inner carriage cross each other.

17 Claims, 30 Drawing Sheets

(56) References Cited

U.S. PATENT DOCUMENTS

| | | | | |
|---|---|---|---|---|
| 8,550,700 | B2 * | 10/2013 | Wiederrecht | G04B 1/225 368/186 |
| 2003/0112709 | A1 * | 6/2003 | Mojon | G04B 15/10 368/127 |
| 2004/0156273 | A1 * | 8/2004 | Mojon | G04F 7/08 368/127 |
| 2007/0127319 | A1 * | 6/2007 | Goeller | G04B 1/225 368/124 |
| 2007/0147179 | A1 * | 6/2007 | Girardin | G04B 15/10 368/147 |
| 2012/0250468 | A1 * | 10/2012 | Bas | G04B 15/10 368/129 |

* cited by examiner

OPERATION STABILIZING MECHANISM, MOVEMENT, AND MECHANICAL TIMEPIECE

BACKGROUND OF THE INVENTION

1. Field of the Invention

This invention relates to an operation stabilizing mechanism, a movement, and a mechanical timepiece.

2. Description of Related Art

As main mechanisms determining the precision in rate of a mechanical timepiece, there exist a governor and an escapement. The governor is composed of a balance with hairspring and a hairspring. The balance with hairspring is caused to oscillate at a fixed cycle by the spring force of the hairspring. It is desirable for the gravitational center position of the balance with hairspring to be situated on the axis of a balance staff. When the axis of the balance staff and the gravitational center position of the balance with hairspring are deviated from each other, there is generated, if the timepiece is in an erect attitude, unnecessary torque due to the biased gravitational center of the balance with hairspring. As a result, depending upon the direction in which the gravitational force is exerted, there is generated an error in precision in rate. This error is referred to as the erect attitude difference.

Further, the hairspring is also formed in a spiral configuration, so that, because of the characteristics due to its configuration, there is generated an erect attitude difference depending upon the direction in which the gravitational force is exerted when the timepiece is in the erect attitude. In this way, the governor of a mechanical timepiece involves an erect attitude difference due to two factors.

As a mechanism for solving this problem of erect attitude difference, there has been known a tourbillon mechanism (operation stabilizing mechanism). In the tourbillon mechanism, the governor and the escapement are arranged in a single carriage, which is rotated at a fixed cycle. As a result, it is possible to average the error in the precision in rate generated by the gravitational force, making it possible to suppress the erect attitude difference.

However, in the above tourbillon mechanism, rotation is effected around a single axis, so that it is difficult to eliminate the error in the precision in rate (hereinafter referred to as the flat-erect difference) between the case when the timepiece is in the flat attitude and the case when it is in the erect attitude.

In view of this, there have been proposed various techniques for simultaneously suppressing the erect attitude difference and the flat-erect difference.

For example, there has been proposed a technique capable of simultaneously suppressing the erect attitude difference and the flat-erect difference through rotation of the governor and the escapement by a plurality of carriages of different rotational axes (See, for example, International Publication No. 2004/077171 (Patent Literature 1) and European Patent No. 1465024 (Patent Literature 2)).

Ideally, the governor oscillates at a fixed oscillation frequency. Actually, however, the amplitude of the balance with hairspring varies under the influence of various error factors, resulting in fluctuation of the oscillation cycle of the balance with hairspring. As a result of this fluctuation of the oscillation cycle, the precision in the rate of the timepiece deteriorates.

The balance with hairspring oscillates due to the spring force of a power mainspring, so that, as a result of unwinding of the power mainspring, the oscillation angle of the balance with hairspring is reduced, resulting in fluctuation in the oscillation cycle of the balance with hairspring. It is difficult to eliminate this fluctuation in the oscillation cycle of the balance with hairspring even by using the above-mentioned tourbillon mechanism. Thus, to enhance the precision in rate, it is desirable to supply a fixed amount of energy to the governor.

As a mechanism for supplying a fixed amount of energy to the governor, there have been known constant-force mechanisms such as a remontoire mechanism. And, there has been proposed a technique which further enhances the rate precision by providing this constant-force mechanism separately from the tourbillon mechanism (See, for example, U.S. Pat. No. 6,948,845 (Patent Literature 3)).

However, in Patent Literature 3, the mechanism as a whole is rather large in size, and when the mechanism is arranged in the timepiece limited in space, it is rather difficult to efficiently arrange the other mechanisms.

SUMMARY OF THE INVENTION

It is an aspect of the present application to provide an operation stabilizing mechanism, a movement, and a mechanical timepiece which allow a reduction in size while achieving an improvement in terms of rate precision.

To achieve the above aspect, there is provided in accordance with the present application an operation stabilizing mechanism including: a plurality of carriages arranged in a multiplex fashion and provided so as to be mutually rotatable; a constant-force spring provided between two adjacent ones of the plurality of carriages and configured to impart a rotational force to the other of the two carriages such that the other carriage rotates with respect to the one carriage; a stop wheel provided on the one carriage; and a stopper configured to perform engaging and releasing operations on the stop wheel upon the rotation of the other carriage, wherein the rotational axes of at least two of the plurality of carriages cross each other.

By thus arranging a constant-force spring between two adjacent carriages, it is possible to impart a rotational force to one carriage in a stable manner without involving an increase in the size of the mechanism as a whole. Further, through the construction consisting of a plurality of carriages, it is possible to eliminate the flat-erect difference. Thus, it is possible to provide a small operation stabilizing mechanism while enhancing the rate precision.

According to the present application, there is provided an operation stabilizing mechanism, wherein the stopper and an escapement/governor mechanism are provided in the one carriage.

Due to this construction, it is possible to impart a rotational force in a stable manner to the one carriage provided with the escapement/governor mechanism. Thus, it is possible to stabilize the rotational torque transmitted to the escapement/governor mechanism, with the result that it is possible to stabilize the operation of the escapement/governor mechanism.

According to the present application, there is provided an operation stabilizing mechanism, wherein there are provided two carriages; the drive force of a train wheel is transmitted to an outer carriage arranged on the outer side, and the stop wheel is provided on the outer carriage; and the stopper and the escapement/governor mechanism are provided in an inner carriage arranged on the inner side.

Due to this construction, it is possible to impart a rotational force in a stable manner to the inner carriage provided with the escapement/governor mechanism while achieving a reduction in size.

According to the present application, there is provided an operation stabilizing mechanism, wherein the escapement/governor mechanism is equipped with an escape wheel & pinion configured to rotate on the inner carriage with the rotation of the inner carriage, and a balance with hairspring configured to rotate and oscillate on the inner carriage with the rotation of the escape wheel & pinion; and the balance with hairspring is arranged such that the rotation axis of the balance with hairspring and the rotation axis of the outer carriage cross each other.

The fact that the rotation axis of the balance with hairspring and the rotation axis of the outer carriage are thus arranged so as to cross each other means that the rotation center of the balance with hairspring is situated at the rotation center of the outer carriage. Due to this construction, it is possible to prevent generation of useless space in the inner carriage and the outer carriage. Thus, it is possible to reliably reduce the size of the operation stabilizing mechanism, and to achieve an improvement in terms of design.

Further, since the balance with hairspring is mounted in the inner carriage, it is possible to stabilize the rotational torque transmitted to the balance with hairspring. As a result, it is possible to suppress fluctuation in the oscillation angle of the balance with hairspring.

According to the present application, there is provided an operation stabilizing mechanism, wherein the rotation axis of the inner carriage and the rotation axis of the balance with hairspring cross each other.

Due to this construction, the provision of at least two carriages of the outer carriage and the inner carriage makes it possible to orient the balance with hairspring in all directions. Thus, it is possible to provide an operation stabilizing mechanism simplified in structure as much as possible and enhanced in rate precision while achieving a reduction in size.

According to the present application, there is provided an operation stabilizing mechanism, wherein the center of gravity of the balance with hairspring is situated in at least one of the rotation axis of the inner carriage and the rotation axis of the outer carriage.

Due to this construction, it is possible to make it difficult for the centrifugal force due to the rotation of each carriage to act on the balance with hairspring. Thus, it is possible to stabilize the operation of the balance with hairspring.

According to the present application, there is provided an operation stabilizing mechanism, wherein the center of gravity of the inner carriage is situated in the rotation axis of the inner carriage.

Due to this construction, it is possible to minimize the requisite rotational torque for rotating the inner carriage. Thus, it is possible to enhance the drive efficiency, and to enhance the rate precision.

According to the present application, there is provided an operation stabilizing mechanism, wherein the center of gravity of the outer carriage is situated in the rotation axis of the outer carriage.

Due to this construction, it is possible to minimize the requisite rotational torque for rotating the outer carriage. As a result, it is possible to efficiently perform the winding-up of the constant-force spring by the outer carriage, making it possible to stabilize the winding-up amount of the constant-force spring. Thus, it is possible to enhance the drive efficiency, and to enhance the rate precision.

According to the present application, there is provided an operation stabilizing mechanism, wherein the stopper is equipped with an arm swingably provided with respect to the outer carriage and configured to swing upon the rotation of the inner carriage, and a pallet portion provided on the arm and capable of being engaged and disengaged with and from the stop wheel; the swing axis of the arm is set in a direction crossing the rotation axis of the stop wheel; and setting is made such that the vector of a mesh-engagement force generated when the stop wheel and the pallet portion are engaged with each other extends along the direction of the swing axis of the arm.

In the case where the swing axis of the arm is thus set in a direction crossing the rotation axis of the stop wheel, it is possible to prevent the mesh-engagement force generated when the stop wheel and the pallet portion are engaged with each other from affecting the inner carriage. Thus, it is possible to minimize the requisite rotational torque for rotating the inner carriage.

According to the present application, there is provided an operation stabilizing mechanism, wherein the stopper is equipped with an arm swingably provided with respect to the outer carriage and configured to swing upon the rotation of the inner carriage, and a pallet portion provided on the arm and capable of being engaged and disengaged with and from the stop wheel; the swing axis of the arm is set so as to extend along the rotation axis of the stop wheel; and setting is made such that the vector of a mesh-engagement force generated when the stop wheel and the pallet portion are engaged with each other passes on the swing axis of the arm.

In the case where the swing axis of the arm is thus set so as to extend along the rotation axis of the stop wheel, it is possible to prevent the mesh-engagement force generated when the stop wheel and the pallet portion are engaged with each other from affecting the inner carriage. Thus, it is possible to minimize the requisite rotational torque for rotating the inner carriage.

According to the present application, there is provided an operation stabilizing mechanism, wherein the arm is equipped with a balancer; and the center of gravity of the arm is situated in the swing axis of the arm.

Due to this construction, it is possible to prevent the gravitational force of the arm itself from affecting the swinging operation of this arm due to inclination of the operation stabilizing mechanism. Thus, it is possible to maintain a fixed force required for the swinging operation of the arm, making it possible to further enhance the rate precision.

According to the present application, there is provided an operation stabilizing mechanism, wherein there is provided a regulating portion regulating the relative rotation amount of the two carriages connected by the constant-force spring.

Due to this construction, it is possible to prevent the constant-force spring from being unwound to a predetermined degree or more. Thus, it is possible to impart rotational force to a desired carriage in a stable manner.

According to the present application, there is provided an operation stabilizing mechanism, wherein, of the two carriages connected by the constant-force spring, the carriage on the outer side is provided with a constant-force spring winding-up wheel for winding up the constant-force spring; the constant-force spring winding-up wheel is provided with a regulating plate; of the two carriages connected by the constant-force spring, the carriage on the inner side is provided with an engagement pin that can be engaged with the regulating plate; and the regulating plate and the engagement pin constitute a regulating portion.

Due to this construction, it is possible to reliably prevent unwinding of the constant-force spring with a simple structure. Thus, it is possible to reliably enhance the rate precision while achieving a reduction in the size of the operation stabilizing mechanism.

According to the present application, there is provided an operation stabilizing mechanism, wherein the respective rotation cycles of the plurality of carriages are set to mutually indivisible numbers.

Here, in the case where the respective rotation cycles of the carriages are set to mutually divisible numbers, there increases the number of times that the relative attitude of the escapement/governor mechanism (balance with hairspring) provided in one of the carriages and that of the other carriages are the same. For example, assuming that the proportion of the rotation cycles of the two carriages is set to 1:1, and that the balance with hairspring is provided in one of the carriages, the balance with hairspring assumes the same attitude when the other carriage makes one rotation. Thus, by setting the rotation cycles of the carriages to mutually indivisible numbers, it takes the balance with hairspring longer to assume the same attitude at the same place. Thus, it is possible to disperse the influence of the gravitational force, making it possible to more reliably eliminate the flat-erect difference, and to disperse the stress applied to the rotation shaft, etc.

According to the present application, there is provided an operation stabilizing mechanism including: a stationary wheel provided separately from the plurality of carriages; and a stop wheel driving wheel integrally fixed to the stop wheel and in mesh with the stationary wheel, wherein the number of teeth of the stationary wheel and the number of teeth of the stop wheel driving wheel are set to mutually indivisible numbers.

Due to this construction, in the case where the respective rotation cycles of the carriages are set to mutually divisible numbers, it is possible to reduce, with a simple structure, the number of times that the escapement/governor mechanism (balance with hairspring) provided in one of the carriages assumes the same relative attitude as the other carriages.

According to the present application, there is provided a movement equipped with an operation stabilizing mechanism as described above.

Due to this construction, it is possible to provide a movement allowing a reduction in size while enhancing the rate precision.

According to the present application, there is provided a mechanical timepiece equipped with a movement as described above.

Due to this construction, it is possible to provide a mechanical timepiece allowing a reduction in size while enhancing the rate precision.

According to the present application, a constant-force spring is arranged between two adjacent carriages, whereby it is possible to impart rotational force to one carriage in a stable manner without involving an increase in the size of the mechanism as a whole. Further, through the formation of the mechanism by a plurality of carriages, it is possible to eliminate the flat-erect difference. Thus, it is possible to provide a small operation stabilizing mechanism while enhancing the rate precision.

BRIEF DESCRIPTION OF THE DRAWINGS

FIG. 23A is a diagram illustrating the stop wheel as seen from the axial direction, and FIG. 23B is a diagram illustrating the stop wheel as seen from the radial direction.

FIG. 24A is a diagram illustrating the stop wheel as seen from the axial direction, and FIG. 24B is a diagram illustrating the stop wheel as seen from the radial direction.

DESCRIPTION OF EMBODIMENTS

Next, embodiments of this invention will be described with reference to the drawings.

First Embodiment

Mechanical Timepiece

First, the first embodiment of this invention will be described with reference to FIGS. 1 through 24.

Figure 1:
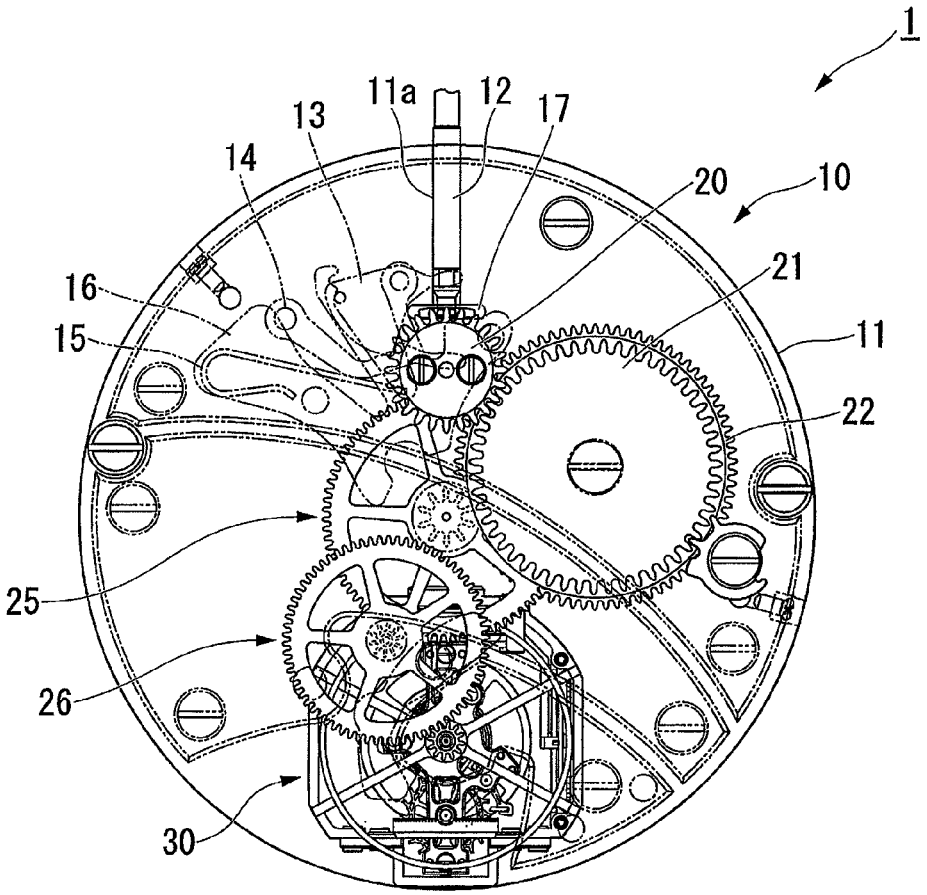
FIG. 1 is a plan view of the front side of a movement of a mechanical timepiece according to a first embodiment of the present invention.
Figure 2:
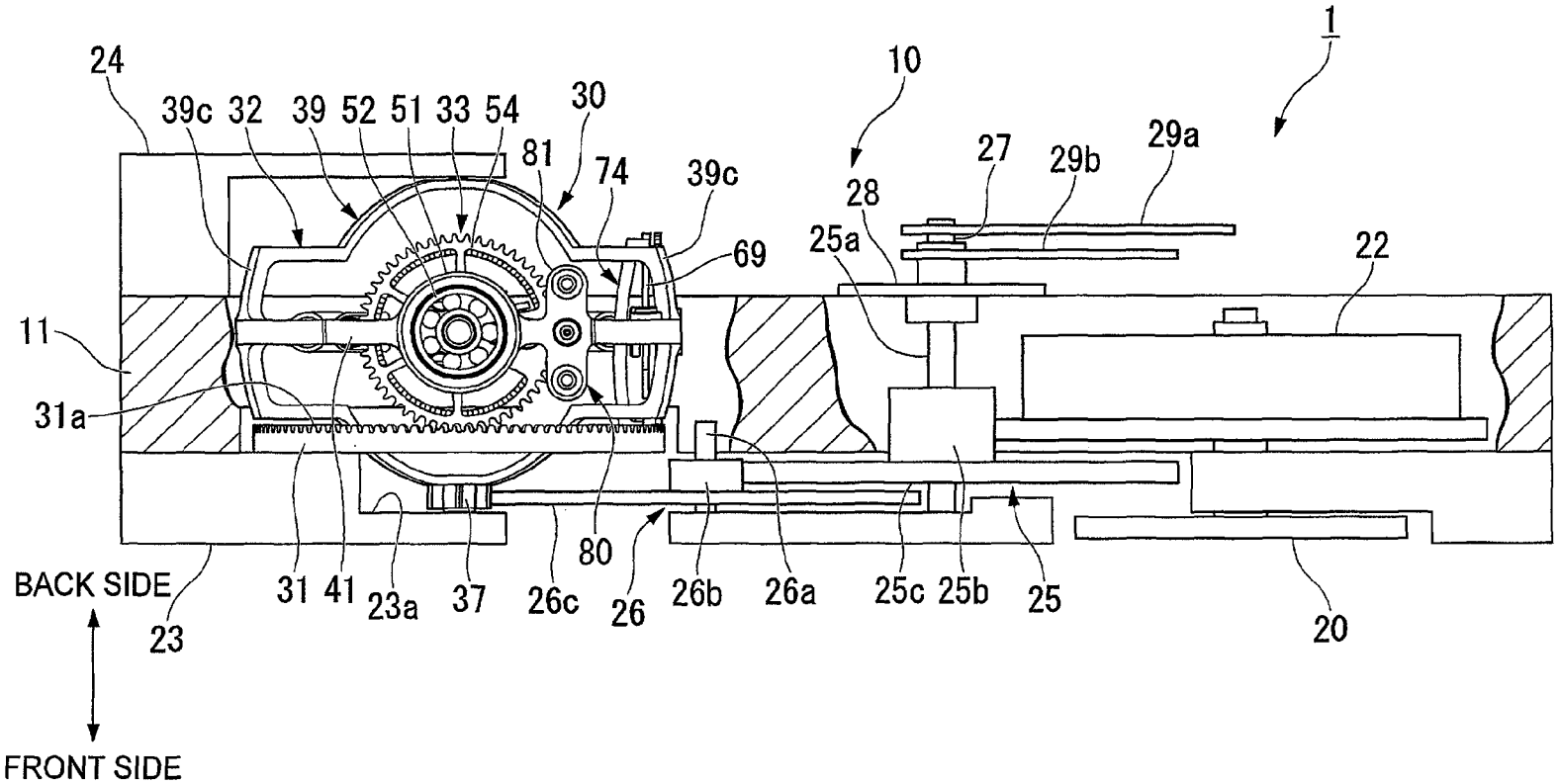
FIG. 2 is a schematic sectional view of the mechanical timepiece according to the first embodiment of the present invention.

FIG. 1 is a plan view of the front side of the movement of a mechanical timepiece 1, and FIG. 2 is a schematic sectional view of the mechanical timepiece 1.

As shown in FIGS. 1 and 2, the mechanical timepiece 1 is composed of a movement 10 and a casing (not shown) accommodating this movement 10.

The movement 10 has a main plate 11 constituting a base plate. On the back side of this main plate 11, there is arranged a dial (not shown). A train wheel mounted to the front side of the movement 10 will be referred to as the front train wheel, and a train wheel mounted to the back side of the movement 10 will be referred to as the back train wheel.

The main plate 11 has a winding stem guide hole 11*a*, to which a winding stem 12 is rotatably mounted.

The position in the axial direction of this winding stem 12 is determined by a switching device having a setting lever 13, a yoke 14, a yoke spring 15, and a setting lever jumper 16. Further, a winding pinion 17 is rotatably provided on the guide shaft portion of the winding stem 12.

In this construction, when the winding stem 12 is rotated in a state in which the winding stem 12 is at a first winding stem position ($0^{th}$ step) nearest to the inner side of the movement 10 along the rotation axis, the winding pinion 17 rotates via the rotation of a clutch wheel (not shown). And, through the rotation of this winding pinion 17, a crown wheel 20 in mesh therewith is rotated. And, through the rotation of the crown wheel 20, a ratchet wheel 21 in mesh therewith is rotated. Further, through the rotation of this ratchet wheel 21, a mainspring (not shown) accommodated in a movement barrel 22 is wound up.

Apart from the above-mentioned movement barrel 22, the front train wheel of the movement 10 is formed by a center wheel & pinion 25 and a third wheel & pinion 26, and exerts the function of transmitting the rotational force of the movement barrel 22. Further, on the front side of the movement 10, there is arranged a tourbillon 30 with constant-force device for controlling the rotation of the front train wheel.

The center wheel & pinion 25 is equipped with a shaft portion 25*a*, a pinion portion 25*b* fixed to this shaft portion 25*a*, and a cogwheel portion 25*c*. And, the pinion portion 25*b* of the center wheel & pinion 25 is in mesh with the movement barrel 22. Apart from this, the center wheel & pinion 25 is provided with a cannon pinion 27, a minute hand 29*a* mounted to the cannon pinion 27, an hour wheel 28, and an hour hand 29*b* mounted to this hour wheel 28.

In this construction, when the center wheel & pinion 25 rotates, the cannon pinion 27 lightly forced into the center wheel & pinion 25 rotates simultaneously, and the minute hand 29*a* mounted to the cannon pinion 27 indicates "minute." Further, based on the rotation of the cannon pinion 27, the hour wheel 28 is rotated through the rotation of a minute wheel (not shown), and the hour hand 29*b* mounted to the hour wheel 28 indicates "hour."

Further, the third wheel & pinion 26 is equipped with a shaft portion 26*a*, a pinion portion 26*b* fixed to this shaft portion 26*a*, and a cogwheel portion 26*c*. And, the pinion portion 26*b* of the third wheel & pinion 26 is in mesh with the cogwheel portion 25*c* of the center wheel & pinion 25. Further, the tourbillon with constant-force device 30 is in mesh with the cogwheel portion 26*c* of the third wheel & pinion 26.

(Tourbillon with Constant-Force Device)

Figure 3:
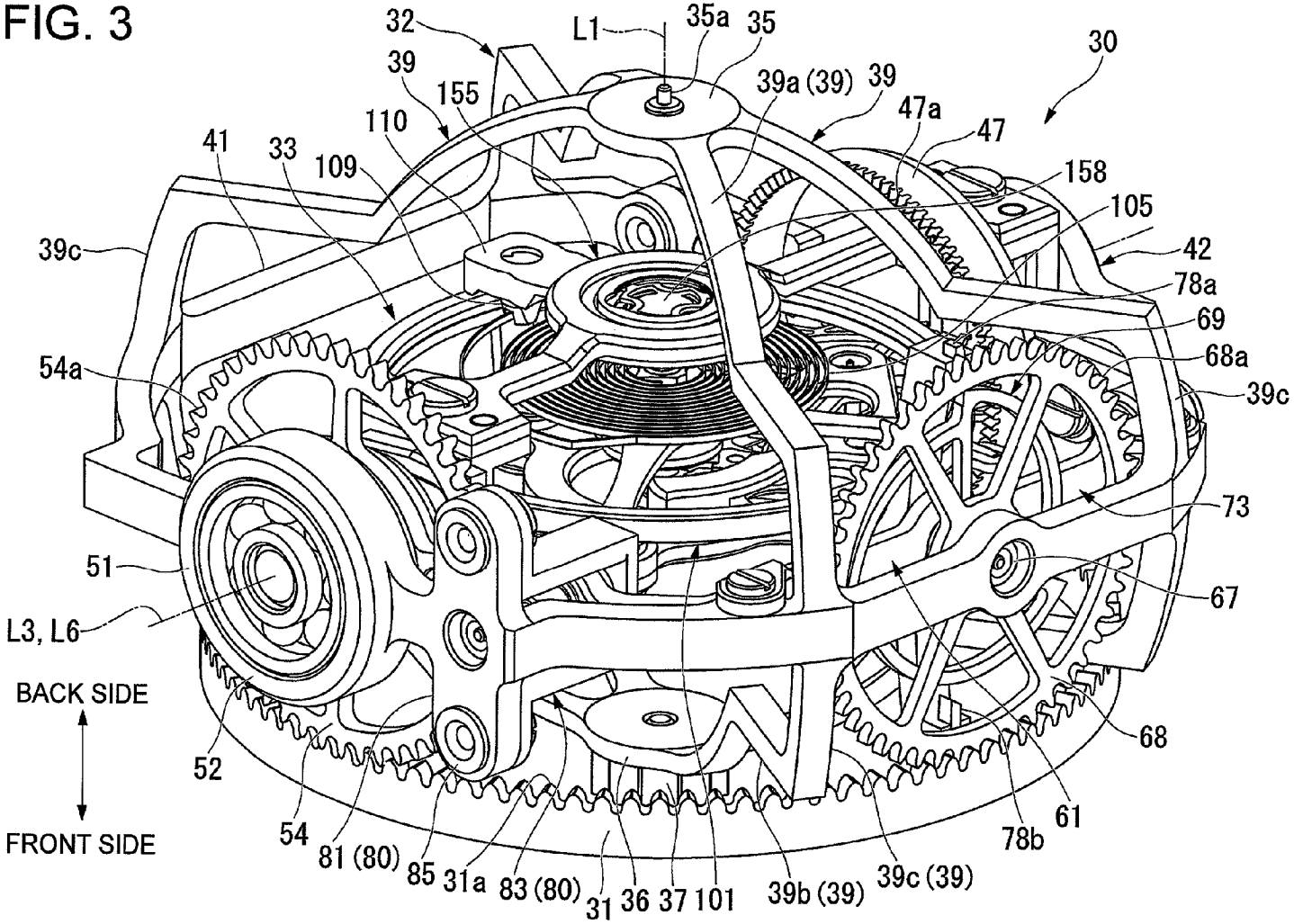
FIG. 3 is a perspective view of a tourbillon with constant-force device according to the first embodiment of the present invention.

FIG. 3 is a perspective view of the tourbillon with constant-force device 30.

As shown in FIGS. 2 and 3, the tourbillon with constant-force device 30 is a mechanism controlling the rotation of the above-mentioned front train wheel. Further, the tourbillon with constant-force device 30 has a so-called tourbillon mechanism configured to reduce the influence of the gravitational force depending on the orientation of a balance with hairspring 101 described below. Further, the tourbillon with constant-force device 30 is equipped with a constant-force device 3 for suppressing fluctuation in the rotational torque transmitted to an escape wheel & pinion 124 described below.

In the following, the tourbillon with constant-force device 30 will be described in detail.

The tourbillon with constant-force device 30 is rotatably supported by a front side carriage bridge 23 mounted to the front side of the main plate 11 and a back side carriage bridge 24 mounted to the back side of the main plate 11. The tourbillon with constant-force device 30 is equipped with a stationary wheel 31 fixed to the main plate 11 side of the front side carriage bridge 23, an outer carriage 32 rotatably supported by the front side carriage bridge 23 and the back side carriage bridge 24, and an inner carriage 33 rotatably supported with respect to the outer carriage 32 on the inner side of the outer carriage 32.

The stationary wheel 31 is formed in a substantially disc-like configuration, and has tooth portions 31*a* at the peripheral edge on the back side (main plate 11 side) thereof.

(Outer Carriage)

Figure 4:
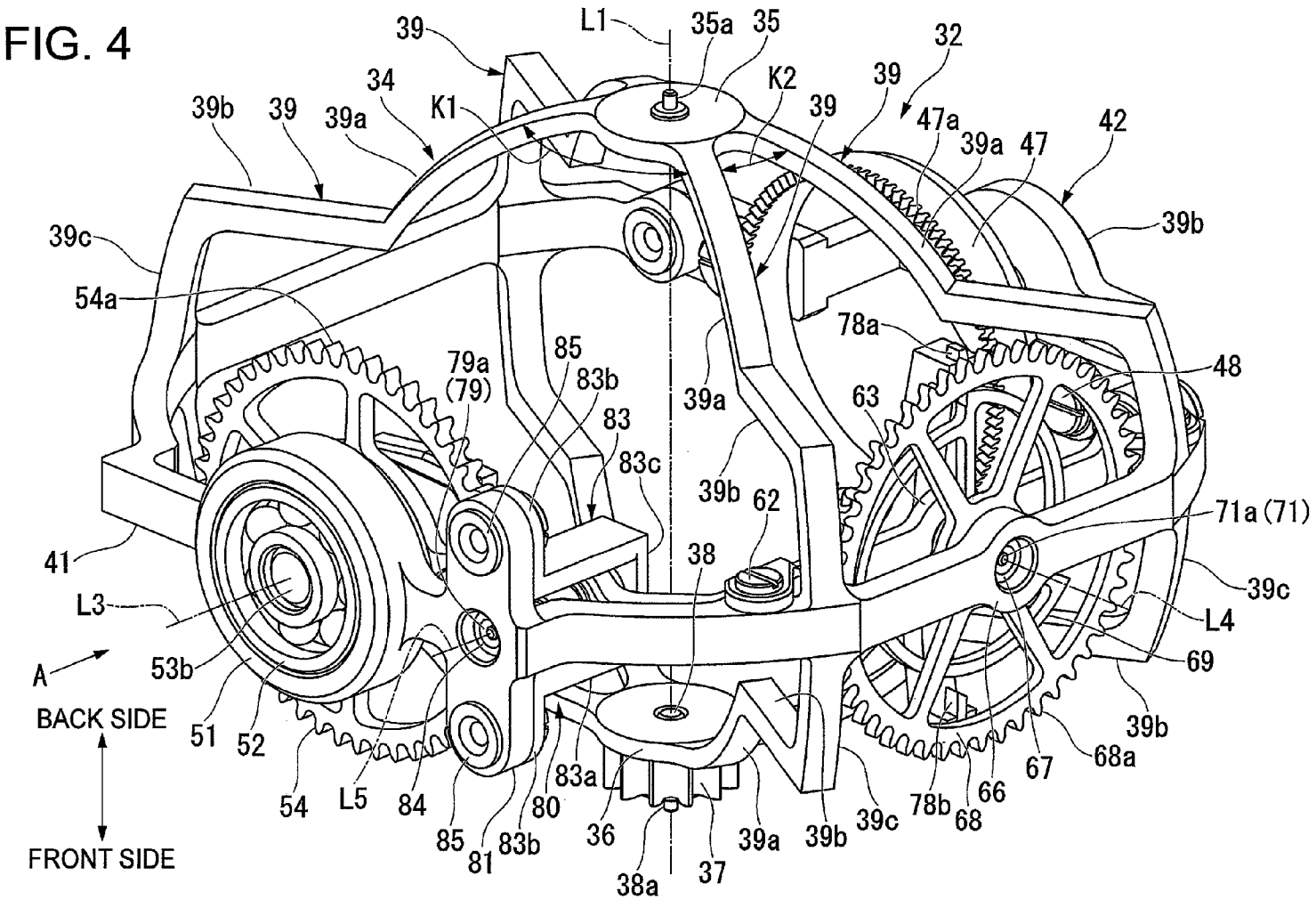
FIG. 4 is a perspective view of an outer carriage according to the first embodiment of the present invention as seen from one side.
Figure 5:
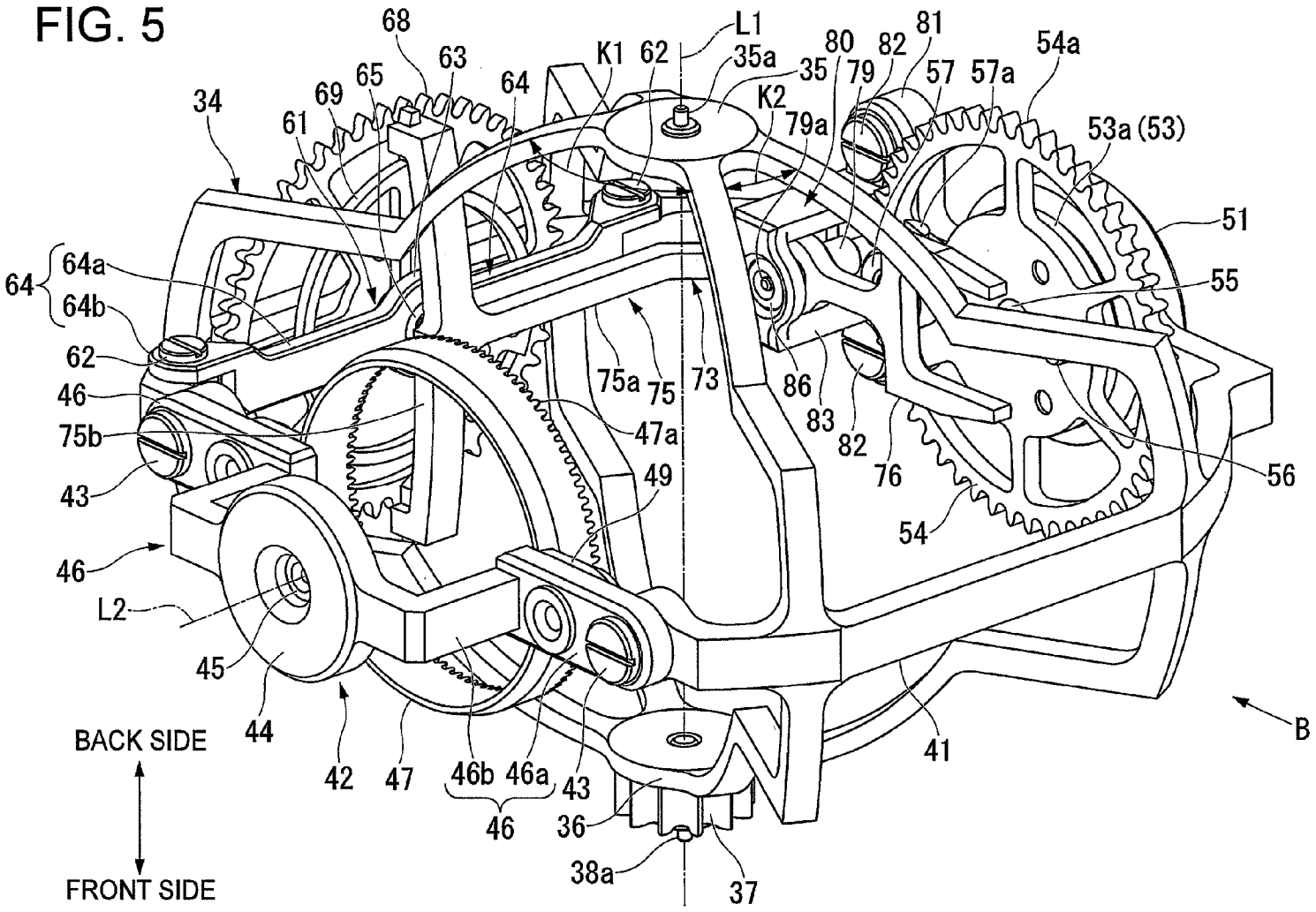
FIG. 5 is a perspective view of the outer carriage according to the first embodiment of the present invention as seen from the other side.
Figure 6:
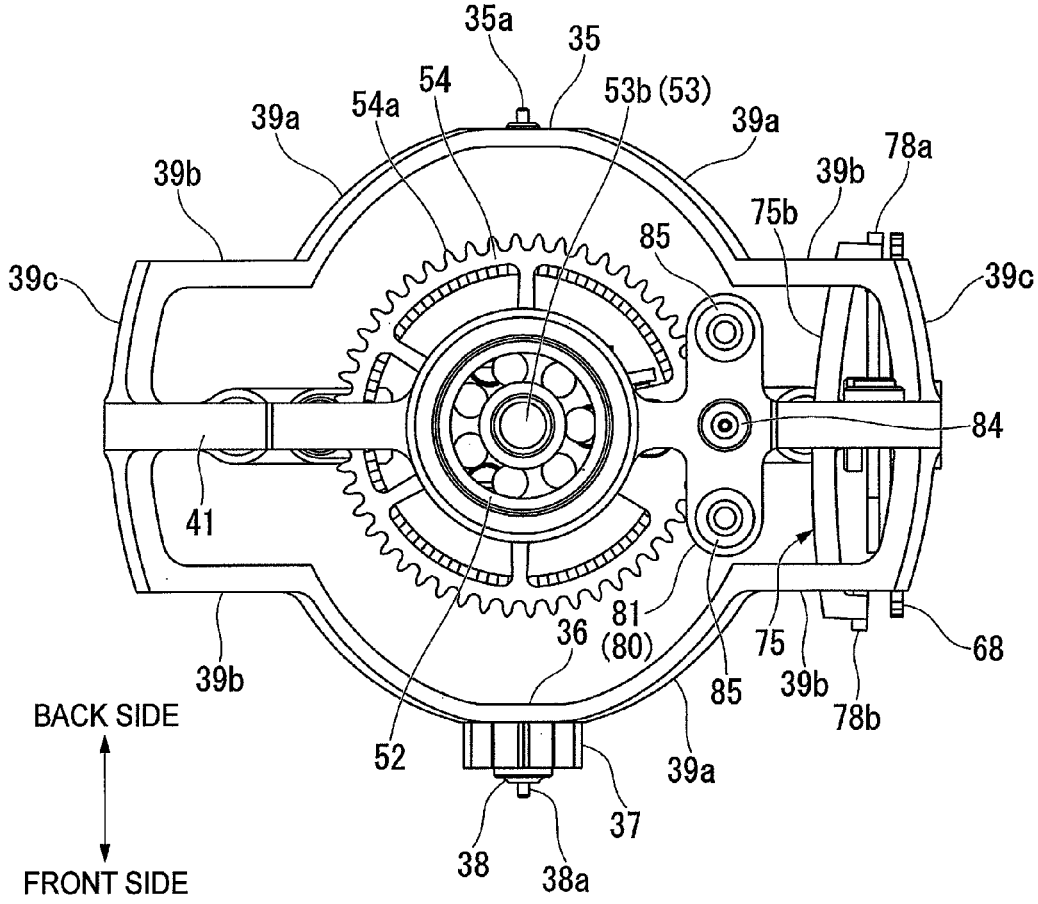
FIG. 6 is a diagram taken in the direction of arrow A in FIG. 4.
Figure 7:
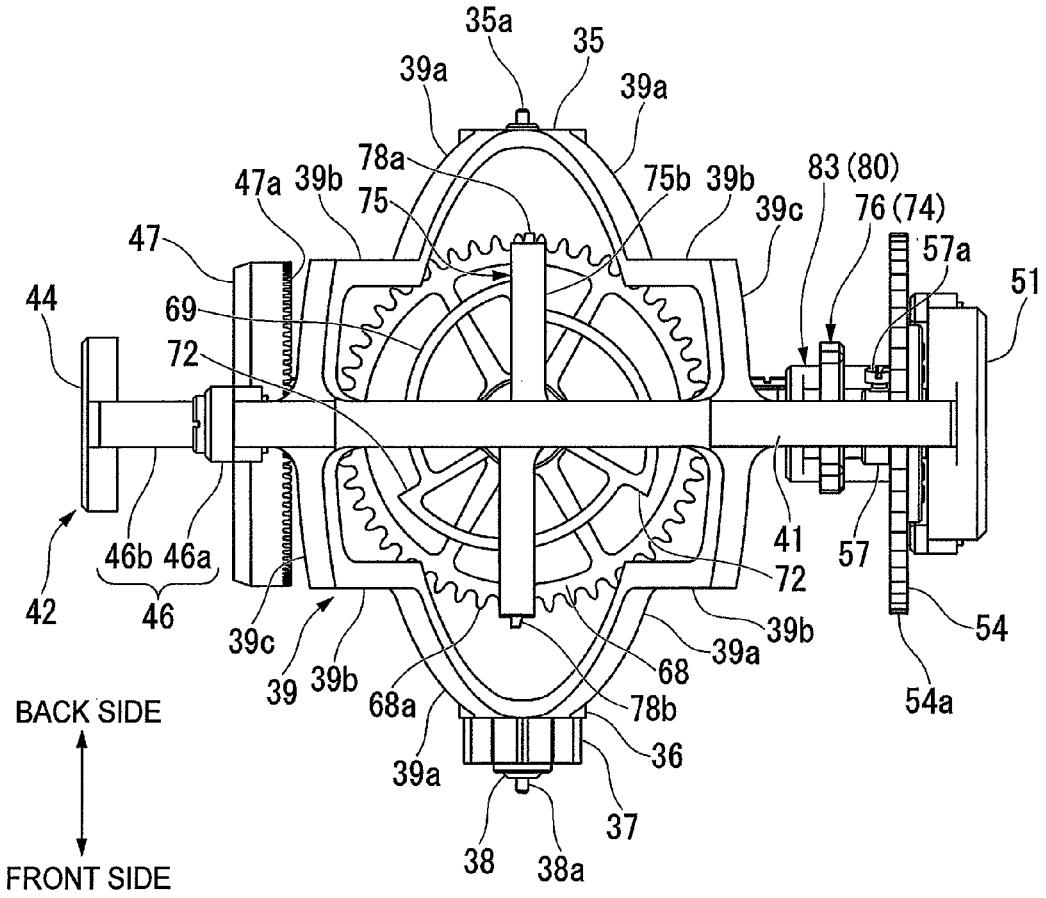
FIG. 7 is a diagram taken in the direction of arrow B in FIG. 5.

FIG. 4 is a perspective view of the outer carriage 32 as seen from one side, FIG. 5 is a perspective view of the outer carriage 32 as seen from the other side, FIG. 6 is a diagram taken in the direction of arrow A in FIG. 4, and FIG. 7 is a diagram taken in the direction of arrow B in FIG. 5.

As shown in FIGS. 4 through 7, the outer carriage 32 has an outer frame 34 constituting the outer framework of the outer carriage. The outer frame 34 is equipped with a disc-like back base portion 35 arranged on the back side, and a disc-like front base portion 36 arranged on the front side.

In the following description of the outer carriage 32, the radial direction of each base portion 35, 36 will be simply referred to as the radial direction, and the peripheral direction of each base portion 35, 36 will be simply referred to as the peripheral direction.

The back base portion 35 is provided with a pivot portion 35*a* protruding toward the back side carriage bridge 24. This pivot portion 35*a* is rotatably supported by a hole jewel (not shown) provided in the back side carriage bridge 24.

On the other hand, the front base portion 36 is situated on the front side of the stationary wheel 31 via a recess 23*a* formed in the front side carriage bridge 23. And, on the front side of the front base portion 36, there is provided an outer carriage pinion 37, and this outer carriage pinion 37 is in mesh with the cogwheel portion 26*c* of the third wheel & pinion 26.

A shaft portion 38 is forced into the front base portion 36 and the outer carriage pinion 37. Due to this shaft portion 38, the front base portion 36 and the outer carriage 37 rotate integrally. Further, at one end of the shaft portion 38, there is integrally formed a pivot portion 38*a* protruding from the outer carriage pinion 37 toward the front carriage bridge 23 side. This pivot portion 38*a* is rotatably supported by a hole jewel (not shown) provided in the front side carriage bridge 23.

The pivot portion 35*a* of the back base portion 35 and the pivot portion 36*a* of the front base portion 36 are arranged in the same straight line, and this straight line constitutes the rotation axis L1 of the outer carriage 32.

Between the back base portion 35 and the front base portion 36, there are integrally formed four longitudinal frames 39 so as to be astride the back base portion 35 and the front base portion 36. The longitudinal frames 39 are formed by integrating a pair of curved portions 39*a* extending radially outwards while curving from the base portions 35 and 36, a pair of radial extension portions 39 extending radially outwards from the curved portions 39*a*, and an axial extension portion 39*c* connecting the distal ends of these radial extension portions 39*b*.

By thus constructing the longitudinal frames 39, it is possible to prevent interference between the stationary wheel 31 and the outer frame 34 even if the front base portion 36 protrudes on the front side of the stationary wheel 31.

Further, the four longitudinal frames 39 are arranged in twos so as to be in point symmetry with respect to the rotation axis L1. In other words, the four longitudinal frames 39 are arranged such that there are formed two large interval portions K1 of a large peripheral distance and two small interval portions K2 of a smaller peripheral distance as compared with the large interval portions K1, and that the large interval portions K1 and the small interval portions K2 are formed alternately.

A lateral frame 41 extending in the peripheral direction so as to connect the axial extension portions 39*c* is integrally formed substantially at the center in the axial direction of the axial extension portions 39*c* of the longitudinal frames 39. Of this lateral frame 41, the portion corresponding to one large interval portions K1 is cut, and an inner carriage bearing portion 42 is fixed in position through fastening by a screw 43 so as to connect the cut portions.

The inner carriage bearing portion 42 serves to rotatably support the inner carriage 33, and is formed by integrating a disc-like bearing seat 44, and a leg portion 46 extending on both sides of the center in the radial direction of the bearing seat 44.

At the center in the radial direction of the bearing seat 44, there is provided a hole jewel 45 for rotatably supporting the inner carriage 33. The center axis L2 of the hole jewel 45 is orthogonal to the rotation axis L1 of the outer carriage 32, that is, extends along the radial direction of the outer carriage 32.

The leg portion 46 is formed by a screw seat 46*a* abutting the lateral frame 41 and formed substantially as a parallelepiped so as to be elongated in the extending direction of the lateral frame 41, and a raise portion 46*b* bent and extending from the proximal end (bearing seat 44 side end) of the screw seat 46*a* toward the side opposite the lateral frame 41. And, the bearing seat 44 is connected to the distal end of the raised portion 46*b*. That is, the bearing seat 44 is arranged so as to be away from the lateral frame 41.

A screw hole (not shown) is formed at the distal end side of the screw seat 46*a*. The screw 43 is inserted into this screw hole, and is further threaded into the lateral frame 41, whereby the inner carriage bearing portion 42 is fastened and fixed by the screw 43. On the other hand, an escape drive stationary wheel 47 is fastened and fixed to the proximal end side of the screw seat 46*a* by a screw 48.

The escape drive stationary wheel 47 serves to rotate an escape wheel & pinion 124 described below, and is formed in a substantially ring-like configuration. And, the escape drive stationary wheel 47 is arranged such that the center axis thereof is coaxial with the center axis L2 of the hole jewel 45 provided in the inner carriage bearing portion 42. Further, the escape drive stationary wheel 47 has tooth portions 47*a* at the peripheral edge on the rotation axis L1 side. Further, the escape drive stationary wheel 47 integrally has a pair of mounting stays 49 at the position corresponding to the screwseat 46*a* of the inner carriage bearing portion 42. A screw 48 is inserted into these mounting stays 49; further, the screw is threaded into the screw seat 46*a*, whereby the mounting stays 49 are fastened and fixed by the screw 48.

The lateral frame 41 integrally has a ring-like bearing holder 51 on the side opposite the inner carriage bearing portion 42 (escape drive stationary wheel 47) with the rotation axis L1 therebetween. This bearing holder 51 is provided with a ball bearing 52.

The ball bearing 52 is arranged such that the center axis L3 thereof is coaxial with the center axis L2 of the hole jewel 45 provided in the inner carriage bearing portion 42. A rotary plate 53 is rotatably supported by the ball bearing 52. The rotary plate 53 is formed by integrating a substantially disc-like plate main body 53*a*, and a support shaft 53*b* protruding from the radial center of the plate main body 53*a*. This support shaft 53*b* is rotatably supported by the ball bearing 52.

A constant-force spring winding-up wheel 54 is fixed to the plate main body 53*a* of the rotary plate 53, and the constant-force spring winding-up wheel 54 and the rotary plate 53 rotate integrally. Tooth portions 54*a* are formed on the outer peripheral portion of the constant-force spring winding-up wheel 54. The tooth portions 54*a* are in mesh with the tooth portions 31*a* of the stationary wheel 31 (See FIG. 3).

At the center in the radial direction of the constant-force spring winding-up wheel 54, there is provided a hole jewel 55 for rotatably supporting the inner carriage 33. Further, an engagement pin 56 protruding toward the rotation axis L1 side is mounted to the constant-force spring winding-up wheel 54 at a position deviated from the hole jewel 55 outwardly in the radial direction. This engagement pin 56 cooperates with a phase regulating plate 153 described below to regulate the rotational phase of the inner carriage 33 and of the constant-force spring winding-up wheel 54.

Further, the constant-force spring winding-up wheel 54 is provided with a stud support 57 on the side opposite the engagement pin 56 with the hole jewel 55 therebetween. A stud 58 is fixed to this stud support 57 via a fastening screw 57*a* (See FIG. 9). The outer end portion of a constant-force spring 59 is fixed to the stud 58 (See FIG. 9).

The constant-force spring 59 serves to impart rotational force to the inner carriage 33 with respect to the outer carriage 32, and is formed in a spiral configuration. The inner end portion of the constant-force spring 59 is fixed to the inner carriage 33 via a collet 152.

A stop wheel bearing portion 61 is fastened and fixed by a screw 62 to the lateral frame 41 at a position corresponding to one of the two small interval portions K2.

The stop wheel bearing portion 61 is formed by integrating a disc-like bearing seat 63, and a pair of leg portions 64 extending in the extending direction of the lateral frame 41 on both sides in the radial direction of the bearing seat 63. A hole jewel 65 is provided at the center in the radial direction of the bearing seat 63.

On the other hand, each leg portion 64 is formed by integrating a leg portion main body 64*a* extending from the bearing seat 63, and a screw seat 64*b* extending from the distal end of the leg portion main body 64*a*. The screw seat 64*b* is formed such that its face direction is orthogonal to the face direction of the leg portion main body 64*a*. And, the screw seat 64*b* is fastened and fixed to the lateral frame 41 by the screw 62 in a state in which it is in contact with the back side end of the lateral frame 41. In this fastened/fixed state, the bearing seat 63 and the leg portions 64 are oppose each other at a predetermined distance with respect to the lateral frame 41.

A substantially disc-like bearing seat 66 is formed so as to be integral with the lateral frame 41, at the position opposite the bearing seat 63 of the stop wheel bearing portion 61. A hole jewel 67 is provided in this bearing seat 66.

And, between the lateral frame 41 and the stop wheel bearing portion 61, there are arranged a stop wheel driving wheel 68 and a stop wheel 69, and the stop wheel driving wheel 68 and the stop wheel 69 are rotatably supported by the two hole jewels 65 and 67. In this way, the rotation axis L4 of the stop wheel driving wheel 68 and of the stop wheel 69 is orthogonal to the rotation axis of the constant-force spring winding-up wheel 54 (the center axis L3 of the ball bearing 52), that is, it extends along the radial direction of the outer carriage 32.

The stop wheel driving wheel 68 and the stop wheel 69 are arranged so as to be superimposed one on the other with a slight distance therebetween, and a shaft portion 71 is forced in their respective centers in the radial direction. Due to this shaft portion 71, the stop wheel driving wheel 68 and the stop wheel 69 are integrated with each other. Further, pivot portions 71*a* are provided at both ends of the shaft portion 71, and these pivot portions 71*a* are rotatably supported by the hole jewels 65 and 67, respectively. As a result, it is possible for the stop wheel driving wheel 68 and the stop wheel 69 to rotate integrally with respect to the lateral frame 41.

Tooth portions 68*a* are formed on the outer peripheral portion of the stop wheel driving wheel 68. The tooth portions 68*a* are in mesh with the tooth portions 31*a* of the stationary wheel 31.

Here, the pitch circle diameter of the stop wheel driving wheel 68 is set to the same as the pitch circle diameter of the constant-force spring winding-up wheel 54. Further, the number of teeth of the tooth portions 68*a* of the stop wheel driving wheel 68 is set to be the same as the number of teeth of the tooth portions 54*a* of the constant-force spring winding-up wheel 54.

Figure 8:
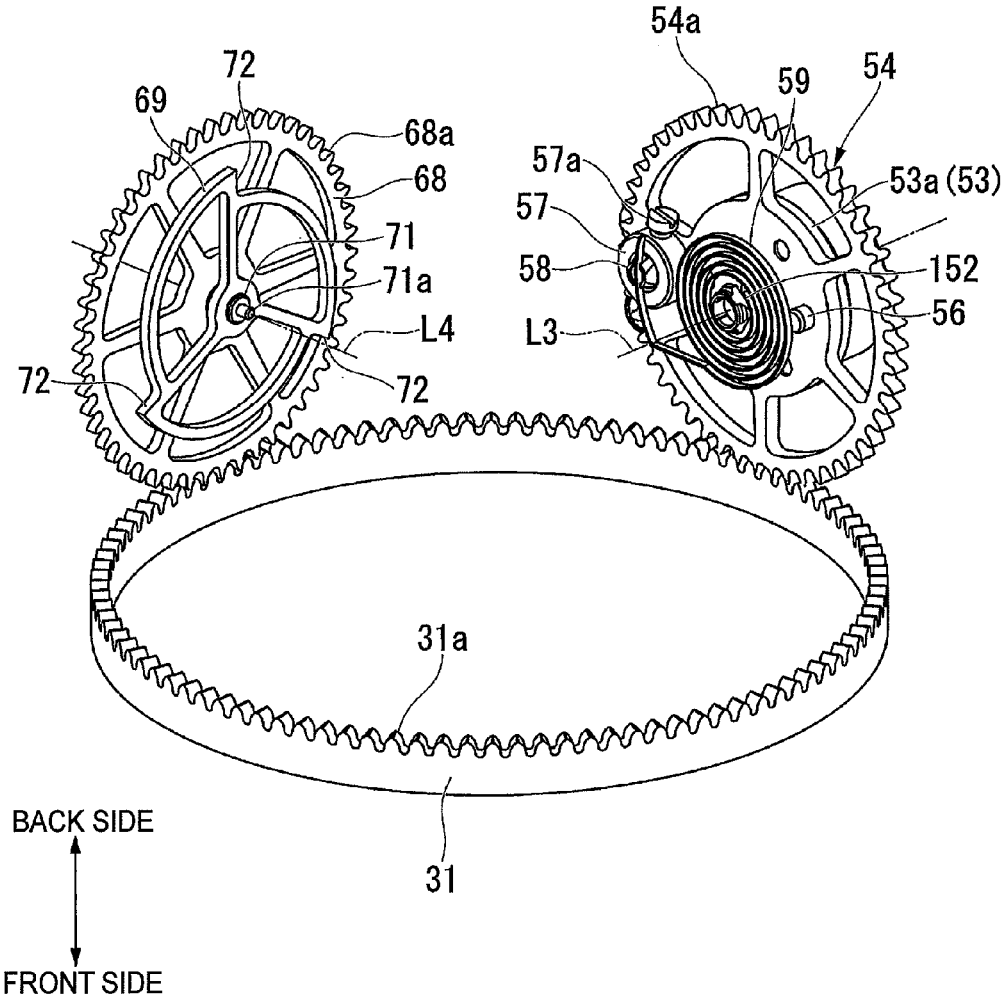
FIG. 8 is a perspective view illustrating how a stop wheel driving wheel and a constant-force spring winding-up wheel are mesh-engaged with a stationary wheel in the first embodiment of the present invention.

FIG. 8 is a perspective view illustrating how the stop wheel driving wheel 68 and the constant-force spring winding-up wheel 54 are held in mesh with the stationary wheel 31.

As shown in the drawing, the stop wheel driving wheel 68 and the constant-force spring winding-up wheel 54 are held in mesh with the stationary wheel 31 in a state in which their respective rotation axes (L4 and L3) are orthogonal to each other. Further, the stop wheel driving wheel 68 and the constant-force spring winding-up wheel 54 are mounted to the outer frame 34, so that, when the outer frame 34 makes one rotation around the rotation axis L1, they rotate simultaneously at the same rotational speed. That is, the number of teeth of the stop wheel driving wheel 68 and the number of teeth of the constant-force spring winding-up wheel 54 are set to the same number.

The number of teeth of the stationary wheel 31, the number of teeth of the stop wheel driving wheel 68, and the number of teeth of the constant-force spring winding-up wheel 54, are set to numbers that are mutually divisible. More specifically, in the present embodiment, the number of teeth of the stop wheel driving wheel 68 and the number of teeth of the constant-force spring winding-up wheel 54 are set to 40, and the number of teeth of the stationary wheel 31 is set to 80. However, it is desirable for the number of teeth of the stationary wheel 31, the number of teeth of the stop wheel driving wheel 68, and the number of teeth of the constant-force spring winding-up wheel 54 to be set to numbers mutually indivisible. This will be discussed below in detail.

As shown in FIG. 8, the stop wheel 69 is a member formed, for example, of a material exhibiting crystal orientation such as metal material or single-crystal silicon, and is formed by electroforming, or a technique based on an optical method such as photolithography, for example, LIGA (Lithographic Galvanoformung Abformung) process, DRIE (Deep Reactive Ion Etching), MIM (Metal Injection Molding), etc.

On the outer peripheral portion of the stop wheel 69, there are formed a plurality of (three in this embodiment) hook portions 72 so as to protrude radially outwards. The hook portions 72 are arranged at equal peripheral intervals.

In this construction, a stopper 73 is engaged and disengaged with and from the stop wheel 69.

Figure 9:
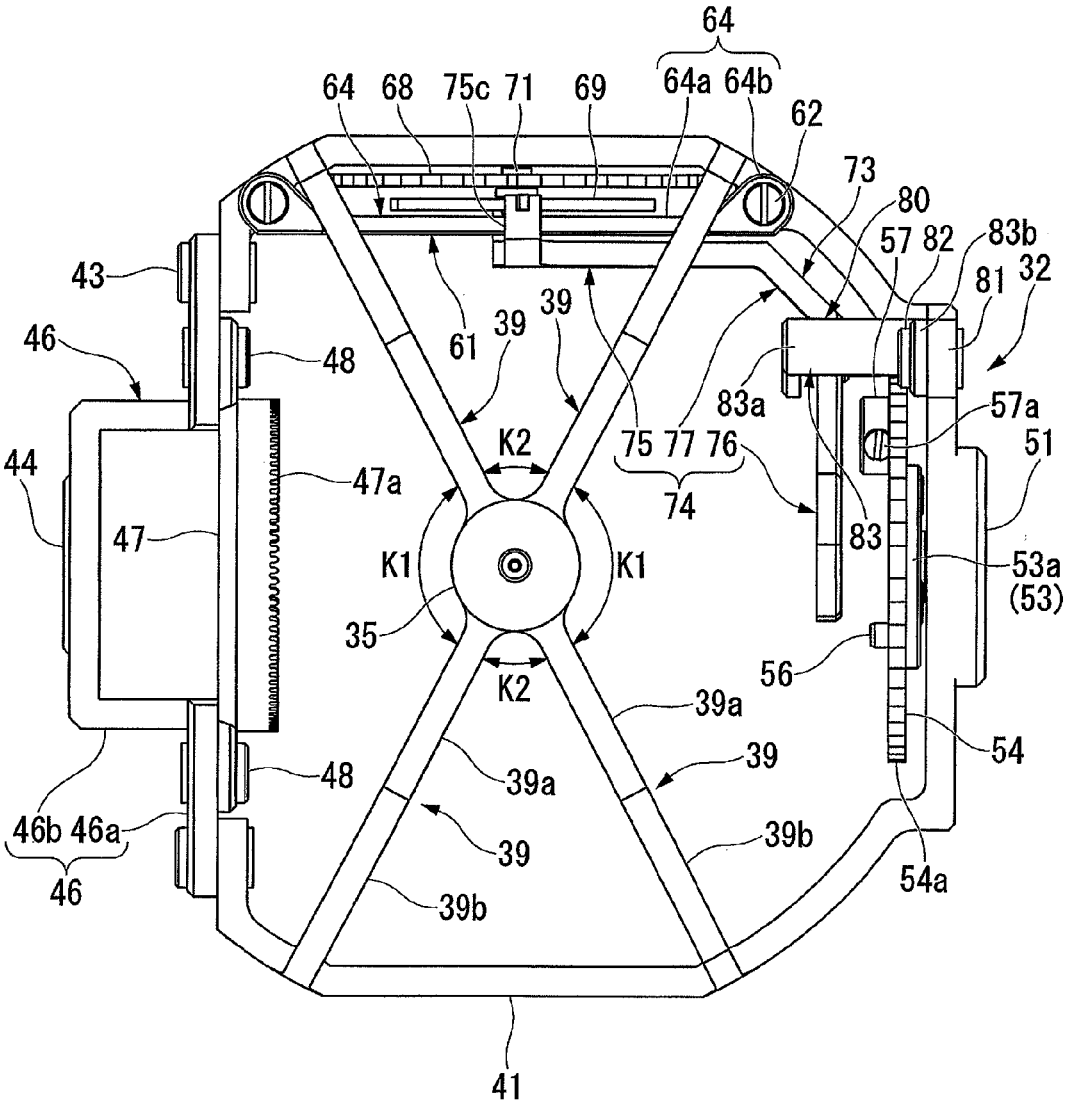
FIG. 9 is a plan view, as seen from the back side, of the outer carriage according to the first embodiment of the present invention.
Figure 10:
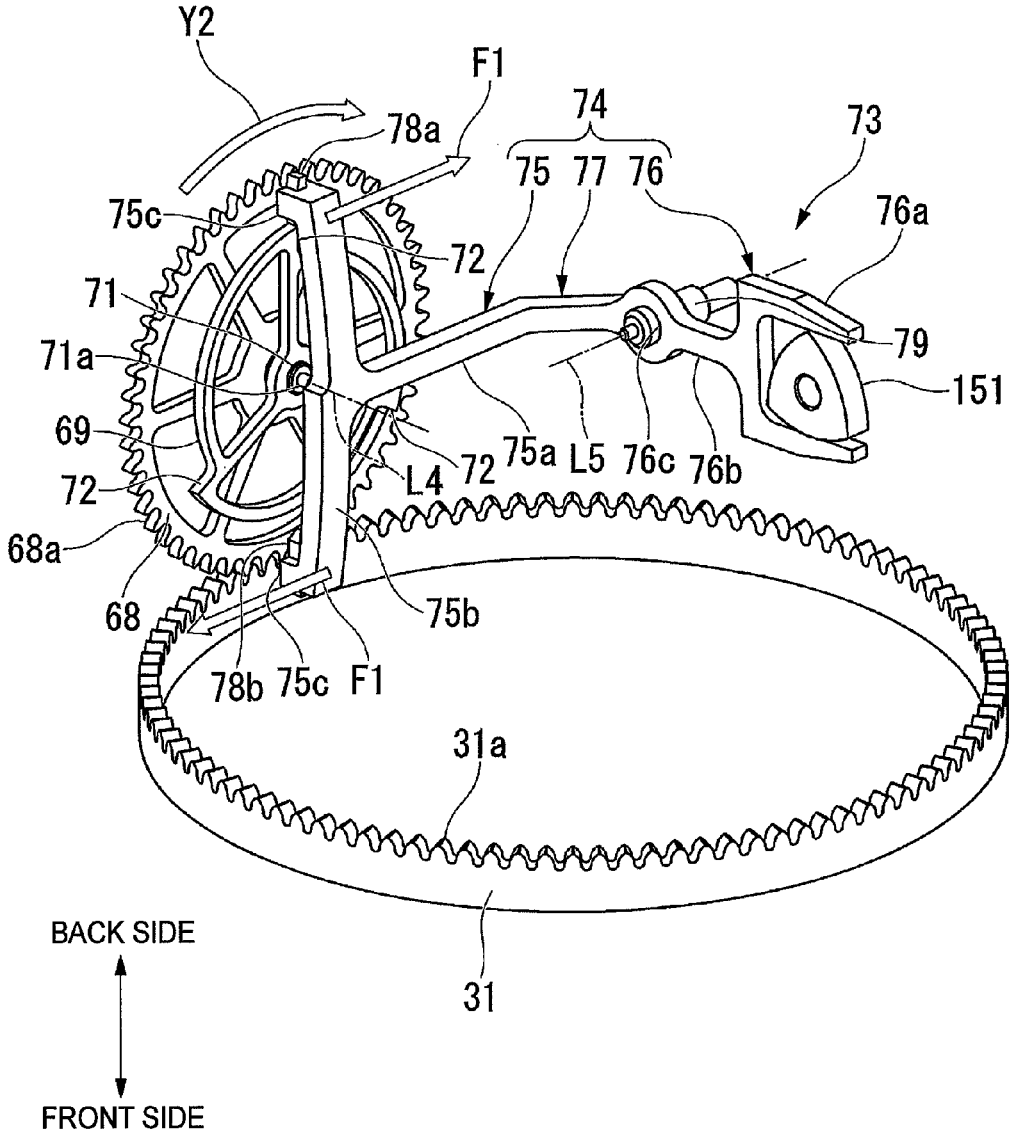
FIG. 10 is a perspective view illustrating the positional relationship between a stop wheel and a stopper in the first embodiment of the present invention.

FIG. 9 is a plan view of the outer carriage 32 as seen from the back side, and FIG. 10 is a perspective view illustrating the positional relationship between the stop wheel 69 and the stopper 73.

As shown in FIGS. 9 and 10, the stopper 73 has a stopper pallet fork 74 of a substantially L-shaped configuration in plan view as seen from the back side. More specifically, the stopper pallet fork 74 is formed by integrating a stopper pallet fork body 75 arranged on the stop wheel driving wheel 68 side, a fork portion 76 arranged on the constant-force spring winding-up wheel 54 side, and a connecting portion 77 connecting the stopper pallet fork body 75 and the fork portion 76.

The stopper pallet fork body 75 extends along the lateral frame 41 to which the stop wheel driving wheel 68 is mounted, and is formed in a substantially T-shaped configuration in plan view as seen from the inner side in the radial direction of the outer carriage 32. More specifically, the stopper pallet fork body 75 is equipped with an arm portion 75*a* extending in the extending direction of the lateral frame 41 from the vicinity of the distal end of the leg portion 64 of the stop wheel bearing portion 61 to the vicinity of the hole jewel 65, and a pawl support body 75*b* extending from the distal end of the arm portion 75*a* along the radial direction of the stop wheel driving wheel 68 (stop wheel 69).

The length of the pawl support body 75*b* is set to be approximately the same as the outer diameter of the stop wheel driving wheel 68. At both longitudinal ends of the pawl support body 75*b*, there are integrally formed protrusions 75*c* protruding toward the stop wheel 69 side. Pallets 78*a* and 78*b* are respectively mounted to these protrusions 75*c*. The pallets 78*a* and 78*b* protrude from the protrusions 75*c* along the longitudinal direction of the pawl support body 75*b*, and the distal end portion there can be brought into contact with the hook portion 72 of the stop wheel 69. As a result, the stopper 73 is engaged and disengaged with and from the stop wheel 69. The operation of engaging and disengaging the stopper 73 with and from the stop wheel 69 will be described in detail below.

The fork portion 76 extends along the lateral frame 41 to which the constant-force spring winding-up wheel 54 is mounted. The fork portion 76 is formed by a forked fork main body 76*a* arranged at a position corresponding to the center in the radial direction of the constant-force spring winding-up wheel 54, and an arm portion 76*b* astride the proximal end of the fork main body 76*a* and the connecting portion 77. The fork main body 76*a* is engaged with a triangular cam 151 (See FIG. 10) provided on the inner carriage 33.

A through-hole 76*c* is formed at the proximal end of the arm portion 76*b*, and a stopper pallet staff 79 is forced into this through-hole 76*c*. Pivot portions 79*a* are integrally formed at both ends of the stopper pallet staff 79.

As illustrated in detail in FIGS. 4 and 5, at the position corresponding to the stopper pallet staff 79 of the lateral frame 41, there is provided a bearing portion 80 rotatably supporting the stopper pallet staff 79.

The bearing portion 80 is equipped with a pedestal portion 81 integrally formed with the lateral frame 41 and extending in a direction orthogonal to the extending direction of the lateral frame 41, and a support portion 83 fastened and fixed to this pedestal portion 81 via a screw 82.

At the portion of the pedestal portion 81 crossing the lateral frame 41, there is provided a hole jewel 84. The pivot portion 79*a* integrally formed at one end of the stopper pallet staff 79 is rotatably supported by this hole jewel 84. Further, at both longitudinal ends of the pedestal portion 81, there are provided female screw portions 85 allowing threading-in of the screws 82 for fastening and fixing the support portion 83.

The support portion 83 is formed in a substantially hat-like sectional configuration. That is, the support portion 83 is equipped with a support portion main body 83*a* of a substantially U-shaped sectional configuration allowing the reception of the stopper pallet staff 79, and a pair of flange portions 83*b* integrally formed at the distal end of the support portion main body 83*a*. And, the flange portions 83*b* are arranged so as to abut the pedestal portion 81.

The flange portions 83*b* have insertion holes (not shown) allowing insertion of the screws 82, and the screws 82 are inserted into the insertion holes; further, the screws 82 are threaded into the female screw portions 85 of the pedestal portion 81, whereby the support portion 83 is fastened and fixed to the pedestal portion 81.

In the bottom wall portion 83*c* of the support portion main body 83*a*, there is provided a hole jewel 86 so as to be coaxial with the hole jewel 84 of the pedestal portion 81. Rotatably supported by this hole jewel 86 is the pivot portion 79*a* formed integrally at the other end of the stopper pallet staff 79.

In this way, the stopper pallet staff 79 is arranged such that its axis L5 is parallel to the rotation axis of the constant-force spring winding-up wheel 54 (the center axis L3 of the ball bearing L3), and orthogonal to the rotation axis L4 of the stop wheel driving wheel 68 and of the stop wheel 69.

And, the stopper pallet fork 74 into which the stopper pallet staff 79 is forced swings around the axis L5 of the stopper pallet staff 79. Through the swinging of the stopper pallet fork 74, the pallet 78*a* arranged on the back side of the stopper pallet fork body 75 draws near to the stop wheel 69 side, whereas the pallet 78*b* arranged on the front side is spaced away from the stop wheel 69; and, conversely, the pallet 78*b* arranged on the front side draws near to the stop wheel 69 side, whereas the pallet 78*a* arranged on the back side is spaced away from the stop wheel 69.

As a result, the pallet 78*a* arranged on the back side of the stopper pallet fork body 75 and the pallet 78*b* arranged on the front side thereof are engaged in turn with the stop wheel 69. This swinging operation of the stopper pallet fork 74 is based on the rotational operation of the triangular cam 151 engaged with the fork portion 76 of the stopper pallet fork 74. The triangular cam 151 is provided on the inner carriage 33.

In this construction, the center of gravity of the outer carriage 32 is situated in the rotation axis L1 of the outer carriage 32.

(Inner Carriage)

Figure 11:
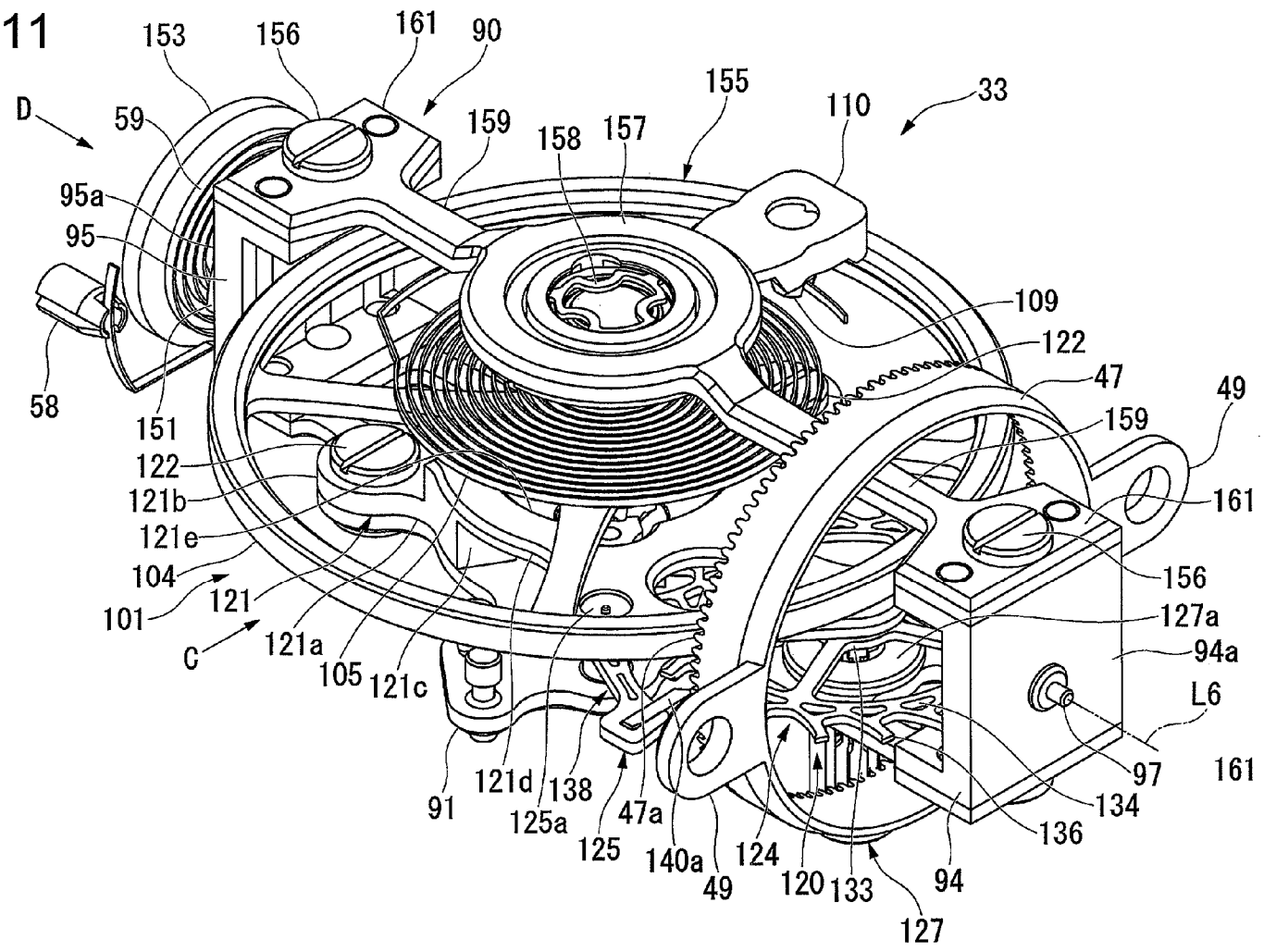
FIG. 11 is a perspective view of an inner carriage according to the first embodiment of the present invention as seen from one side.
Figure 12:
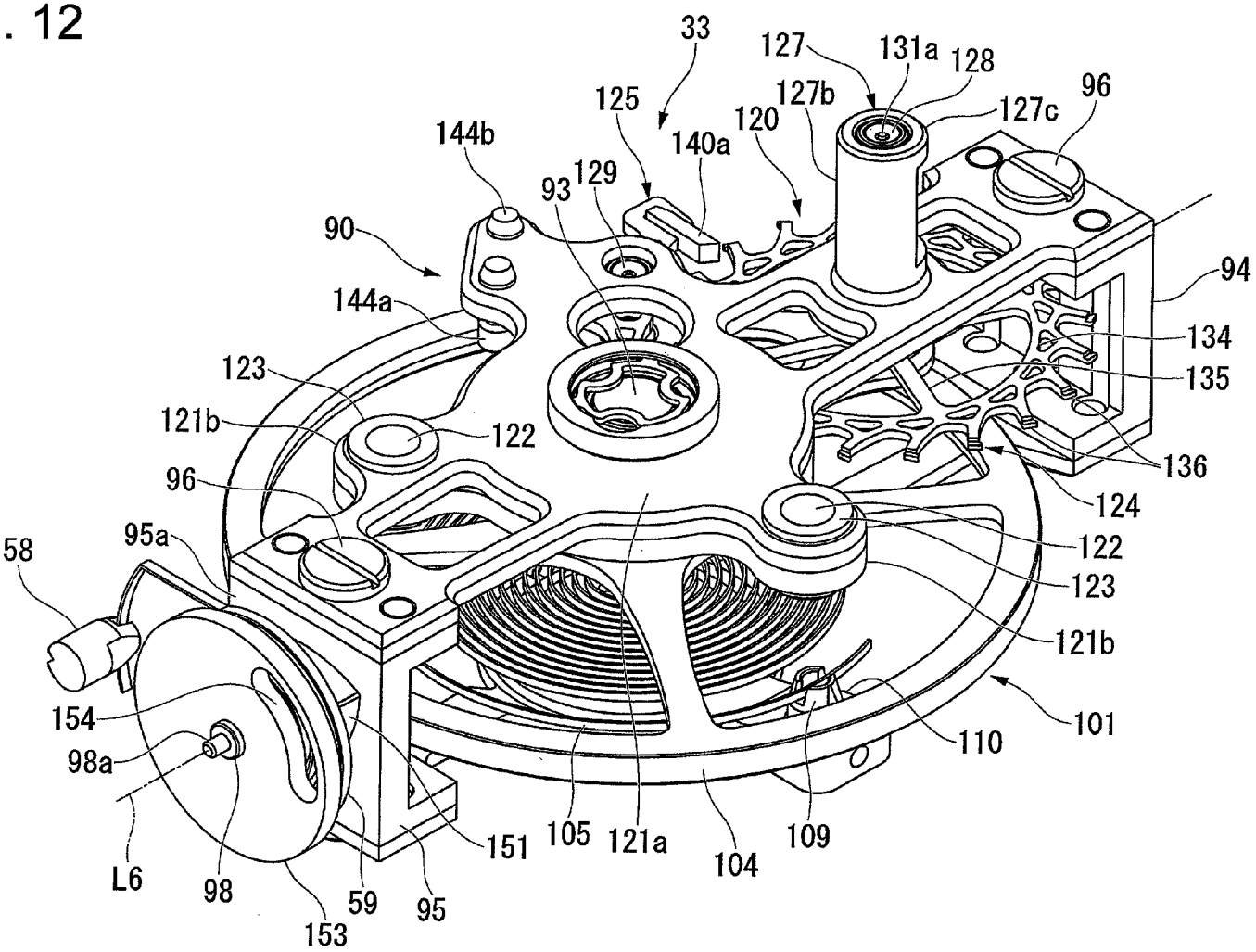
FIG. 12 is a perspective view of the inner carriage according to the first embodiment of the present invention as seen from the other side.
Figure 13:
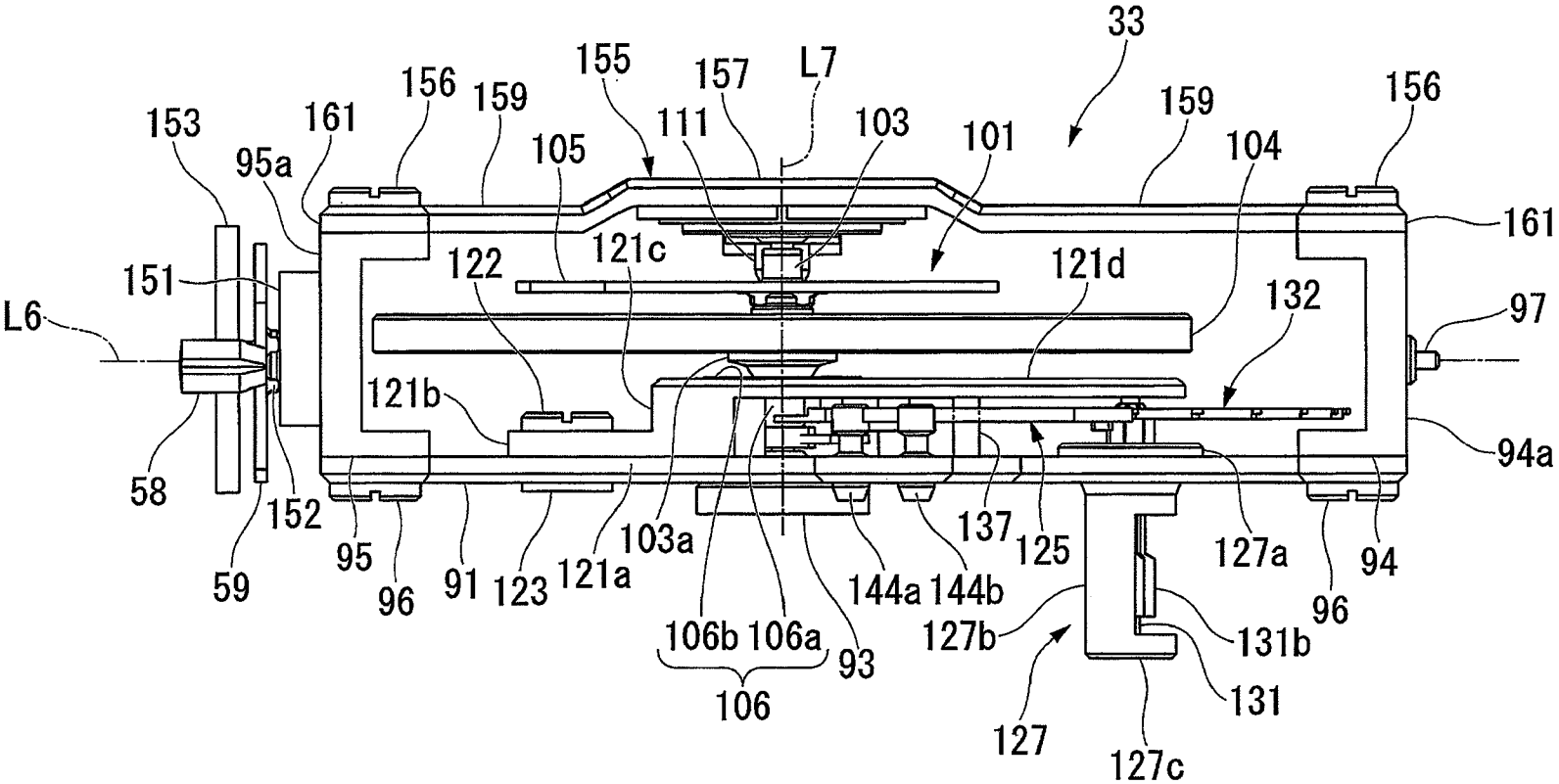
FIG. 13 is a diagram taken in the direction of arrow C in FIG. 11.
Figure 14:
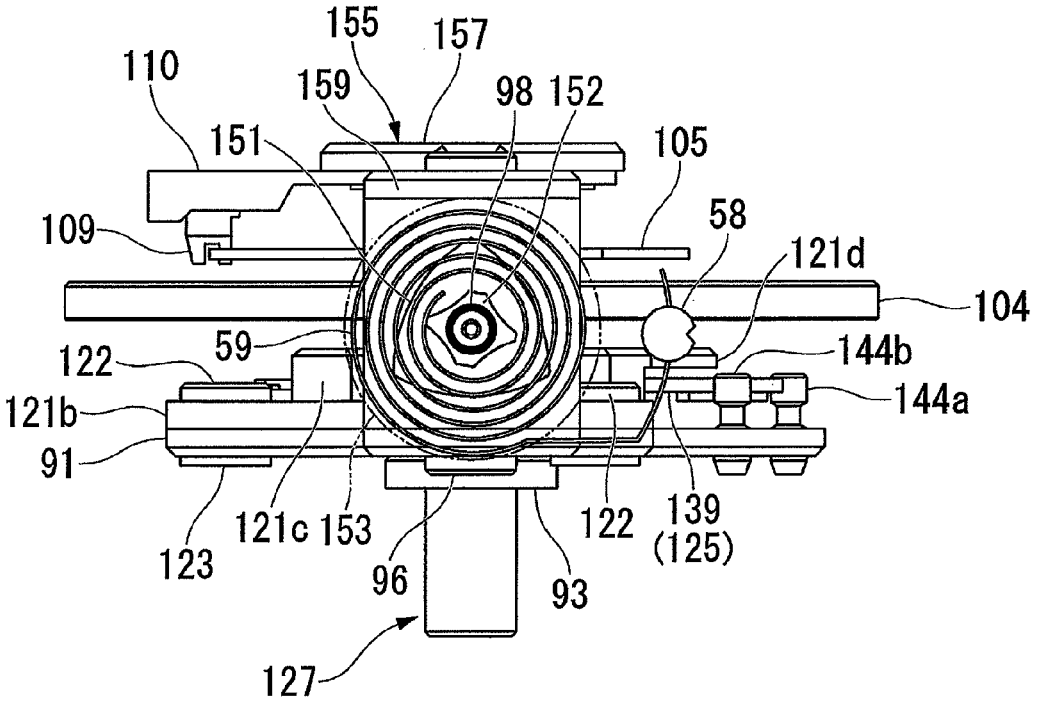
FIG. 14 is a diagram taken in the direction of arrow D in FIG. 11.

FIG. 11 is a perspective view of the inner carriage 33 as seen from one side, FIG. 12 is a perspective view of the inner carriage 33 as seen from the other side, FIG. 13 is a diagram taken in the direction of arrow C in FIG. 11, and FIG. 14 is a diagram taken in the direction of arrow D in FIG. 11.

As shown in FIGS. 11 through 14, the inner carriage 33 has an inner frame 90 constituting the inner framework of the inner carriage 33. The inner frame 90 has a base plate 91.

The base plate 91 is formed so as to be elongated in the direction of the center axis L2 (See FIG. 5) of the hole jewel 45 provided in the inner carriage bearing portion 42 of the outer carriage 32. Substantially at the center in the longitudinal direction of the base plate 91, there is provided an anti-vibration bearing 93. Further, pillar blocks 94 and 95 are respectively fastened and fixed to both longitudinal ends of the base plate 91 by screws 96. The pillar blocks 94 and 95 are formed in a substantially U-shaped sectional configuration, and are arranged with their respective openings directed toward the longitudinal center of the base plate 91.

Of the two pillar blocks 94 and 95, the first pillar block 94 has a bottom portion 94*a* at the central portion of which there is provided a pivot portion 97. The pivot portion 97 protrudes outwards in the longitudinal direction of the base plate 91. The pivot portion 97 is rotatably supported by the hole jewel 45 provided at the inner carriage bearing portion 42 of the outer carriage 32.

On the other hand, of the two pillar blocks 94 and 95, the second pillar block 95 has a bottom portion 95*a* at the central portion of which there is provided a pivot shaft 98. The pivot shaft 98 protrudes outwards in the longitudinal direction. Further, a pivot portion 98*a* protrudes from the distal end of the pivot shaft 98. This pivot portion 98*a* is rotatably supported by the hole jewel 55 provided in the constant-force spring winding-up wheel 54.

In this way, the inner carriage 33 is supported by the pivot portions 97 and 98*a* with respect to the outer carriage 32 so as to be rotatable around the center axis L2 of the hole jewel 45 provided at the inner carriage bearing portion 42 and around the center axis L3 of the ball bearing 52 provided at the outer carriage 32. That is, the rotation axis L6 of the inner carriage 33 is orthogonal to the rotation axis L1 of the outer carriage 32.

Further, forced into the pivot shaft 98 are a triangular cam 151, a collet 152, and a phase regulating plate 153 in that order from the bottom portion 95*a* side of the second pillar block 95. That is, the triangular cam 151, the collet 152, and the phase regulating plate 153 rotate integrally with the inner carriage 33.

The triangular cam 151 is formed so as to cause the stopper pallet fork 74 to reciprocate and swing three times through one rotation. The inner end portion of the constant-force spring 59 is bonded to the collet 152. That is, the inner carriage 33 is rotatably supported with respect to the outer carriage 32, and is connected to the outer carriage 32 via the constant-force spring 59.

Figure 15:
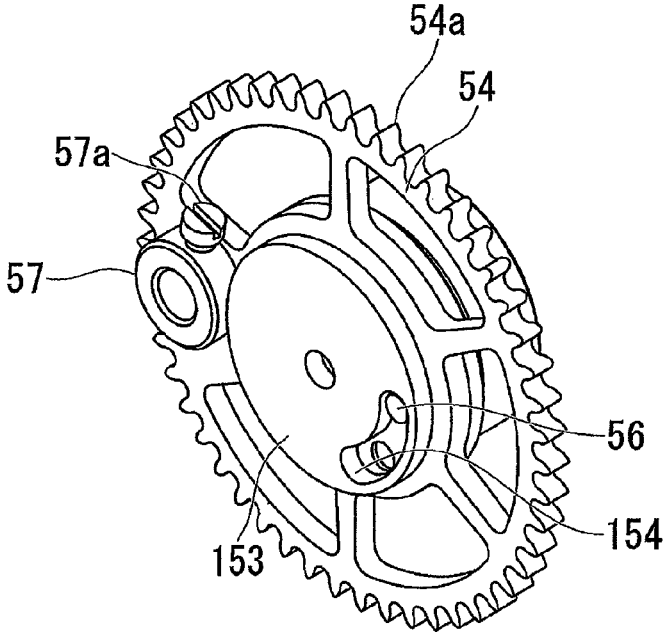
FIG. 15 is a diagram illustrating the positional relationship between the constant-force spring winding-up wheel and a phase regulating plate in the first embodiment of the present invention.

FIG. 15 is an explanatory view illustrating the positional relationship between the constant-force spring winding-up wheel 54 and the phase regulating plate 153 in the state in which the inner carriage 33 is mounted to the outer carriage 32.

As shown in FIGS. 12 and 15, the phase regulating plate 153 is formed as a disc, and its outer diameter is set to be somewhat larger than the non-load outer diameter of the constant-force spring 59. In the state in which the inner carriage 33 is mounted to the outer carriage 32, the phase regulating plate 153 is opposite the constant-force spring winding-up wheel 54 in the direction of the rotation axis L6 of the inner carriage 33.

At the position corresponding to the engagement pin 56 provided on the constant-force spring winding-up wheel 54 of the outer carriage 32, the phase regulating plate 153 has an elongated hole 154 allowing insertion of this engagement pin 56. The elongated hole 154 is formed so as to extend arcuately along the peripheral direction. Further, the elongated hole 154 is formed such that, in the state in which the engagement pin 56 is inserted into this elongated hole 154, the rotational angle of the phase regulating plate 153 with respect to the constant-force spring winding-up wheel 54 is not deviated by 60 degrees or more.

Referring back to FIGS. 11 through 14, at the end on the opposite side of the base plate 91 of the two pillar blocks 94 and 95, there is provided a bridge plate 155 so as to be astride the two pillar blocks 94 and 95. The bridge plate 155 has a substantially ring-like bearing seat 157 arranged coaxially with the anti-vibration bearing 93 provided on the base plate 91. An anti-vibration bearing 158 is provided on this bearing seat 157.

Integrally formed with the bearing seat 157 are arm portions 159 respectively extending toward the two pillar blocks 94 and 95 from the side surface of the bearing seat 157. At the distal ends of the arms 159, there are integrally formed stays 161. These stays 161 are formed in a substantially rectangular configuration so as to be in correspondence with the configuration of the side surfaces of the two pillar blocks 94 and 95. The stays 161 are respectively fastened and fixed to the two pillar blocks 94 and 95 by screws 156. In this way, the base plate 91, the pillar blocks 94 and 95, and the bridge plate 155 are integrated to form an inner frame 90.

Here, the size of the inner frame 90, and the size of the inner diameter of the escape driving stationary wheel 47 provided on the outer carriage 32 are set to sizes allowing insertion of the inner frame 90 into the escape driving stationary wheel 47 in the state in which the inner carriage 33 is mounted to the outer carriage 32. That is, in the state in which the inner carriage 33 is mounted to the outer carriage 32, a portion of the inner frame 90 on the first pillar block 94 side is inserted into the escape driving stationary wheel 47.

In the inner frame 90, constructed as described above, a balance with hairspring 101 is rotatably supported by the anti-vibration bearing 93 of the base plate 91 and the anti-vibration bearing 158 of the bridge plate 155.

(Balance with Hairspring)

The balance with hairspring 101 is equipped with a balance staff 103 rotataby supported by the anti-vibration bearings 93 and 158, a balance wheel 104 mounted to the balance staff 103, and a hairspring 105, and makes normal and reverse rotation at a fixed oscillation cycle by the power transmitted from the hairspring 105.

The balance staff 103 is a shaft member gradually reduced in diameter stepwise as it extends from substantially the center in the axial direction toward its axial ends. At both ends of the balance staff 103, there are formed pivot portions (not shown) so as to protrude axially outwards. The pivot portions are rotatably supported by the anti-vibration bearings 93 and 158, respectively.

Here, the anti-vibration bearings 93 and 158 are provided substantially at the center in the longitudinal direction of the base plate 91 and at that of the bridge plate 155. In other words, the anti-vibration bearings 93 and 158 are provided such that their respective axes are situated in the rotation axis L1 of the outer carriage 32, and that they cross the rotation axis L1. That is, the balance with hairspring 101 is arranged such that the rotation axis L7 thereof crosses the rotation axis L1 of the outer carriage 32. Further, the center of gravity of the balance with hairspring 101 is situated in the rotation axis L1 of the outer carriage 32, and in the rotation axis L6 of the inner carriage 33.

The rotation axis L7 rotates together with the inner carriage 33, so that the fact that the rotation axis L7 and the rotation axis L1 cross each other naturally implies that the rotation axis L7 and the rotation axis L1 are in the same straight line.

The rotation axis L7 of the balance with hairspring 101 is orthogonal to the rotation axis L6 of the inner carriage 33. Further, substantially at the center in the axial direction of the balance staff 103 where the shaft diameter is maximum, there is integrally formed an outer flange portion 103*a*, and the balance wheel 104 is fitted onto and fixed to the balance staff 103 so as to be set in position by the outer flange portion 103*a*.

Further, the balance staff 103 is provided with a double roller 106 (See FIG. 13) on the side opposite the balance wheel 104 of the outer flange portion 103*a*. The double roller 106 is equipped with a cylinder portion 106*a* externally fitted onto and fixed to the balance staff 103, and an annular flange portion 106*b* integrally formed on the outer flange portion 103*a* side of the cylinder portion 106*a*. An impulse pin 107 (See FIG. 16) is provided on the flange portion 106*b* so as to protrude toward the base plate 91 side. The impulse pin 107 serves to swing a pallet fork 125 of an escapement/governor mechanism 120 described below.

The hairspring 105 is, for example, a flat hairspring wound spirally in a single plane, and the inner end portion thereof is fixed, via a collet ill, to the portion of the balance staff 103 on the bridge plate 155 side of the balance wheel 104.

On the other hand, a stud 109 is mounted to the outer end portion of the hairspring 105. The stud 109 is fixed to a stud support 110 provided on a bridge plate 155. And, the hairspring 105 serves to accumulate a power transmitted to the double roller 106 from the escapement/governor mechanism 120 described below, and to transmit this power to the balance staff 103 and the balance wheel 104.

(Escapement/Governor Mechanism)

Figure 16:
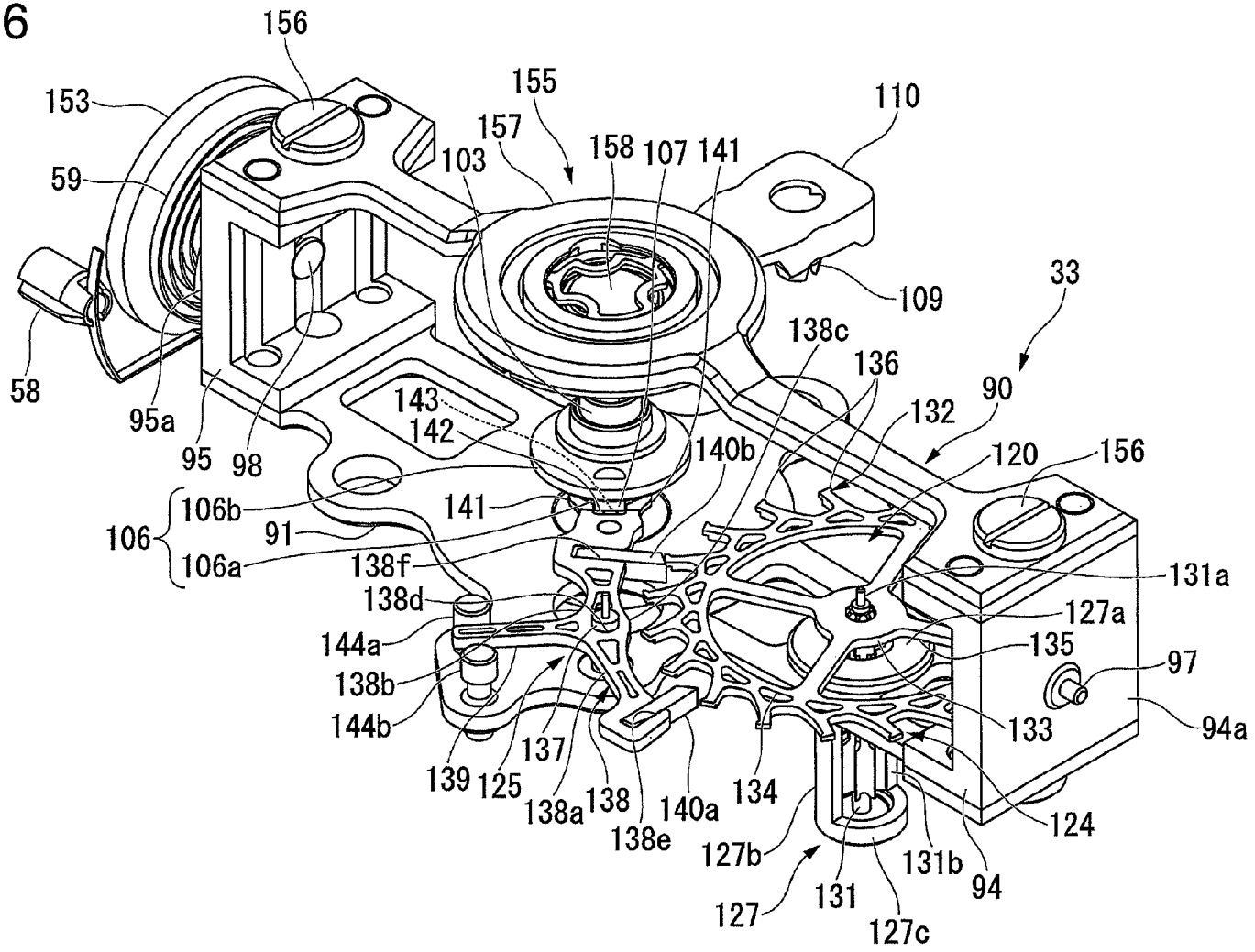
FIG. 16 is a perspective view of the inner carriage according to the first embodiment of the present invention with a part thereof removed.

FIG. 16 is a perspective view of the inner carriage 33 with a part thereof removed.

As shown in FIGS. 11 through 13 and FIG. 16, the escapement/governor mechanism 120 is mounted to the base plate 91.

The escapement/governor mechanism 120 is equipped with an escapement mechanism holder 121 mounted to the base plate 91, an escape wheel & pinion 124 rotatably supported by the escapement mechanism holder 121 and the base plate 91, and a pallet fork 125.

The escapement mechanism holder 121 is arranged on the second pillar block 95 side of the balance staff 103, and has a base portion 121*a* formed in a substantially C-shaped configuration along the balance staff 103.

On both lateral sides of the base plate 91, the base portion 121*a* has screw seats 121*b* integrally formed therewith. Screws 122 are respectively inserted into these screw seats 121*b*. The screws 122 are threaded into female screw portions 123 provided in the base plate 91, whereby the base portion 121*a* is fastened and fixed to the base plate 91.

In the vicinity of the screw seats 121*b* of the base portion 121*a*, there are respectively integrally formed raised portions 121*c*, and, further, a bearing plate 121*d* is integrated with the raised portions 121*c*.

The bearing plate 121*d* extends from each raised portions 121*c* toward the first pillar block 94 side while detouring around the balance staff 103. Thus, when the escapement mechanism holder 121 is seen from the axial direction of the balance staff 103, there is formed in this escapement mechanism holder 121 an opening 121*e* allowing insertion of the balance staff 103 and the double roller 106. Further, the bearing plate 121*d* is integrally formed on the raised portions 121*c*, so that it is opposite the base plate 91 at a predetermined interval.

The bearing plate 121*d*, formed as described above, is provided with a first hole jewel (not shown) for rotatably supporting the escape wheel & pinion 124, and a second hole jewel 125*a* for rotatably supporting the pallet fork 125.

At the position of the base plate 91 corresponding to the first hole jewel, there is provided a shaft support portion 127. The shaft support portion 127 serves to support the shaft body 131 of the escape wheel & pinion 124, and has a substantially annular flange portion 127*a* fixed to the base plate 91. The flange portion 127*a* is arranged such that the central opening thereof is situated coaxially with the first hole jewel of the bearing plate 121*d*.

On the flange portion 127*a*, there is integrally formed a wall portion 127*b* protruding to the side opposite the bridge plate 155. This wall portion 127*b* extends from the base plate 91 to the outer side in the radial direction of the escape drive stationary wheel 47 provided on the outer carriage 32. Further, the wall portion 127*b* is formed in a substantially C-shaped sectional configuration so that the escape drive stationary wheel 47 may be open. Further, on the inner peripheral surface side at the distal end of the wall portion 127*b*, a substantially disc-like bearing seat 127*c* is integrally formed so as to be orthogonal to the wall portion 127*b*. The bearing seat 127*c* is provided with a hole jewel 128. This hole jewel 128 is arranged coaxially with the first hole jewel of the escapement mechanism holder 121.

In this construction, the escape wheel & pinion 124 is rotatably supported by the first hole jewel of the escapement mechanism holder 121 and the hole jewel 128 of the shaft support portion 127.

The escape wheel & pinion 124 is equipped with the shaft body 131, and an escape cogwheel portion 132 fitted onto and fixed to the shaft body 131. Most portion of the shaft body 131 is accommodated in the shaft support portion 127. And, the end portion of the shaft body 131 on the escapement mechanism holder 121 side protrudes to reach, via the flange portion 127*a* of the shaft support portion 127, the bearing plate 121*d* of the escapement mechanism holder 121. Further, at both axial ends of the shaft body 131, there are respectively integrally formed pivot portions 131*a*. These pivot portions 131*a* are rotatably supported by the first hole jewel of the escapement mechanism holder 121 and by the hole jewel 128 of the shaft support portion 128.

At the portion of the shaft body 131 accommodated in the shaft support portion 127, there is integrally formed an escape pinion portion 131*b*.

Here, in the state in which the inner carriage 33 is mounted to the outer carriage 32, the first pillar block 94 side of the inner frame 90 is inserted into the escape drive stationary wheel 47. Further, the wall portion 127*b* of the shaft support portion 127 extends from the base plate 91 to the outer side in the radial direction of the escape drive stationary wheel 47 provided on the outer carriage 32. Thus, the escape pinion portion 131*b* is brought into mesh with the tooth portions 47*a* of the escape drive stationary wheel 47.

The escape cogwheel portion 132 is a member formed, for example, of a metal material or a material with crystal orientation such as single crystal silicon; and it is formed through electroforming or a technique based on an optical method such as photolithography including LIGA (Lithographie Galvanoformung Abformung) process, DRIE (Deep Reactive Ion Etching), and MIM (Metal Injection Molding).

The escape cogwheel portion 132 has a substantially annular hub portion 133 to be forced into the shaft body 131. The shaft body 131 is forced into a through-hole 133*a* formed in this hub portion 133. And, between the base plate 91 and the bearing plate 121*d* of the escapement mechanism holder 121, there exists the escape cogwheel portion 132.

On the outer side in the radial direction of the hub portion 133, there is provided a rim portion 134 formed in a ring-like configuration so as to surround this hub portion 133. The rim portion 134 and the hub portion 133 are connected by a plurality of (four in this embodiment) spoke portions 135. The spoke portions 135 extend along the radial direction, and are arranged at equal peripheral intervals.

Further, at the outer peripheral edge of the rim portion 134, there are formed a plurality of (twenty in this embodiment) tooth portions 136 in a special hook-like configuration so as to protrude radially outwards. Pallets 140*a* and 140*b* of the pallet fork 125 are engaged and disengaged with and from the distal ends of these tooth portions 136.

On the other hand, the base plate 91 is provided with a hole jewel 129 at the position corresponding to the second hole jewel 125*a* of the escapement mechanism holder 121. This hole jewel 129 is arranged coaxially with the second hole jewel 125*a*. And, the pallet fork 125 is rotatably supported by the second hole jewel 125*a* of the escapement mechanism holder 121 and the hole jewel 129 of the base plate 91.

The pallet fork 125 serves to cause the escape wheel & pinion 124 to escape and to cause it to rotate regularly, and is equipped with a pallet staff 137, a body of pallet fork 138 fitted onto and fixed to the pallet staff 137, and a pallet shaft 139 integrally formed with the body of pallet fork 138.

The pallet staff 137 is a shaft body, and is rotatably supported by the second hole jewel 125*a* of the escapement mechanism holder 121 and by the hole jewel 129 of the base plate 91.

The body of pallet fork 138 and the pallet shaft 139 are formed in a three-forked configuration by, for example, electroforming. As the electroforming metal for forming the body of pallet fork 138 and the pallet shaft 139, it is possible to employ, for example, chromium of high hardness, nickel, iron, or an alloy containing these.

Two pallet beams 138*a* and 138*b* are connected to the body of pallet fork 138. The body of pallet fork 138 has, at a connection portion 138*c* of the two pallet beams 138*a* and 138*b*, an insertion hole 138*b* allowing insertion of the pallet staff 137. And, the two pallet beams 138*a* and 138*b* extend in opposite directions from the connection portion 138*c*. Of the two pallet beams 138*a* and 138*b*, one pallet beam 138*b* extends toward the double roller 106 provided on the pallet staff 103.

At the distal end sides of the two pallet beams 138*a* and 138*b*, there are respectively formed slits 138*e* and 138*f* so as to be open on the escape wheel & pinion 124 side. The pallets 140*a* and 140*b* are respectively bonded and fixed to the slits 138*e* and 138*f* by adhesive or the like.

The pallets 140*a* and 140*b* are substantially rectangular prisms of ruby, and protrude from the distal ends of the pallet beams 138*a* and 138*b* toward the tooth portions 136 of the escape cogwheel portion 132.

At the distal end of one pallet beam 138*b*, there are provided entry horns 141 and a guard pin 142 arranged between the entry horns 141. And, on the inner side of the entry horns 141, there is formed a pallet box 143 with and from which the impulse pin 107 of the balance with hairspring 101 is engaged and disengaged.

On the other hand, the pallet shaft 139 is formed so as to protrude from the connection portion 138*c* of the body of pallet fork 138 to the side opposite the escape wheel & pinion 124.

The base plate 91 has, on both lateral sides of the pallet shaft 139 and at positions corresponding to the distal end of the pallet shaft 139, banking pins 144*a* and 144*b* provided so as to be erect. By these banking pins 144*a* and 144*b*, the rotational range of the body of pallet fork 138 and of the pallet shaft 139 is regulated.

In this construction, the center of gravity of the inner carriage 33 is situated in the rotation axis L6 of the inner carriage 33.

(Operation of the Tourbillon with Constant-Force Device)

Next, the operation of the tourbillon with constant-force device 30 will be described.

First, referring to FIGS. 11, 12, and 16, the operation of the balance with hair spring 101 mounted in the inner carriage 33 and of the escapement mechanism 120 will be described.

The balance with hairspring 101 receives the rotational force of the escape wheel & pinion 124 via the impulse pin 107, and makes free oscillation due to this rotational force and the spring force of the hairspring 105. Due to the free oscillation of the balance with hairspring 101, the pallet box 143 which can be engaged and disengaged with and from the impulse pin 107 swings to the right and left around the pallet staff 137 together with the body of pallet fork 138.

As a result of the swinging of the body of pallet fork 138, the two pallets 140*a* and 140*b* are alternately brought into contact with the tooth portions 136 of the escape cogwheel portion 132. As a result, the escape wheel & pinion 124 constantly escapes at a fixed cycle.

Here, the pallet fork 125 is equipped with the pallet shaft 139 integrally formed with the body of pallet fork 138, and this pallet shaft 139 is regulated in rotational range by the banking pins 144*a* and 144*b*. Thus, it is possible to prevent the pallet fork 125 from swinging beyond a predetermined range upon receiving external shock or the like.

Next, referring to FIGS. 1, 10, and 17 through 24, the operation of the outer carriage 32 and the inner carriage 33 will be described.

Figure 21:
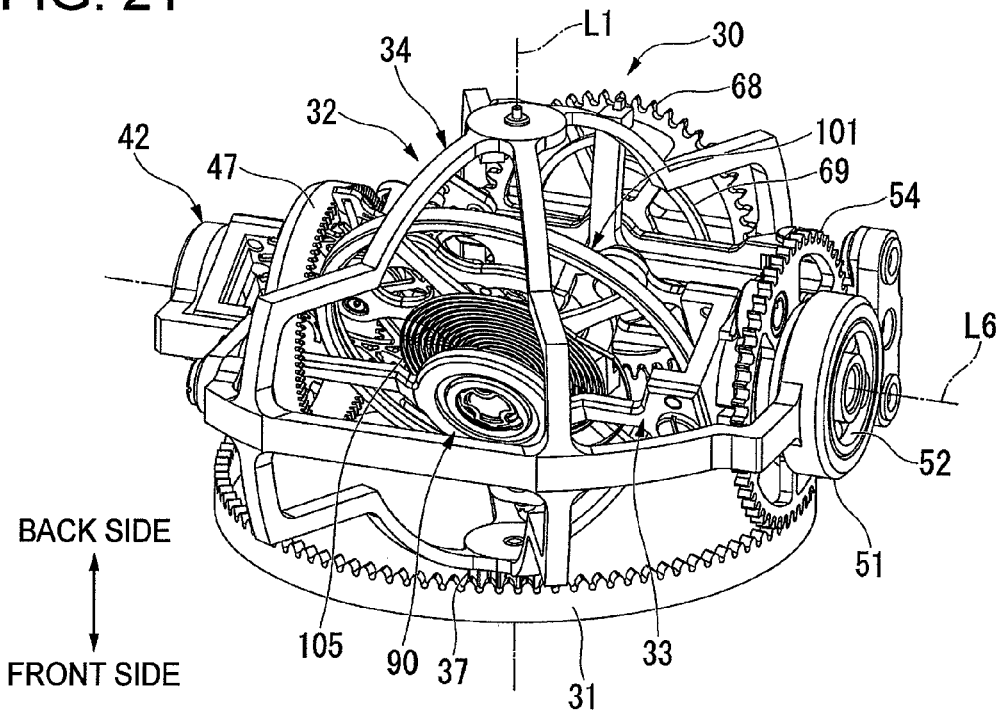
FIG. 21 is a diagram illustrating the operation of the outer carriage and the inner carriage according to the first embodiment of the present invention.
Figure 22:
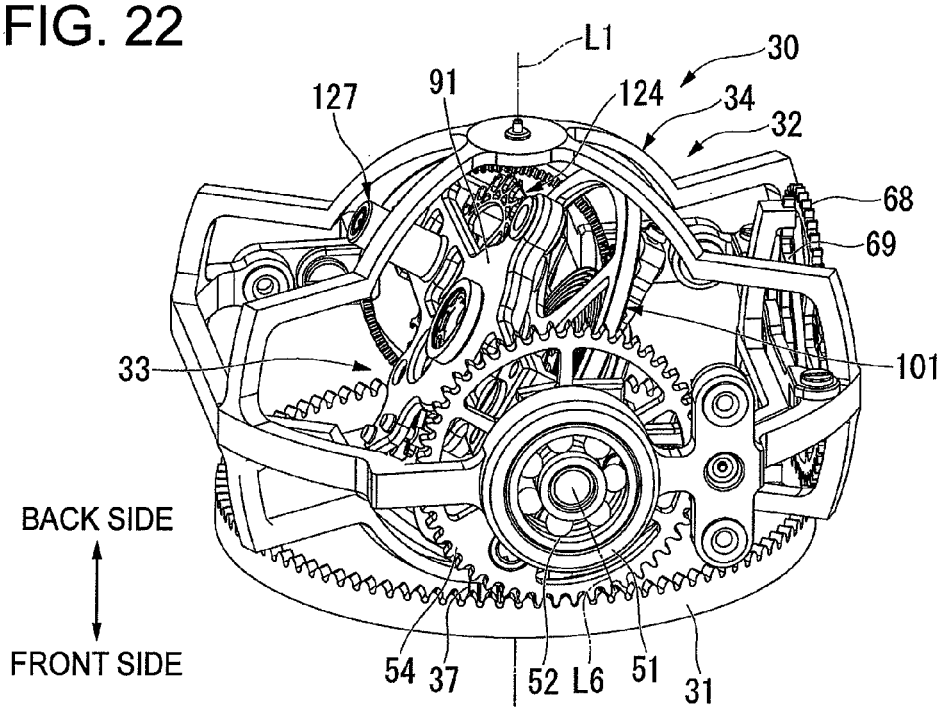
FIG. 22 is a diagram illustrating the operation of the outer carriage and the inner carriage according to the first embodiment of the present invention.
Figure 23B:
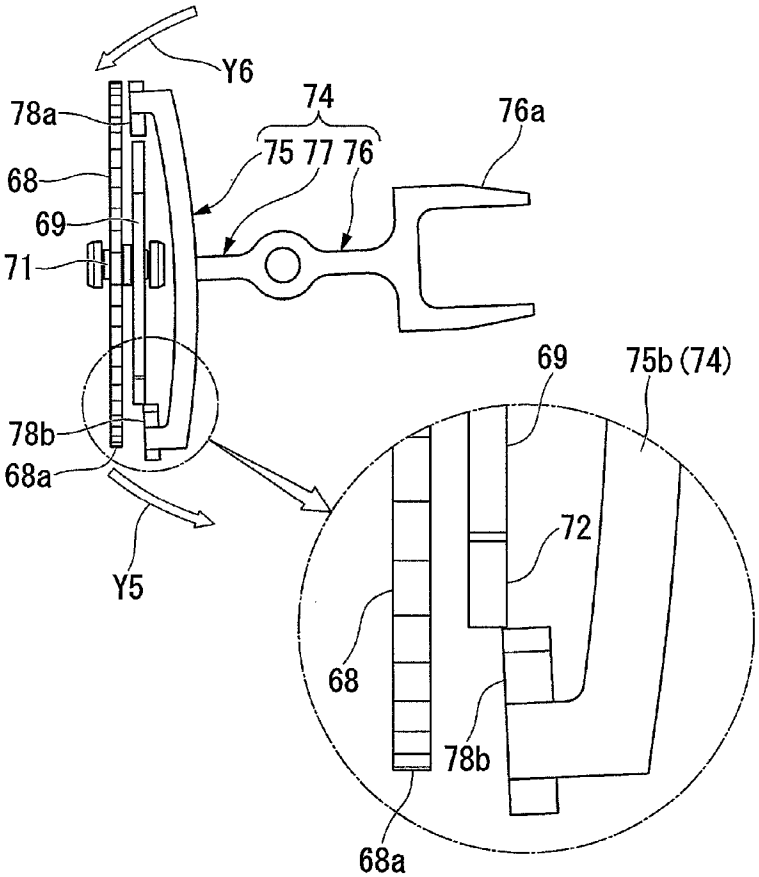
FIGS. 23A and 23B are diagrams illustrating mesh-engagement between a stop wheel and a stopper pallet fork, and the behavior of the stopper pallet fork in the first embodiment of the present invention.
Figure 23A:
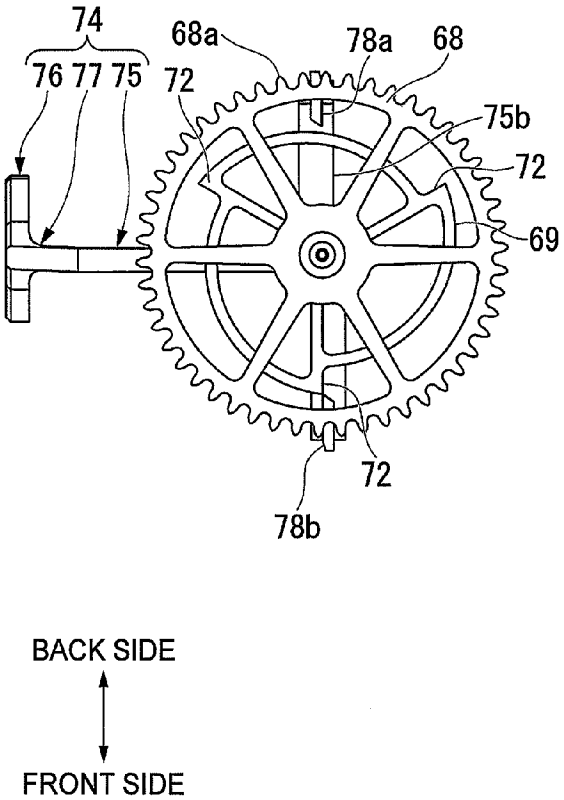
Figure 24B:
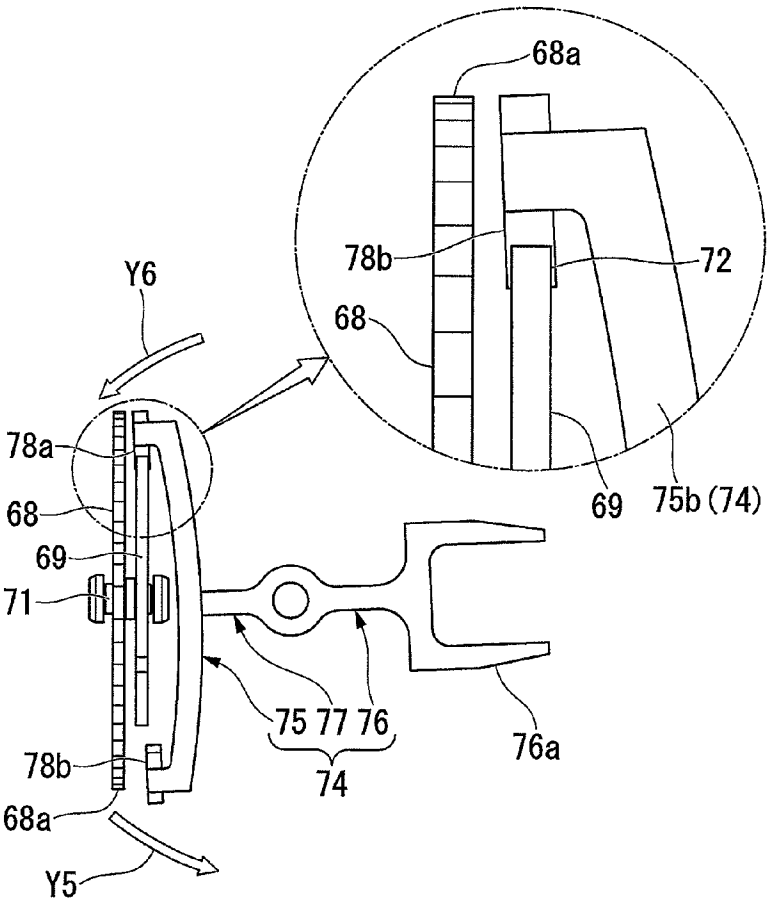
FIGS. 24A and 24B are diagrams illustrating mesh-engagement between the stop wheel and the stopper pallet fork, and the behavior of the stopper pallet fork in the first embodiment of the present invention.
Figure 24A:
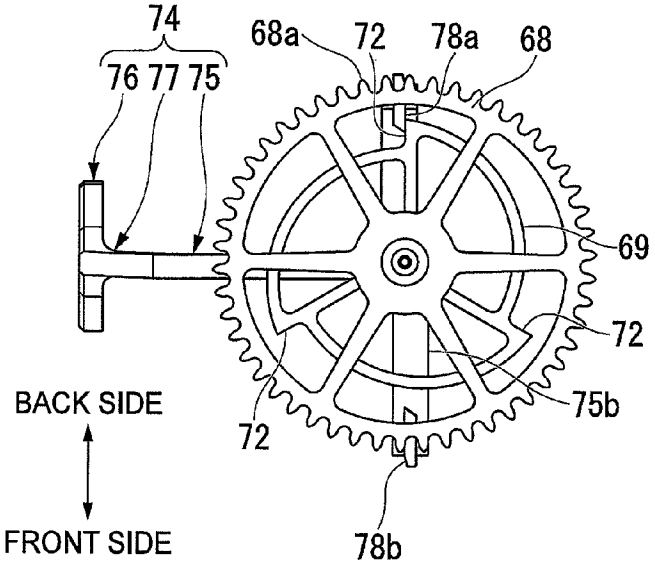

FIGS. 17 through 22 are diagrams illustrating the operation of the outer carriage 32 and the inner carriage 33; they illustrate the state of the outer carriage 32 and the inner carriage 33 at each cycle time. FIGS. 23A, 23B, 24A and 24B illustrate the mesh-engagement state of the stop wheel 69 and the stopper pallet fork 74, and the behavior of the stopper pallet fork 74; FIGS. 23A and 24A illustrate the stop wheel 69 as seen from the axial direction, and FIGS. 23B and 24B illustrate the stop wheel 69 as seen from the radial direction.

Figure 17:
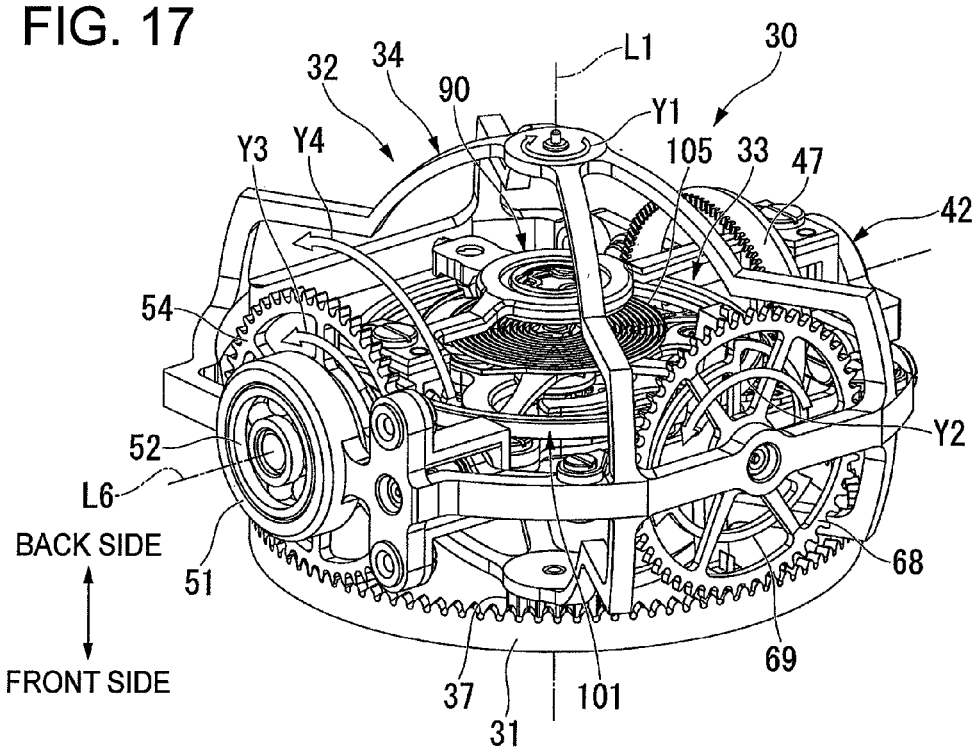
FIG. 17 is a diagram illustrating the operation of the outer carriage and the inner carriage according to the first embodiment of the present invention.

As shown in FIGS. 1 and 17, in the outer carriage 32, the outer carriage pinion 37 is in mesh with the cogwheel portion 26*c* of the third wheel & pinion 26, so that the rotational force of the movement barrel 22 is transmitted to the outer carriage 32 via the front train wheel. And, the outer frame 34 strives to rotate around the rotation axis L1 (See arrow Y1 in FIG. 17).

Then, the stop wheel driving wheel 68 provided on the outer frame 34 and in mesh with the tooth portions 31*a* of the stationary wheel 31 strives to rotate (See arrow Y2 in FIG. 17), and the constant-force spring winding-up wheel 54 strives to rotate (See arrow Y3 in FIG. 17). The outer frame 34 is configured to make one rotation every two minutes (120 seconds).

At this time, when one of the two pallets 78*a* and 78*b* of the stopper pallet fork 74 is in contact with (engaged with) the hook portion 72 of the stop wheel 69 rotating integrally with the stop wheel driving wheel 68, the stop wheel driving wheel 68 and the stop wheel 69 stop. Thus, the outer frame 34 and the constant-force spring winding-up wheel 54 stop.

Here, as shown in FIG. 10, the hook portion 72 of the stop wheel 69 and the two pallets 78*a* and 78*b* of the stopper pallet fork 74 are formed such that the vector F1 of the load (mesh-engagement force) applied when the pallets 78*a* and 78*b* are in contact with the hook portion 72 is parallel to the axis L5 of the stopper pallet staff 79. Thus, it is possible to prevent the rotational force around the stopper pallet staff 79 from being allowed to act on the stopper pallet fork 74 due to the mesh-engagement force of the hook portion 72 of the stop wheel 69 and the pallets 78*a* and 78*b* of the stopper pallet fork 74.

On the other hand, as shown in FIG. 17, the inner carriage 33 is supported so as to be rotatable with respect to the outer carriage 32, and is connected to the outer carriage 32 via the constant-force spring 59. Thus, upon receiving the urging force of the constant-force spring 59, the inner frame 90 rotates around the rotation axis L6 with respect to the outer frame 34 (See arrow Y4 in FIG. 17). At this time, the shaft body 131 of the escape wheel & pinion 124 in mesh with the escape drive stationary wheel 47 of the outer carriage 32 rotates.

Here, the escape wheel & pinion 124 constitutes the escapement mechanism 120, and is caused to escape constantly at a fixed cycle by the pallet fork 125 and the balance with hairspring 101. That is, due to the escapement of the escape wheel & pinion 124 at a fixed cycle, the inner carriage 33 rotatably supporting the escape wheel & pinion 124 repeats rotation and stopping at a fixed cycle.

More specifically, the escape wheel & pinion 124 rotates at a fixed speed so that the inner frame 90 may make one rotation in a minute. In other words, the inner frame 90 rotates six times in a second.

Thus, examples of the construction indicating "second" include one in which what corresponds to a second hand is provided on the back side of the outer peripheral surface of the escape drive stationary wheel 47 and in which a disc with an engraved scale is provided at the position corresponding to the second hand of the inner frame 90. In this construction, the second hand remains at rest, whereas the scale rotates as the inner frame 90 rotates, so that it is possible to display "second."

The inner frame 90 makes one rotation in a minute, whereby the center wheel & pinion 25 makes one rotation in an hour.

Here, through the rotation of the inner frame 90, the triangular cam 151 integrated with the inner frame 90 is also rotated. Through the rotation of the triangular cam 151, the stopper pallet fork 74 of the outer carriage 32 engaged with this triangular cam 151 swings around the stopper pallet staff 79.

The triangular cam 151 is formed so as to cause the stopper pallet fork 74 to make three reciprocations in swinging in a minute through one rotation, so that the stopper pallet fork 74 makes three reciprocations in swinging in a minute. As a result, the hook portion 72 of the stop wheel 69 and the pallets 78*a* and 78*b* are engaged and disengaged with and from each other repeatedly.

More specifically, suppose, for example, of the two pallets 78*a* and 78*b* of the stopper pallet fork 74, the front-side pallet 78*b* is engaged with the hook portion 72 of the stop wheel 69. When, in this state, the stopper pallet fork 74 starts to swing with the rotation of the inner frame 90 (triangular cam 151) as shown in FIGS. 23A and 23B, the front-side pallet 78*b* moves so as to be deviated from the rotational path of the hook portion 72. On the other hand (See arrow Y5 in FIG. 23B), the back-side pallet 78*a* moves toward the rotational path of the hook portion 72 (See arrow Y6 of FIG. 23B).

Here, as illustrated in detail in FIG. 23B, at the moment that the front-side pallet 78*b* is detached from the hook portion 72 of the stop wheel 69, the back-side pallet 78*a* is situated on the rotational path of the hook portion 72. Thus, when the front-side pallet 78*b* is detached from the hook portion 72 of the stop wheel 69, the stop wheel 69 rotates until the back-side pallet 78*a* and the hook portion 72 are engaged with each other the next time. More specifically, the number of hook portions 72 formed on the stop wheel 69 is three, and the hook portions 72 are arranged at equal intervals, so that the stop wheel 69 rotates by 60 degrees.

When the stop wheel 69 rotates, the outer frame 34, rotates around the rotation axis L1; further, the constant-force spring winding-up wheel 54 rotates. Here, the pitch circle diameter of the stop wheel driving wheel 68 is set to be the same as the pitch circle diameter of the constant-force spring winding-up wheel 54. Further, the number of teeth of the tooth portions 68*a* of the stop wheel driving wheel 68 is set to be the same as the number of teeth of the tooth portions 54*a* of the constant-force spring winding-up wheel 54. Thus, when the stop wheel 69 rotates by 60 degrees, the constant-force spring winding-up wheel 54 also rotates by 60 degrees.

The constant-force spring winding-up wheel 54 is provided with the stud support 57 (stud 58), so that, when the constant-force spring winding-up wheel 54 rotates, the stud 58 moves integrally. Through the movement of the stud 58, the constant force spring 59 is wound up by 60 degrees. And, as the stop wheel 69 stops again with the constant-force spring 59 wound up, the outer frame 34 also stops. On the other hand, the inner frame 90 rotates with respect to the outer frame 34 upon receiving the urging force of the wound-up constant-force spring 59. By repeating this, the inner carriage 33 and the escape wheel & pinion 124 continue to rotate at a fixed speed.

More specifically, changes with passage of time in the tourbillon with constant-force device 30 will be described with reference to FIGS. 17 through 22.

Figure 18:
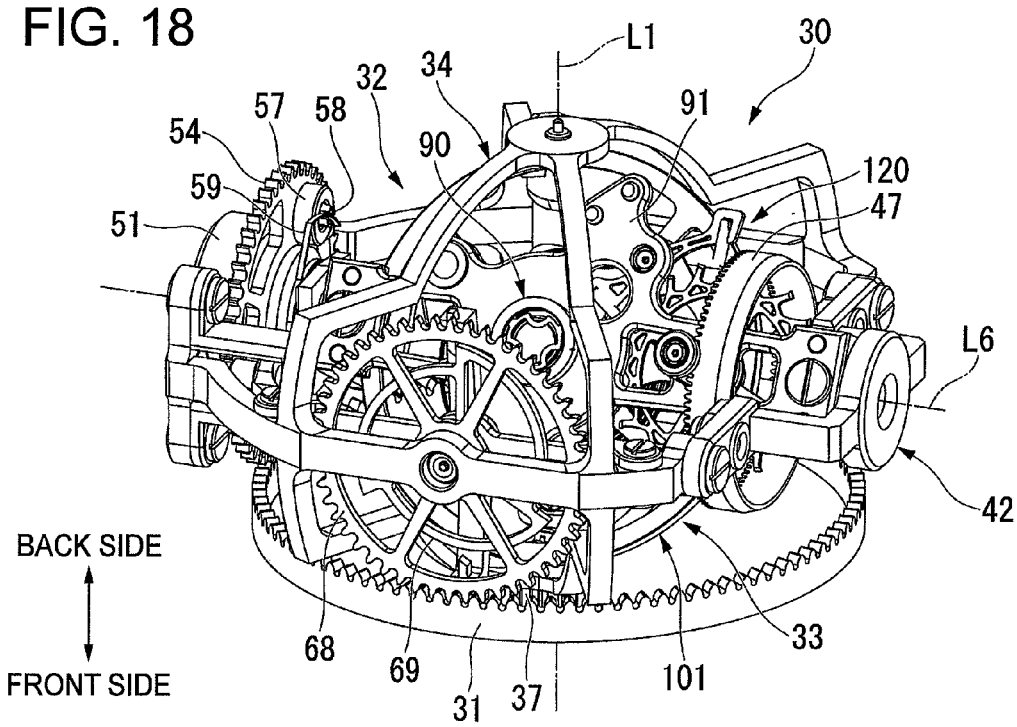
FIG. 18 is a diagram illustrating the operation of the outer carriage and the inner carriage according to the first embodiment of the present invention.
Figure 19:
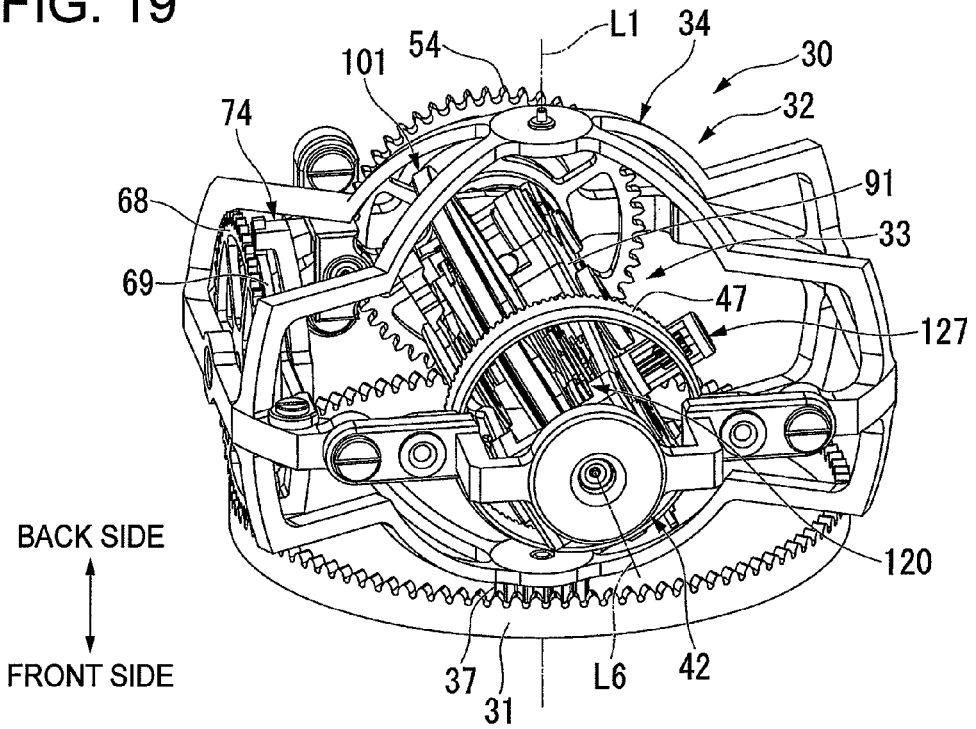
FIG. 19 is a diagram illustrating the operation of the outer carriage and the inner carriage according to the first embodiment of the present invention.

First, when 20 seconds have elapsed from the state of FIG. 17, the tourbillon with constant-force device 30 attains the state as shown in FIG. 18. When another 20 seconds have elapsed (i.e., when 40 seconds have elapsed from the state of FIG. 17), the tourbillon with constant-constant force device 30 attains the state as shown in FIG. 19.

Figure 20:
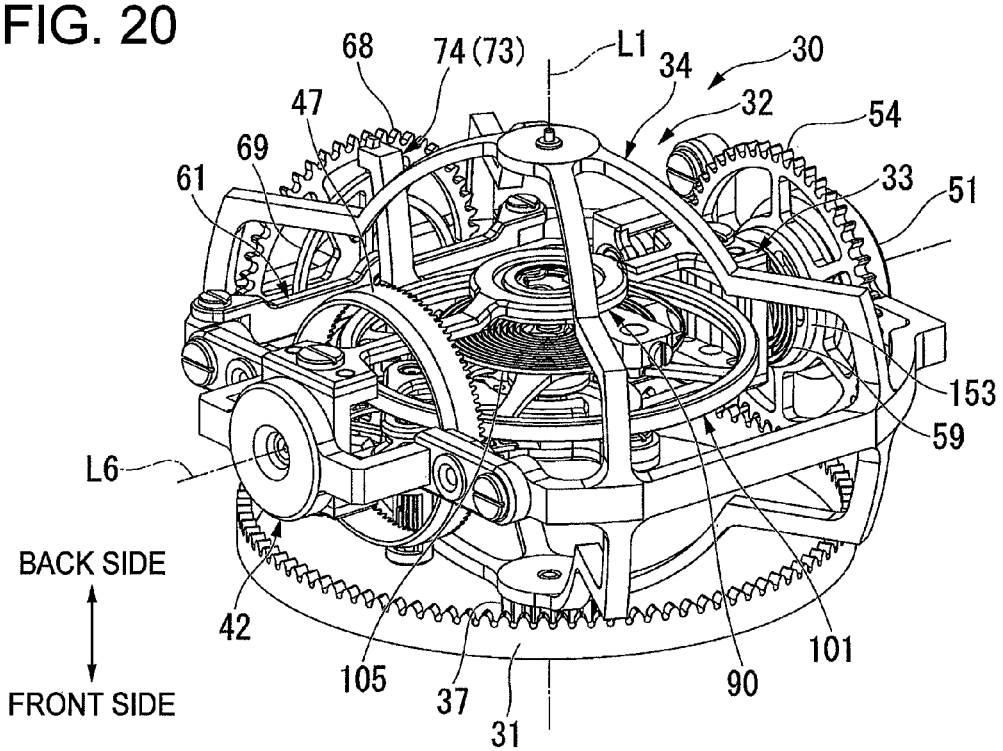
FIG. 20 is a diagram illustrating the operation of the outer carriage and the inner carriage according to the first embodiment of the present invention.

When still another 20 seconds have elapsed (i.e., when 60 seconds have elapsed from the state as shown in FIG. 17), the tourbillon with constant-force device 30 attains the state as shown in FIG. 20.

When yet another 20 seconds have elapsed (i.e., when 80 seconds have elapsed from the state of FIG. 17), the tourbillon with constant-force device 30 attains the state as shown in FIG. 21. When yet another 20 seconds have elapsed (i.e., when 100 seconds have elapsed from the state of FIG. 17), the tourbillon with constant-force device 30 attains the state as shown in FIG. 22. And, when 120 seconds have elapsed, the outer frame 34 makes one rotation to be restored to the state of FIG. 17 again.

Here, the constant-force spring winding-up wheel 54 provided on the outer carriage 32 and the phase regulating plate 153 provided on the inner carriage 33 are arranged so as to be opposite each other. Further, the engagement pin 56 protruding from the constant-force spring winding-up wheel 54 and the elongated hole 154 of the phase regulating plate 153 are engaged with each other. And, due to this construction, the rotational angle of the phase regulating plate 153 with respect to the constant-force winding-up wheel 54 is not deviated by 60 degrees or more. Thus, it is possible to prevent the constant-force spring 59 from being unwound to a predetermined degree or more.

In this way, in the first embodiment described above, the tourbillon with constant-force device 30 is formed by the outer carriage 32, and the inner carriage 33 provided so as to be rotatable with respect to the outer carriage 32. Further, the rotation axis L1 of the outer carriage 32 and the rotation axis L6 of the inner carriage 33 are orthogonal to each other. Thus, the balance with hairspring 101 provided in the inner carriage 33 can be oriented in all directions, making it possible to simultaneously suppress the erect attitude difference and the flat-erect difference.

Further, between the outer carriage 32 and the inner carriage 33, there is arranged the constant-force spring 59 connecting the outer carriage 32 and the inner carriage 33. And, engagement and releasing operations between the stop wheel 69 provided on the outer carriage 32 and the stopper 73 (stopper pallet fork 74) are repeatedly conducted upon receiving the rotational motion of the inner carriage 33. Thus, it is possible to impart rotational force to the inner carriage 33 in a stable manner without involving an increase in the size of the tourbillon with constant-force device 30.

Further, between the outer carriage 32 and the inner carriage 33, there is arranged the constant-force spring 59 connecting the outer carriage 32 and the inner carriage 33, whereby it is possible to impart rotational force to the inner carriage 33 in a stable manner. The balance with hairspring 101 undergoes free oscillation through the transmission of the rotational torque of the inner carriage 33 to the escape wheel & pinion 124, so that, when rotational force is imparted to the inner carriage 33 in a stable manner, it is possible to stabilize the oscillation angle of the balance with hairspring. Thus, it is possible to reliably enhance the rate precision of the mechanical timepiece 1.

The balance with hairspring 101 provided in the inner carriage 33 is arranged such that the rotation axis L7 thereof crosses the rotation axis L1 of the outer carriage 32. Thus, it is possible to prevent generation of a useless space between the outer carriage 32 and the inner carriage 33. Thus, it is possible to reliably achieve a reduction in the size of the tourbillon with constant-force device 30, and to achieve an improvement in terms of design property.

Further, the center of gravity of the balance with hairspring 101 is situated in the rotation axis L1 of the outer carriage 32 and in the rotation axis L6 of the inner carriage 33. Thus, it is possible to make it difficult for the centrifugal force due to the rotation of the carriages 32 and 33 to act on the balance with hairspring 101. As a result, it is possible to stabilize the operation of the balance with hairspring 101.

Further, the center of gravity of the inner carriage 33 is situated in the rotation axis L6 of the inner carriage 33. Thus, it is possible to minimize the requisite rotational torque for rotating the inner carriage 33. Accordingly, it is possible to enhance the drive efficiency of the tourbillon with constant-force device 30, and to enhance the rate precision.

The center of gravity of the outer carriage 32 is situated in the rotation axis L1 of the outer carriage 32. Thus, it is possible to minimize the requisite rotational torque for rotating the outer carriage 32. As a result, the winding-up of the constant-force spring 59 by the outer carriage 32 can be conducted efficiently, making it possible to stabilize the winding-up amount of the constant-force spring 59. Thus, it is possible to enhance the drive efficiency of the tourbillon with constant-force device 30, making it possible to enhance the rate precision.

Further, the axis L5 of the stopper pallet staff 79 for swingably supporting the stopper pallet fork 74 is orthogonal to the rotation axis L4 of the stop wheel 69. And, the two pallets 78*a* and 78*b* of the hook portion 72 of the stop wheel 69 and of the stopper pallet fork 74 are formed such that the vector F1 of the load (mesh-engagement force) applied in the state in which the pallets 78*a* and 78*b* are in contact with the hook portion 72 is parallel to the axis L5 of the stopper pallet staff 79.

Thus, it is possible to prevent the rotational force around the stopper pallet staff 79 from acting on the stopper pallet fork 74 due to the mesh-engagement force of the hook portion 72 of the stop wheel 69 and of the pallets 78*a* and 78*b* of the stopper pallet fork 74. As a result, no excessive rotational force acts on the inner carriage 33 via the triangular cam 151. Thus, it is possible to minimize the requisite rotational torque for rotating the inner carriage 33.

Further, the constant-force spring winding-up wheel 54 provided on the outer carriage 32 and the phase regulating plate 153 provided on the inner carriage 33 are arranged so as to be opposite each other. Further, the engagement pin 56 protruding from the constant-force spring winding-up wheel 54 and the elongated hole 154 of the phase regulating plate 153 are engaged with each other. And, due to this construction, the rotational angle of the phase regulating plate 153 with respect to the constant-force spring winding-up wheel 54 is not deviated by 60 degrees or more. Thus, it is possible to prevent the constant-force spring 59 from being unwound to a predetermined degree or more. Thus, it is possible to impart rotational force to the inner carriage 33 in a stable manner.

Modification of the First Embodiment

In the first embodiment described above, the rotation axis L1 of the outer carriage 32 and the rotation axis L6 of the inner carriage 33 are orthogonal to each other. This, however, should not be construed restrictively; any other construction will do so long as the rotation axis L1 of the outer carriage 32 and the rotation axis L6 of the inner carriage 33 cross each other.

Further, in the first embodiment described above, the outer frame 34 makes one rotation in 120 seconds. This, however, should not be construed restrictively.

For example, it is possible to cause the outer frame 34 to make one rotation in 60 seconds by changing the configuration of the triangular cam 151 or by separately providing an amplifier or the like. In the case where the outer frame 34 is caused to make one rotation in 60 seconds, it is also possible to indicate "second" by the second hand provided on the outer frame 34 and a dial (not shown).

Further, in the first embodiment described above, the outer frame 34 is provided with the outer carriage pinion 37, and this outer carriage pinion 37 is in mesh with the cogwheel portion 26*c* of the third wheel & pinion 26. And, the rotational force of the movement barrel 22 is transmitted to the outer carriage 32 via the front train wheel. This, however, should not be construed restrictively; any other construction will do so long as any portion of the outer frame 34 is in mesh with one of the cogwheels constituting the front train wheel. For example, it is also possible to form tooth portions on the lateral frame 41 of the outer frame 34, bringing the tooth portions into mesh with a cogwheel of the front train wheel.

Further, in the first embodiment described above, the stationary wheel 31 is formed in a substantially disc-like configuration, and the tooth portions 31*a* are formed at the peripheral edge on the back side (main plate 11 side). And, the constant-force spring winding-up wheel 54 and the stop wheel driving wheel 68 are in mesh with these tooth portions 31*a*. This, however, should not be construed restrictively; each of the stationary wheel 31, the constant-force spring winding-up wheel 54, and the stop wheel driving wheel 68 may be formed in a bevel-gear-like configuration. In this construction, it is possible to augment the mesh-engagement area between the cogwheels, so that it is possible to enhance the drive transmission efficiency.

Further, in the first embodiment described above, the balance with hairspring 101 is arranged such that the rotation axis L7 thereof crosses the rotation axis L1 of the outer carriage 32. This, however, should not be construed restrictively; the rotation axes L1 and L7 may not completely cross each other, and more or less deviation is permissible. That is, it is only necessary for the balance with hairspring 101 to be provided such that the rotation axis L7 of the balance with hairspring 101 is situated in the vicinity of the rotation axis L1 of the outer carriage 32. This is due to the fact that there is actually generated an error in production and that some play is generated at the mounting portion of each component. Even in this case, the balance with hairspring 101 is arranged substantially at the center of the inner carriage 33, so that it is possible to prevent generation of a useless space between the outer carriage 32 and the inner carriage 33.

Further, in the first embodiment described above, the center of gravity of the balance with hairspring 101 is situated in the rotation axis L1 of the outer carriage 32 and in the rotation axis L6 of the inner carriage 33. This, however, should not be construed restrictively; any other construction will do so long as the center of gravity of the balance with hairspring 101 is situated in at least one of the rotation axis L1 of the outer carriage 32 and the rotation axis L6 of the inner carriage 33. Even in the case where the center of gravity of the balance with hairspring 101 is situated in one of the rotation axis L1 of the outer carriage 32 and the rotation axis L6 of the inner carriage 33, it is possible to prevent the centrifugal force of the carriage rotating around the rotation axis in which the center of gravity is situated from acting on the balance with hairspring 101. Thus, it is possible to stabilize the operation of the balance with hairspring 101.

Further, in the first embodiment described above, the number of teeth of the stationary wheel 31, the number of teeth of the stop wheel driving wheel 68, and the number of teeth of the constant-force spring winding-up wheel 54 are set to numbers that are mutually divisible. It should be noted, however, that it is desirable for the number of teeth of the stationary wheel 31, the number of teeth of the stop wheel driving wheel 68, and the number of teeth of the constant-force spring winding-up wheel 54 to be set to mutually indivisible numbers. Due to this construction, it takes longer for the balance with hairspring 101 to assume the same attitude at the same position. Thus, it is possible to disperse the influence of the gravitational force, making it possible to more reliably eliminate the flat-erect difference, and to disperse the stress applied to the balance staff 103.

That is, for example, in the case where, as in the first embodiment described above, the number of teeth of the stationary wheel 31, the number of teeth of the stop wheel driving wheel 68, and the number of teeth of the constant-force spring winding-up wheel 54 are set to mutually divisible numbers, the rotational cycles of the carriages 32 and 33 are also mutually divisible. In this case, as described with regard to the change with passage of time in the tourbillon with constant-force device 30 with reference to FIGS. 17 through 22, the balance with hairspring 101 assumes the same attitude every 120 seconds (each time the outer frame 34 makes one rotation). Thus, the balance with hairspring 101 becomes subject to the influence of the gravitational force.

However, when the number of teeth of the stationary wheel 31, the number of teeth of the stop wheel driving wheel 68, and the number of teeth of the constant-force spring winding-up wheel 54 are set to mutually indivisible numbers (when the rotational cycles of the carriages 32 and 33 are set to mutually indivisible numbers), it takes longer for the balance with hairspring 101 to assume the same attitude at the same place. Thus, it is possible to disperse the influence of the gravitational force, making it possible to more reliably eliminate the flat-erect difference, and to disperse the stress applied to the balance staff 103.

Further, in the first embodiment described above, the stopper pallet fork 74 of the stopper 73 is formed by integrating the stopper body of pallet fork 75, the fork portion 76, and the connection portion 77, and the fork portion 76 is formed by the forked fork main body 76*a*, and the arm portion 76*b* astride the proximal end of the fork main body 76*a* and the connection portion 77. And, the fork main body 76*a* is engaged with the triangular cam 151 provided on the carriage 33. However, the configuration of the stopper pallet fork 74 is not restricted thereto, and the following construction is also acceptable.

Figure 25:
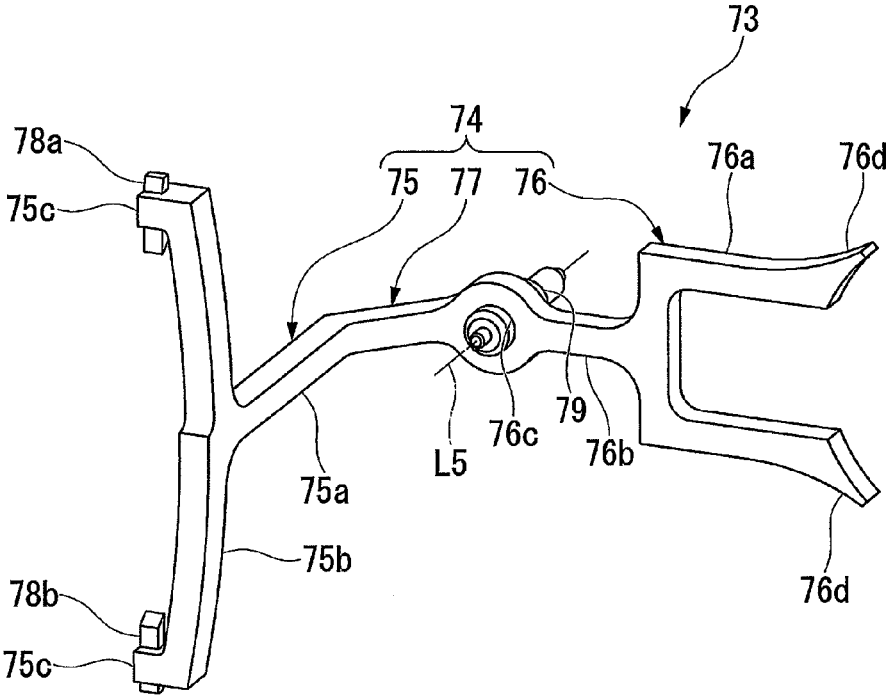
FIG. 25 is a perspective view of a modification of the stopper pallet fork according to the first embodiment of the present invention.

FIG. 25 is a perspective view of a modification of the stopper pallet fork 74 according to the first embodiment. The components that are the same as those of the first embodiment are indicated by the same reference numerals, and a description thereof will be left out (This also applies to the following embodiments and modifications).

As shown in the drawing, the fork main body 76*a* of the stopper pallet fork 74 has, at the distal ends thereof, balancers 76*d* integrated therewith. The balancers 76*d* are weights formed of the same material as the stopper pallet fork 74. The balancers 76*d* are inclined and extend on the side reverse to the side where they are opposite each other as they extend toward the distal ends. Further, the balancers 76*d* are formed so as to be tapered as they extend toward their distal ends.

Due to the provision of the balancers 76*d*, the center of gravity of the stopper pallet fork 74 as a whole is situated in the axis L5 of the stopper pallet staff 79. Thus, it is possible to prevent the gravitational force of the stopper pallet fork 74 from affecting the requisite force for swinging the stopper pallet fork 74 due to the erect attitude and the flat attitude of the mechanical timepiece 1. Thus, in the modification of the stopper pallet fork 74 of the first embodiment described above, it is possible to prevent the necessary force for the inner carriage 33 (triangular cam 151) to swing the stopper pallet fork 74 from being changed.

Here, the rotational torque of the inner carriage 33 is transmitted to the escape wheel & pinion 124, and the balance with hairspring 101 undergoes free oscillation, so that the oscillation angle of the balance with hairspring is not changed if the rotational torque of the inner carriage 33 is not changed. Thus, due to the balancers 76*d*, the requisite force for swinging the stopper pallet fork 74 of the inner carriage 33 is prevented from being changed, whereby it is possible to reliably enhance the rate precision of the mechanical timepiece 1.

In the above-described modification of the first embodiment, the balancers 76*d* are integrally formed on the fork main body 76*a* of the stopper pallet fork 74. This, however, should not be construed restrictively; the balancers 76*d* may be formed separately from the fork main body 76*a*, and may be mounted to the fork main body 76*a*. In this case, the balancers 76*d* may be forced into the fork main body 76*a*; or, for example, screws or the like may be formed on the fork main body 76*a* and the balancers 76*d*, and the balancers 76*d* may be detachably provided on the fork main body 76*a*. By detachably providing the balancers 76*d* on the fork main body 76*a*, it is possible to easily adjust the gravitational position of the stopper pallet fork 74 by the balancers 76*d*.

Second Embodiment

Tourbillon with Constant-Force Device

Next, the second embodiment of this invention will be described with reference to FIGS. 26 and 27.

Figure 26:
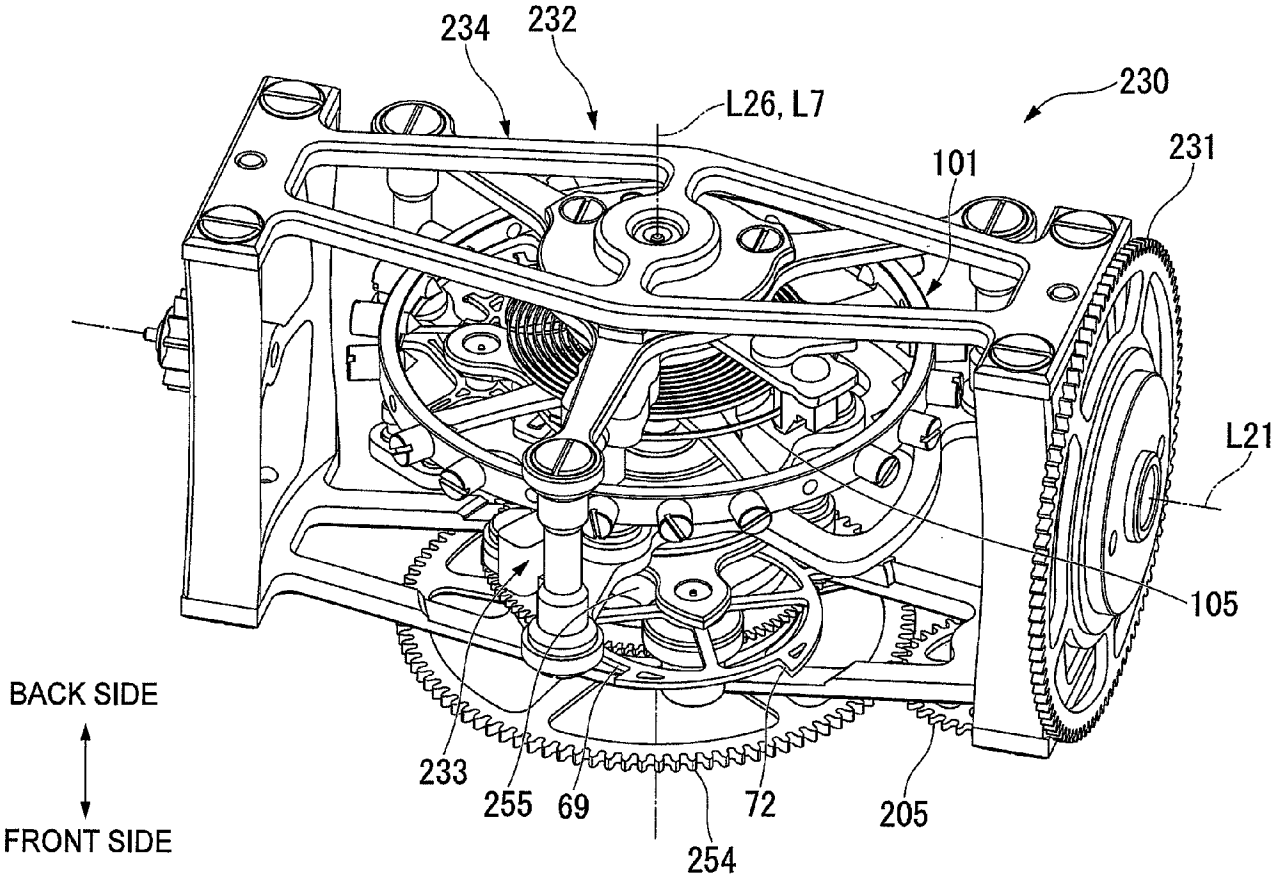
FIG. 26 is a perspective view of a tourbillon with constant-force device according to a second embodiment of the present invention as seen from one side.
Figure 27:
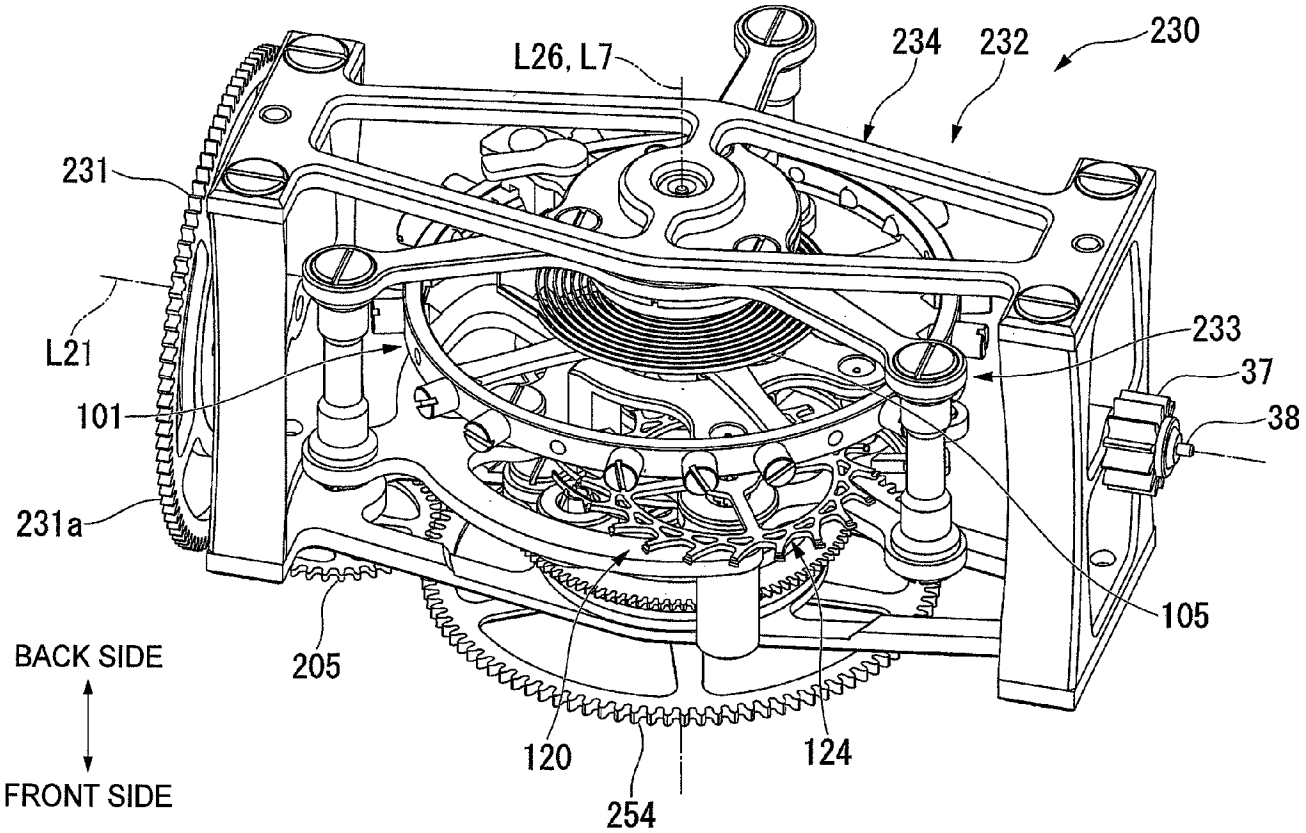
FIG. 27 is a perspective view of the tourbillon with constant-force device according to the second embodiment of the present invention as seen from the other side.

FIG. 26 is a perspective view of a tourbillon with constant-force device 230 according to the second embodiment as seen from one side, and FIG. 27 is a perspective view of the tourbillon with constant-force device 230 according to the second embodiment as seen from the other side.

This second embodiment is the same as the first embodiment described above in that the tourbillon with constant-force device 230 is incorporated in the mechanical timepiece 1, and is a mechanism for controlling the rotation of the front train wheel (This also applies to the following embodiments).

The tourbillon with constant-force device 230 according to the second embodiment is equipped with an outer carriage 232, and an inner carriage 233 provided in the outer carriage 232 and having a rotation axis L26 extending in a direction orthogonal to the rotation axis L21 of the outer carriage 232. And, the inner carriage 233 is provided with the balance with hairspring 101 and the escapement mechanism 120.

Here, in the inner carriage 233 of the second embodiment, the rotation axis L26 of the inner carriage 233 and the rotation axis L7 of the balance with hairspring 101 are set to be in the same straight line. In this respect, this embodiment is greatly different from the first embodiment described above.

Further, an outer frame 234 of the outer carriage 232 is formed so as to be elongated in the direction orthogonal to the front-back direction of the main plate 11 (See FIGS. 1 and 2), and the rotation axis L21 of the outer carriage 232 is also set to a direction orthogonal to the front-back direction of the main plate 11. The outer carriage pinion 37 is provided at an end portion in the longitudinal direction of the outer frame 234, and is in mesh with a cogwheel of the front train wheel.

Further, on the main plate 11 side, there is provided a stationary wheel 231 on the side opposite the side where the outer carriage pinion 37 of the outer carriage 232 is provided. On the other hand, the outer frame 234 is provided with an idler wheel 205 in mesh with tooth portions 231*a* of the stationary wheel 231, and a constant-force spring winding-up wheel 254 in mesh with the idler wheel 205.

Here, the rotation axis of the tooth portions 231*a* of the stationary wheel 231 and the rotation axis of the idler wheel 205 are orthogonal to each other. Thus, the stationary wheel 231 and the idler wheel 205 may be formed in a bevel-gear-like configuration. In this case, it is necessary to provide the idler wheel 205 and an outer cogwheel configured to rotate integrally with the idler wheel 205 and in mesh with the constant-force spring winding-up wheel 254.

In this construction, when the outer frame 234 rotates, the idler wheel 205 in mesh with the stationary wheel 231 strives to rotate while revolving around the stationary wheel 231. Further, the rotational force of the idler wheel 205 is transmitted to the constant-force spring winding-up wheel 254.

Further, the outer carriage 232 is provided with a rotary plate 255 fixed to the constant-force spring winding-up wheel 254 and configured to rotate integrally with the constant-force spring winding-up wheel 254. This rotary plate 255 is provided with the stop wheel 69. On the other hand, the inner carriage 233 is pallets (not shown) that can be engaged and disengaged with and from the hook portion 72 of the stop wheel 69. Further, between the outer carriage 232 and the inner carriage 233, there is provided a constant-force spring (not shown) connecting the outer carriage 232 and the inner carriage 233. And, the inner carriage 233 is rotated by the spring force of this constant-force spring.

In this construction, when the inner carriage 233 is rotated by a predetermined angle (more specifically, six degrees in this second embodiment), the engagement between the stop wheel 69 and the pallets is released, and the outer carriage 232 is rotated by a predetermined angle (more specifically, six degrees in this second embodiment). As a result, the constant-force spring is wound up. By repeating this, the inner carriage 233 and the escapement mechanism 120 continue to drive at a fixed speed.

Thus, in the second embodiment described above, even if the rotation axis L26 of the inner carriage 233 and the rotation axis L7 of the balance with hairspring 101 are set to be in the same straight line, it is possible to achieve the same effect as that of the first embodiment described above.

Modification of the Second Embodiment

In the second embodiment described above, the rotation axis L21 of the outer carriage 232 and the rotation axis L26 of the inner carriage 233 are orthogonal to each other. This, however, should not be construed restrictively; any other construction will do so long as the rotation axis L21 of the outer carriage 232 and the rotation axis L26 of the inner carriage 233 cross each other.

Further, in the second embodiment described above, the rotation axis L26 of the inner carriage 233 and the rotation axis L7 of the balance with hairspring 101 are set to be in the same straight line. This, however, should not be construed restrictively; any other construction will do so long as the rotation axis L26 of the inner carriage 233 and the rotation axis L7 of the balance with hairspring 101 are parallel to each other.

Further, the rotation axis L7 of the balance with hairspring 101 may be provided so as to be oblique with respect to the rotation axis L26 of the inner carriage 233. This will be described in detail with reference to FIGS. 28 and 29.

Figure 28:
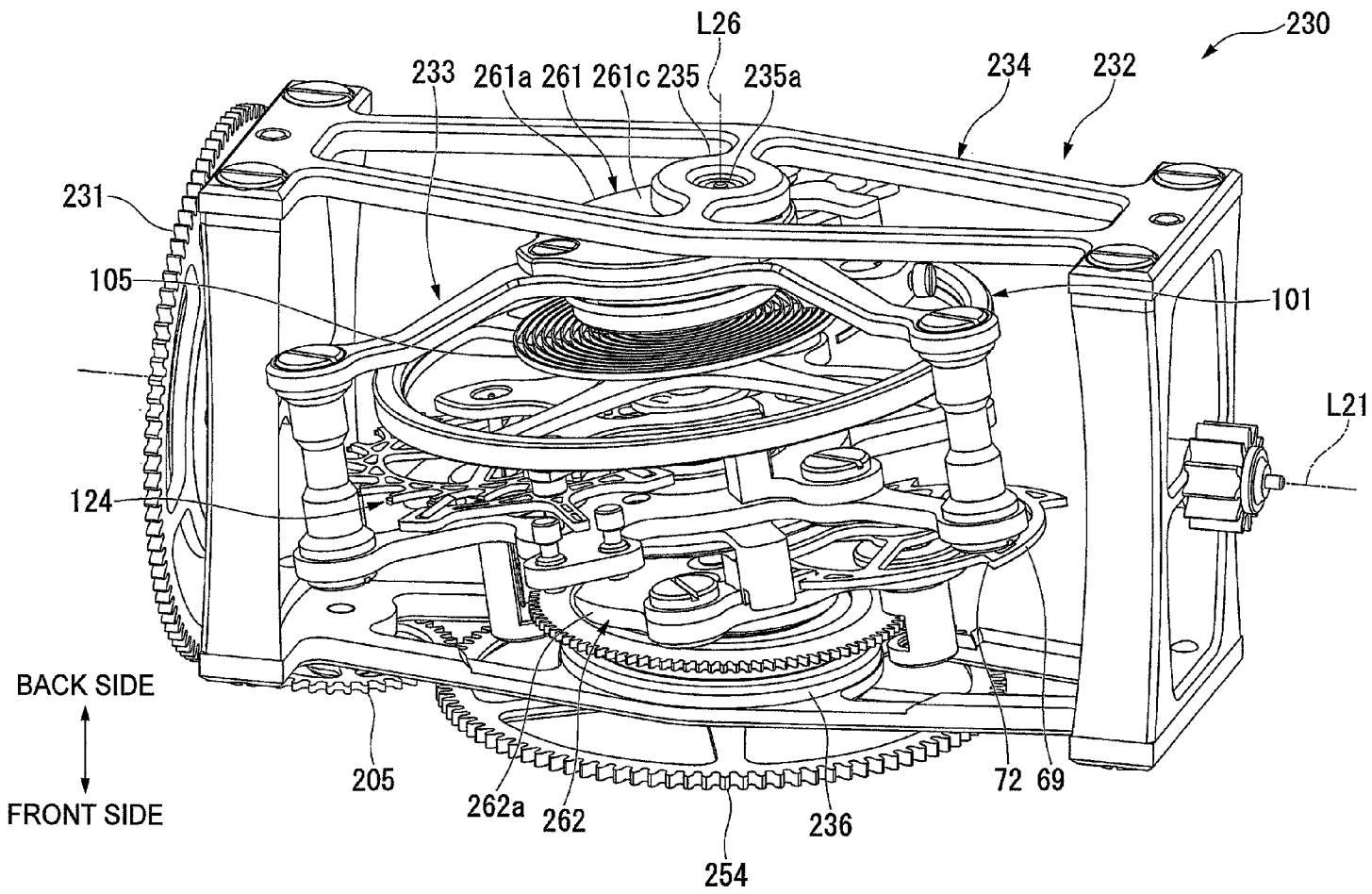
FIG. 28 is a perspective view of a modification of the tourbillon with constant-force device according to the second embodiment of the present invention.
Figure 29:
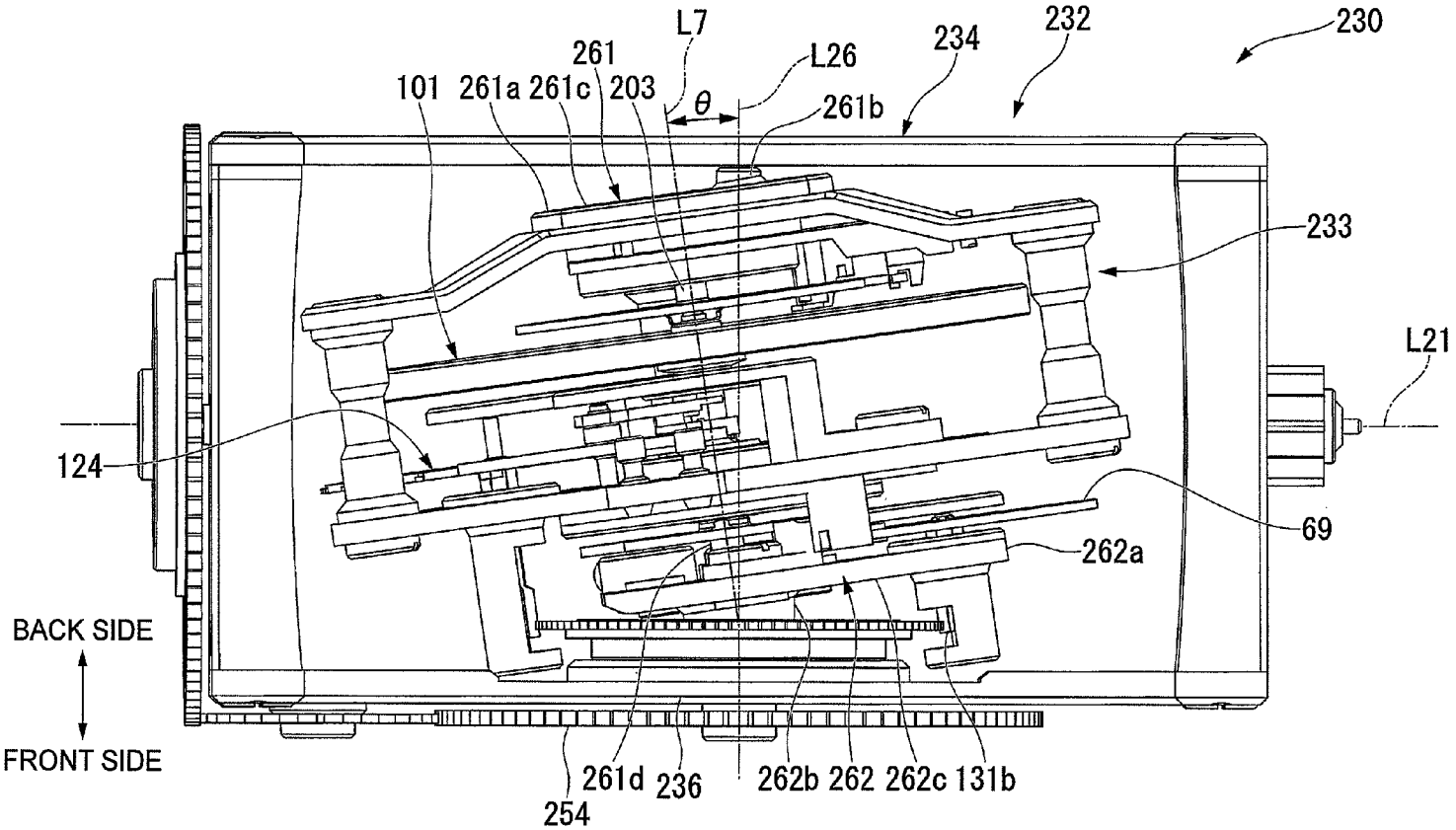
FIG. 29 is a side view of a modification of the tourbillon with constant-force device according to the second embodiment of the present invention.

FIG. 28 is a perspective view of a modification of the tourbillon with constant-force device 230 according to the second embodiment, and FIG. 29 is a side view of the modification of the tourbillon with constant-force device 230 according to the second embodiment.

As shown in FIGS. 28 and 29, the inner carriage 233 has a rotary body 261 rotatably supporting the inner carriage 233 with respect to the outer carriage 232.

The rotary body 261 has a base portion 261*a* formed substantially as a disc. One end of a balance staff 203 is rotatably supported at the center in the radial direction of this base portion 261*a*. Further, the base portion 261*a* has, on a surface 261*c* on the side opposite the side where the balance staff 203 is supported and at a position deviated from the axis of the balance staff 203 (rotation axis L7 of the balance with hairspring 101), a protruding pivot portion 261*b*. The pivot portion 261*b* extends obliquely with respect to the axis of the balance staff 203. The pivot portion 261*b* thus constructed is rotatably supported by a hole jewel 235*a* provided on a bearing seat 235 of the outer carriage 232.

That is, the axis of the pivot portion 261*b* constitutes the rotation axis L26 of the inner carriage 233, and the rotation axis L7 of the balance with hairspring 101 is inclined with respect to this rotation axis L26. The base portion 261*a* is also arranged such that the face direction thereof is inclined with respect to the rotation axis L26.

On the other hand, an intermediate rotary body 262 is provided on the side opposite the rotary body 261 of the inner carriage 233. This intermediate rotary body 262 is arranged between the outer carriage 232 and the inner carriage 233. And, the intermediate rotary body 262 is supported rotatably with respect to the outer carriage 232. Further, the side of the inner carriage 233 opposite the rotary body 261 is rotatably supported by the intermediate rotary body 262.

More specifically, the intermediate rotary body 262 has a base portion 262*a* extending parallel to the base portion 261*a* of the rotary body 261. The stop wheel 69, etc. are provided on this base portion 262*a*. Further, substantially at the center in the face direction of the base portion 262*a*, there is provided a hole jewel (not shown), and a lower pivot portion 261*d* of the inner carriage 233 is rotatably supported by this hole jewel. This lower pivot portion 261*d* is provided coaxially with the balance staff 203.

Further, the base portion 262*a* has a protruding shaft portion 262*b* on a surface 262*c* on the side opposite the side where a balance staff 293 is supported and at a position deviated from the rotation axis L7 of the balance with hairspring 101. The shaft portion 262*b* extends obliquely with respect to the axis of the balance staff 203. The shaft portion 262*b* thus constructed is rotatably supported by a ball bearing (not shown) provided on a bearing seat 236 of the outer carriage 232.

That is, the axis of the shaft portion 262*b* constitutes the rotation axis L26 of the inner carriage 233, and the rotation axis L7 of the balance with hairspring 101 is inclined with respect to this rotation axis L26. The base portion 262*a* is also arranged such that the face direction thereof is inclined with respect to the rotation axis L26.

Here, when, as in the second embodiment described above, formation is effected with two carriages (the outer carriage 232 and the inner carriage 233), and the rotation axis L26 of the inner carriage 233 and the rotation axis L7 of the balance with hairspring 101 are set to be in the same straight line, the orientation in which the balance with hairspring 101 is directed is restricted.

Thus, as in the modification of the second embodiment described above, the rotation axis L7 of the balance with hairspring 101 is inclined with respect to the rotation axis L2 of the inner carriage 233, whereby it is possible to expand the orientation in which the balance with hairspring 101 is directed. This makes it possible to simultaneously suppress the erect attitude difference and the flat-erect difference.

It is desirable for the inclination angle θ of the rotation axis L7 of the balance with hairspring 101 with respect to the rotation axis L26 of the inner carriage 233 to be 45 degrees. By setting the inclination angle θ to 45 degrees, it is possible to suppress the erect attitude difference and the flat-erect difference most effectively. The reason for this is as follows.

Even in the case where the inclination angle θ is set to 45 degrees, there is a limitation to the orientation of the balance with hairspring 101 in the inner carriage 233. However, when the total range of orientation of the balance with hairspring 101 in the case of the erect attitude, and the total range of orientation of the balance with hairspring 101 in the case of the flat attitude are taken into consideration, the balance with hairspring 101 is to be oriented in all directions. In other words, a direction of the balance with hairspring 101 and the frequency of orientation in that direction in the case of the erect attitude are the same as those in the case of the flat attitude. Thus, it is possible to eliminate the error in rate precision generated between the flat attitude and the erect attitude.

In contrast, in the case where the inclination angle θ is less than 45 degrees, even when the total range of orientation of the balance with hairspring 101 in the case of the erect attitude, and the total range of orientation of the balance with hairspring 101 in the case of the flat attitude are taken into consideration, there exists a direction in which the balance with hairspring 101 is not oriented. That is, when the total range of orientation of the balance with hairspring 101 in the case of the erect attitude, and the total range of orientation of the balance with hairspring 101 in the case of the flat attitude are different from each other. Thus, it is impossible to eliminate the error in rate precision generated between the flat attitude and the erect attitude. Thus, it is desirable for the inclination angle θ to be 45 degrees.

Third Embodiment

Tourbillon with Constant-Force Device

Next, the third embodiment according to this invention will be described with reference to FIGS. 30 through 32.

Figure 30:
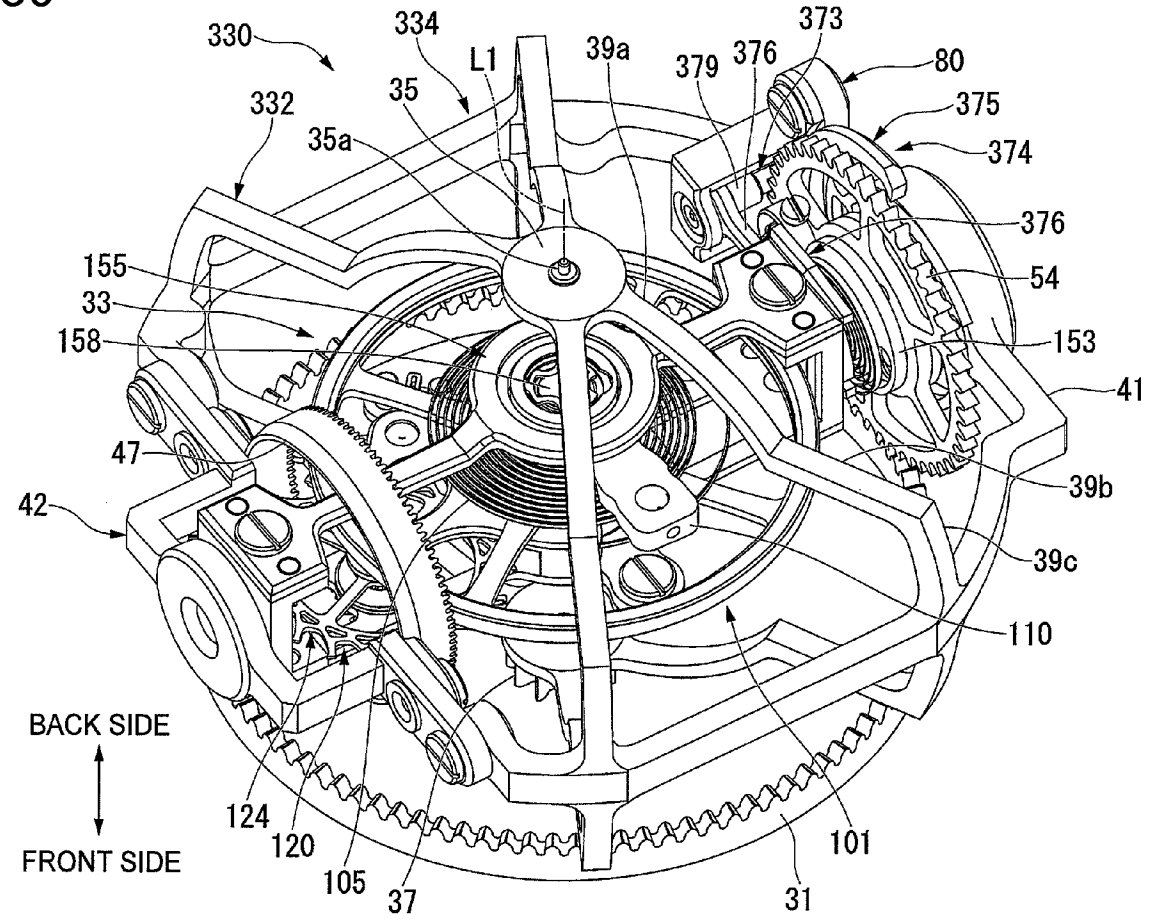
FIG. 30 is a perspective view of a tourbillon with constant-force device according to a third embodiment of the present invention as seen from one side.
Figure 31:
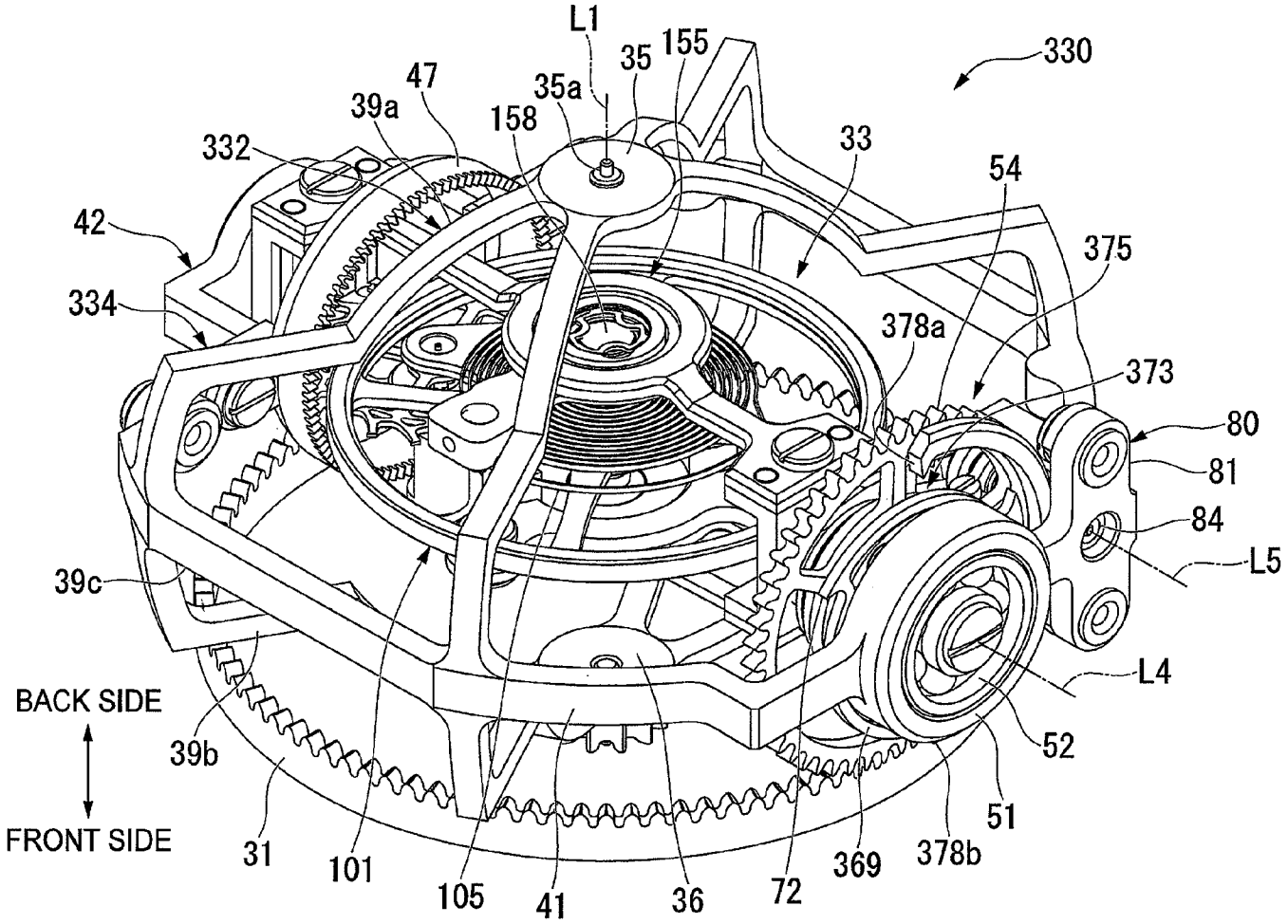
FIG. 31 is a perspective view of the tourbillon with constant-force device according to the third embodiment of the present invention as seen from the other side.
Figure 32:
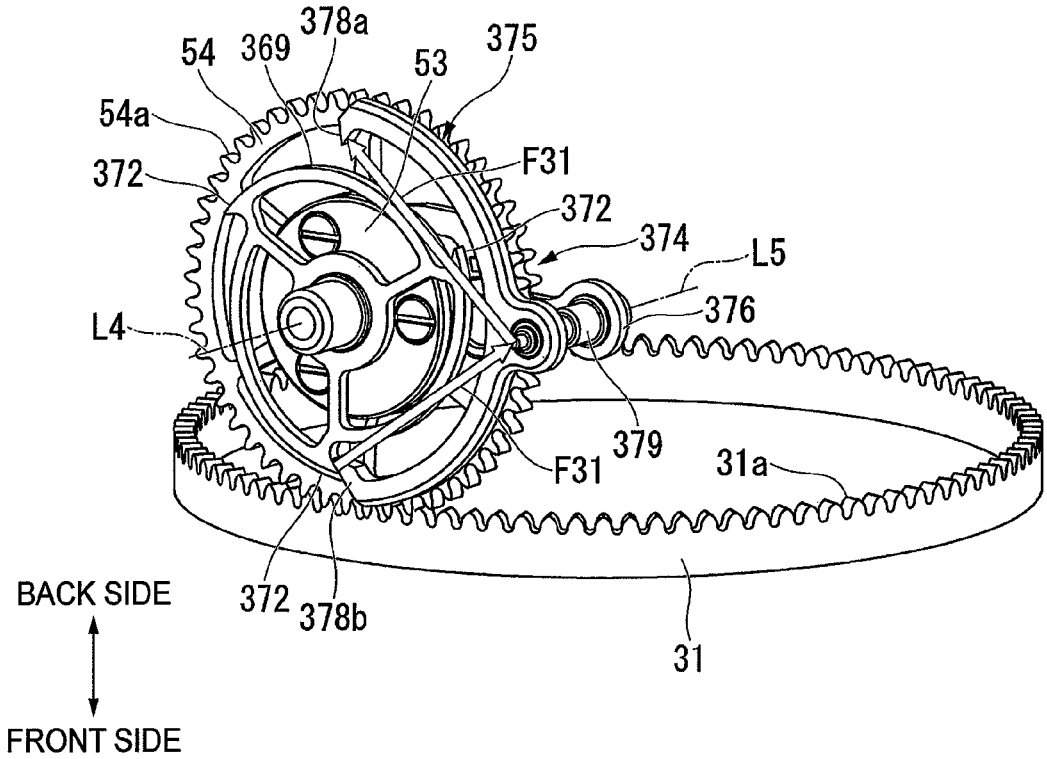
FIG. 32 is a perspective view illustrating the positional relationship between the stop wheel and the stopper according to the third embodiment of the present invention.

FIG. 30 is a perspective view of a tourbillon with constant-force device 330 according to the third embodiment as seen from one side, FIG. 31 is a perspective view of the tourbillon with constant-force device 330 according to the third embodiment as seen from the other side, and FIG. 32 is a perspective view illustrating the positional relationship between a stop wheel 369 and a stopper 373 according to the third embodiment.

As shown in FIGS. 30 through 32, the difference between the first embodiment described above and the third embodiment is as follow: in the first embodiment described above, the rotation axis L4 of the stop wheel 69 and the swing axis of the stopper pallet fork 74 (the axis L5 of the stopper pallet staff 79) are orthogonal to each other, whereas, in the third embodiment, the rotation axis L4 and the swing axis (the axis L5 of a stopper pallet staff 379) are parallel to each other.

More specifically, a stop wheel 369 is arranged on the inner side of the bearing holder 51 in the radial direction of an outer frame 334. And, the stop wheel 369 is arranged such that the rotation axis thereof is in the same straight line as the axis of the bearing holder 51 (ball bearing 52).

Further, a stopper pallet fork 374 of a stopper 373 is separately formed by a stopper body of pallet fork 375 that can be engaged and disengaged with and from the stop wheel 369, and a fork portion 376 to be engaged with a triangular cam (not shown in connection with this third embodiment) provided in the inner carriage 33.

The stopper body of pallet fork 375 and the fork portion 376 are arranged so as to be opposite each other in the radial direction of the outer carriage 332, and their respective proximal end sides are forced into and supported by the stopper pallet staff 379. And, between the stopper body of pallet fork 375 and the fork portion 376, there are arranged the stop wheel 369, the constant-force spring winding-up wheel 54, the phase regulating plate 153, the constant-force spring 59, and the triangular cam 151 in that order from the stopper body of pallet fork 375 side.

On the other hand, the stopper pallet staff 379 is rotatably supported by the bearing portion 80 of the outer frame 334, and the axis L5 thereof is parallel to the rotation axis of the constant-force spring winding-up wheel 54 (the rotation axis L4 of the stop wheel 369).

The stopper body of pallet fork 375 is formed in a substantially C-shaped configuration as seen from the direction of the rotation axis L4 of the stop wheel 369. More specifically, the stopper body of pallet fork 375 extends in the front-back direction of the main plate 11 (See FIGS. 1 and 2) from the stopper pallet staff 379 along the peripheral direction of the stop wheel 369; as a whole, it extends approximately half the circle. At the two distal end portions of the stopper body of pallet fork 375, there are integrally formed pallet portions 378*a* and 378*b* that can be respectively engaged and disengaged with and from the hook portion 72 of the stop wheel 369.

In this construction, when the triangular cam 151 rotates with the rotation of the inner carriage 33, the fork portion 376 of the stopper pallet fork 374 engaged with the triangular cam 151 swings around the stopper pallet staff 379. Further, the stopper body of pallet fork 375 also swings around the stopper pallet staff 379. And, the pallet portions 378*a* and 378*b* of the stopper body of pallet fork 375 are repeatedly engaged and disengaged with and from the hook portion 372 of the stop wheel 369.

Here, the hook portion 372 of the stop wheel 369 and the two pallet portions 378*a* and 378*b* of the stopper pallet fork 374 are formed such that the vector F31 of the load (mesh-engagement force) applied in the state in which the pallet portions 378*a* and 378*b* are in contact with the hook portion 372 passes on the axis L5 of the stopper pallet staff 379.

Thus, according to the third embodiment described above, in the case where the rotation axis L4 of the stop wheel 369 and the swing axis of the stopper pallet fork 374 (the axis L5 of the stopper pallet staff 379) are parallel to each other, it is possible to prevent the rotational force around the stopper pallet staff 379 from being allowed to act on the stopper pallet fork 374 due to the mesh-engagement force between the hook portion 372 of the stop wheel 369 and the pallet portions 378*a* and 378*b* of the stopper pallet fork 374.

As a result, no excessive rotational force is applied to the inner carriage 33 via the triangular cam 151. Thus, it is possible to minimize the requisite torque for rotating the inner carriage 33.

Further, it is possible to coaxially arrange and integrate the stop wheel 369 and the constant-force spring winding-up wheel 54, so that there is no need to provide the stop wheel driving wheel 68 of the first embodiment described above. Thus, as compared with the first embodiment described above, it is possible to reduce the number of components of the tourbillon with constant-force device 330.

Further, the stopper 373 (stopper pallet fork 374) can also be reduced in size, and there is no need to form the stopper pallet fork 374 in an L-shaped configuration, so that it is possible to enhance the rigidity of the stopper pallet fork 374.

Modification of the Third Embodiment

In the third embodiment described above, the stop wheel 369 is arranged on the inner side of the bearing holder 51 in the radial direction of the outer frame 334, and the rotation axis thereof is in the same straight line as the bearing holder 51 (ball bearing 52). This, however, should not be construed restrictively; any other construction will do so long as the rotation axis L4 of the stop wheel 369 and the swing axis of the stopper pallet fork 374 (the axis L5 of the stopper pallet staff 379) are substantially parallel to each other.

In the third embodiment described above, in the stopper pallet fork 374 of the stopper 373, the stopper body of pallet fork 375 and the fork portion 376 are formed as separate components. And, the stopper body of pallet fork 375 and the fork portion 376 are arranged so as to be opposite each other in the radial direction of the outer carriage 332, and their respective proximal end sides are forced into and supported by the stopper pallet staff 379. However, the configuration of the stopper pallet fork 374 is not restricted thereto, and the following construction is also acceptable.

Figure 33:
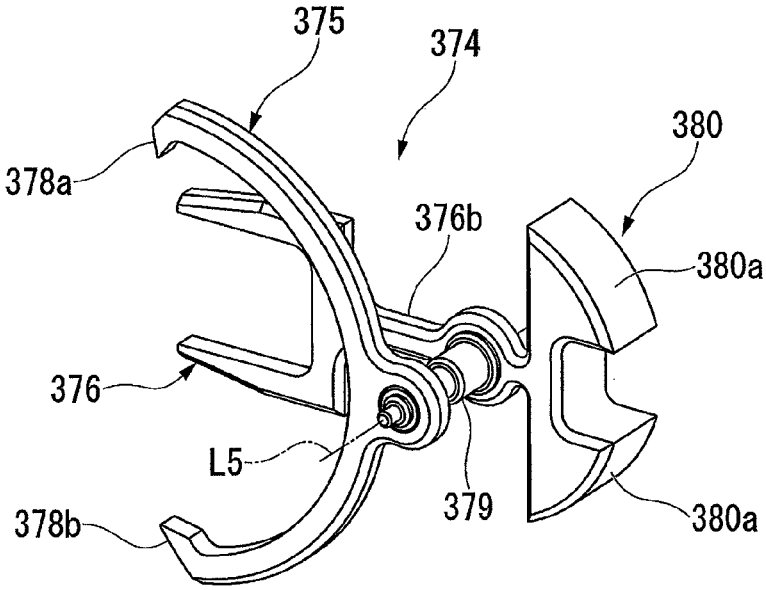
FIG. 33 is a perspective view of a modification of the stopper pallet fork according to the third embodiment of the present invention.

FIG. 33 is a perspective view of a modification of the stopper pallet fork 374 according to the third embodiment.

As shown in the drawing, a balancer 380 is integrally formed on the fork portion 376 of the stopper pallet fork 374 on the opposite side with respect to the stopper pallet staff 379. The balancer 380 is a weight formed of the same material as the fork portion 376, and extends in a direction orthogonal to the arm portion 376*b* of the fork portion 376 and the axis L5 of the stopper pallet staff 379. The balancer 380 has two weight main bodies 380*a* respectively arranged on both sides of the stopper pallet staff 379. Each of these weight main bodies 380*a* is formed as a ¼ circle as seen from the direction of the axis L5 of the stopper pallet staff 379.

By providing the balancer 380, the center of gravity of the stopper pallet fork 374 as a whole is situated in the axis L5 of the stopper pallet staff 79. Thus, it is possible to prevent the gravitational force of the stopper pallet fork 374 from affecting the requisite force for swinging the stopper pallet fork 74 due to the erect attitude and the flat attitude of the mechanical timepiece 1. Thus, in the modification of the stopper pallet fork 74 of the third embodiment described above, it is possible to prevent a change in the requisite force for the inner carriage 33 (triangular cam 151) to swing the stopper pallet fork 74. Thus, it is possible to reliably enhance the rate precision of the mechanical timepiece 1.

In the modification of the third embodiment described above, the balancer 380 is integrally formed on the fork portion 376 of the stopper pallet fork 374. This, however, should not be construed restrictively; the balancer 380 may be formed separately from the fork portion 376, and mounted to the fork portion 376.

In this case, the balancer 380 may be forced into the fork portion 376; or, for example, it is also possible to form a screw or the like on the fork portion 376 and the balancer 380, providing the balancer 380 detachably with respect to the fork portion 376. By providing the balancer 380 on the fork portion 376 detachably, it is possible to easily adjust the position of the center of gravity of the stopper pallet fork 374 by the balancer 380.

Further, instead of being formed on the fork portion 376, the balancer 380 may be formed on the stopper body of pallet fork 375 of the stopper pallet fork 374. That is, any construction will do so long as the center of gravity of the stopper pallet fork 374 as a whole is situated in the axis L5 of the stopper pallet staff 79 by the balancer 380.

Fourth Embodiment

Tourbillon with Constant-Force Device

Next, the fourth embodiment of this invention will be described with reference to FIGS. 34 and 35.

Figure 34:
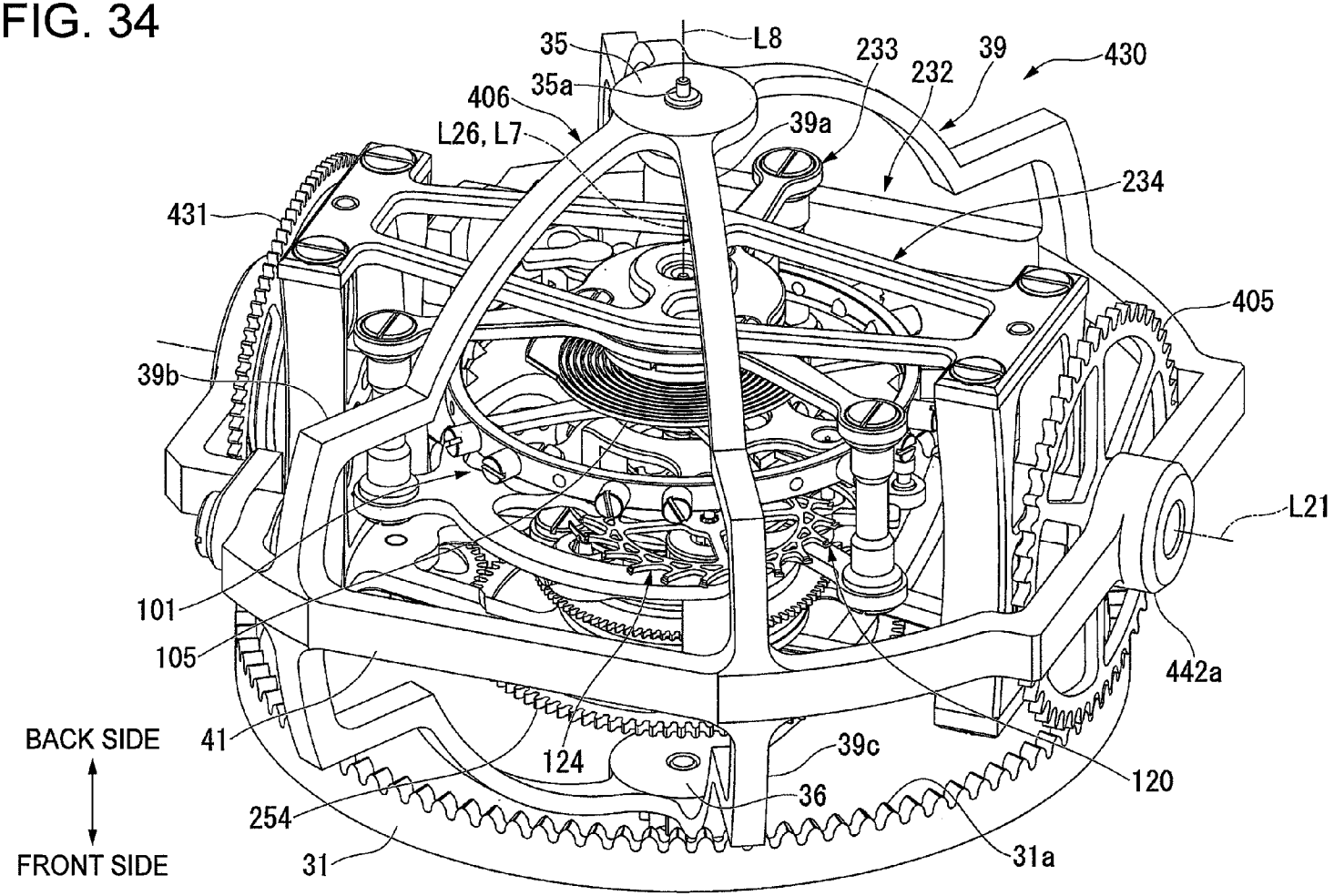
FIG. 34 is a perspective view of a tourbillon with constant-force device according to a fourth embodiment of the present invention as seen from one side.
Figure 35:
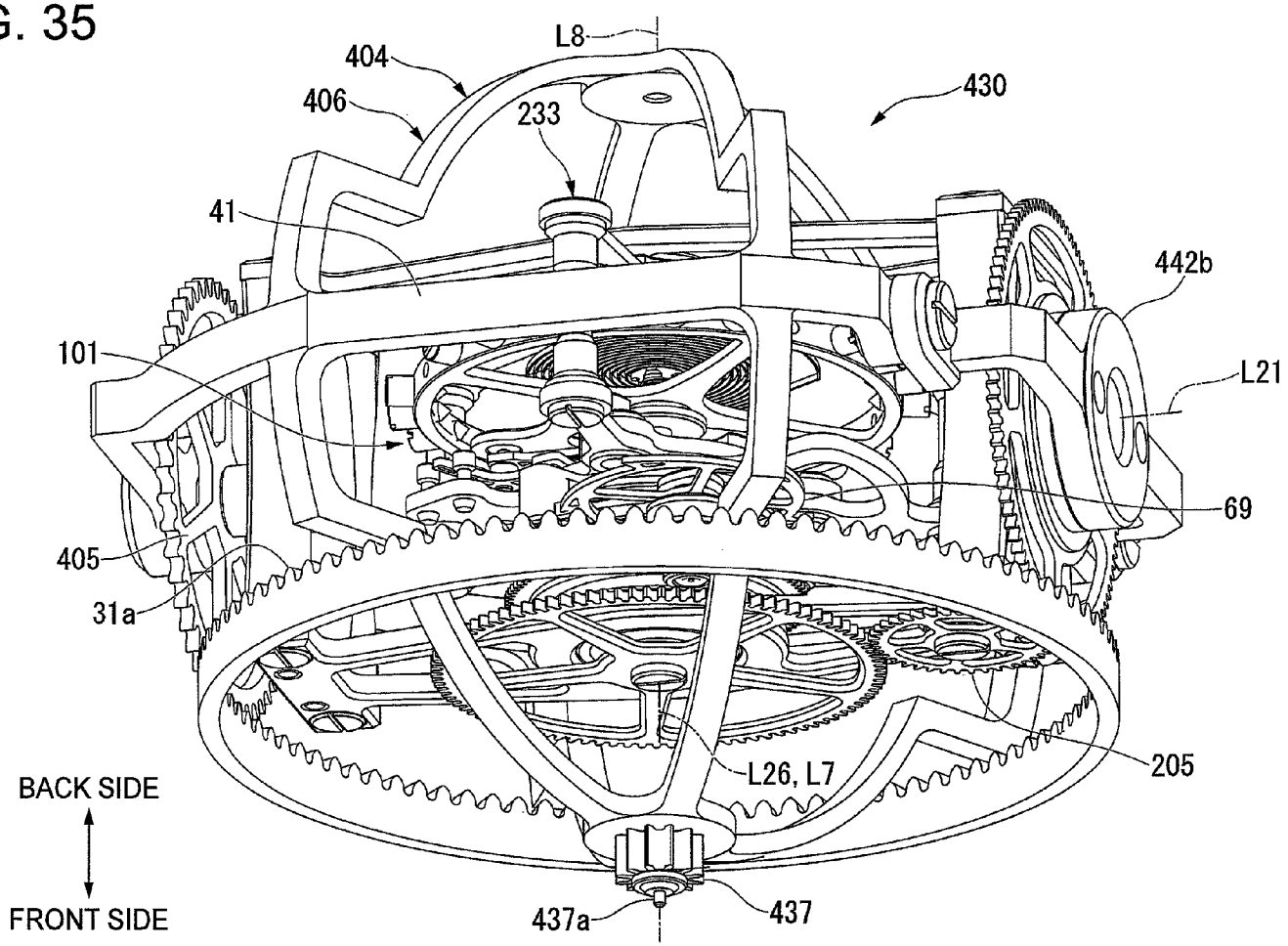
FIG. 35 is a perspective view of the tourbillon with constant-force device according to the fourth embodiment of the present invention as seen from the other side.

FIG. 34 is a perspective view of a tourbillon with constant-force device 430 according to the fourth embodiment as seen from one side, and FIG. 35 is a perspective view of the tourbillon with constant-force device 430 according to the fourth embodiment as seen from the other side. In the fourth embodiment, the components that are the same as those of the second embodiment described above are indicated by the same reference numerals, and a description thereof will be left out.

As shown in FIGS. 34 and 35, in the tourbillon with constant-force device 430 according to the fourth embodiment, a third carriage 404 is further added to the tourbillon with constant-force device 230 according to the second embodiment described above.

More specifically, the third carriage 404 has a third frame 406 formed so as to surround the outer carriage 232 from the outside. The basic construction of the third frame 406 is the same as that of the outer carriage 32 of the first embodiment described above.

That is, the third frame 406 is mainly composed of the back base portion 35, the front base portion 36, the longitudinal frame 39 provided so as to be astride the back base portion 35 and the front base portion 36, and the lateral frame 41. The back base portion 35 is provided with a pivot portion 35*a*. On the other hand, the front base portion 36 is provided with a third carriage pinion 437, and a pivot portion 437*a* protruding from the third carriage pinion 437.

And, the pivot portion 35*a* of the back base portion 35 is rotatably supported by the back side carriage bridge 24, and the pivot portion 437*a* of the third carriage pinion 437 is rotatably supported by the front side carriage bridge 23. Further, the front train wheel is in mesh with the third carriage pinion 437, and the rotational force of the front train wheel is transmitted to the third carriage 404 via the third carriage pinion 437.

The stationary wheel 35 is provided on the front side of the third carriage 404. Further, the lateral frame 41 of the third frame 406 is provided with two outer carriage bearing portions 442*a* and 442*b* arranged so as to be opposite each other, with the rotation axis L8 of the third carriage 404 being at the center. The outer carriage bearing portions 442*a* and 442*b* serve to rotatably support the outer carriage 232, and are respectively equipped with hole jewels (not shown).

Of the two outer carriage bearing portions 442*a* and 442*b*, one outer carriage bearing portion 442*b* (the one on the right-hand side in FIG. 35) is provided, on the inner surface side, with an outer carriage driving stationary wheel 431. The outer carriage driving stationary wheel 431 corresponds to the stationary wheel 231 of the second embodiment described above, and is arranged coaxially with the hole jewel (not shown) of the outer carriage bearing portion 442*b* so as to be not in mesh with the stationary wheel 31. Further, at the center in the radial direction of the outer carriage driving stationary wheel 431, there is formed an opening (not shown) allowing insertion of a pivot (not shown) provided at one end side in the longitudinal direction of the outer carriage 232. As a result, one longitudinal end of the outer carriage 232 is rotatably supported by one outer carriage bearing portion 442*b*.

At the other longitudinal end of the outer carriage 232 (the right-hand side end in FIG. 34), there is provided an outer carriage driving wheel 405. This outer carriage driving wheel 405 is integrated with the outer frame 234. Further, at the center in the radial direction of the outer carriage driving wheel 405, there protrudes a pivot (not shown). This pivot is rotatably supported by the other outer carriage bearing portion 442*a*. In this way, in the third carriage 404, the outer carriage 232 is arranged such that the rotation axis L21 thereof is orthogonal to the rotation axis L8 of the third carriage 404. Further, the outer carriage driving wheel 405 is in mesh with the stationary wheel 31.

In this construction, when the inner carriage 233 rotates by a predetermined angle, and the engagement between the stop wheel 69 provided on the outer carriage 232 and the pallet provided on the inner carriage 233 is released, the third carriage 404 rotates by a predetermined angle. When the third carriage 404 rotates, the outer carriage 232 rotates around the rotation axis L8 of the third carriage 404. At this time, the outer carriage driving wheel 405 of the outer carriage 232 is in mesh with the stationary wheel 31, so that the outer carriage 232 rotates around the rotation axis L21 of the outer carriage 232 while rotating around the rotation axis L8 of the third carriage 404.

Then, the idler wheel 205 in mesh with the outer carriage driving stationary wheel 431 provided on the third carriage 404 rotates while revolving around the outer carriage driving stationary wheel 431. Further, the constant-force spring winding-up wheel 254 in mesh with the idler wheel 205 rotates to thereby wind up a constant-force spring (not shown). By repeating this, the inner carriage 233 and the escapement mechanism 120 continue to drive at a fixed speed.

Here, when, as in the second embodiment described above, the rotation axis L26 of the inner carriage 233 and the rotation axis L7 of the balance with hairspring 101 are set to be in the same straight line while forming the system with two carriages (the outer carriage 232 and the inner carriage 233), there is a limitation to the direction in which the balance with hairspring 101 is oriented.

However, in this fourth embodiment, there is further provided the third carriage 404 in addition to the two carriages 232 and 233 of the second embodiment described above, and the rotation axis L8 of the third carriage 404 and the rotation axis L21 of the outer carriage 232 are orthogonal to each other, whereby it is possible to orient the balance with hairspring 101 in all directions.

Further, in the second embodiment described above, in order to bring the outer carriage pinion 37 and a cogwheel of the front train wheel into mesh with each other, it is necessary to provide the cogwheel so as to be orthogonal to the other cogwheels of the front train wheel; further, to rotatably support the outer carriage 232, it is necessary to perform machining on the main plate 11, etc. However, due to the construction of the fourth embodiment, it is possible to bring a cogwheel of the front train wheel into mesh with the third carriage pinion 437, with all the cogwheels of the front train wheel being oriented in the ordinary direction. Further, the third carriage 404 can be rotatably supported by the front-side carriage bridge 23 and the back-side carriage bridge 24 (See FIG. 2).

The present invention is not restricted to the above-described embodiments but allows various modifications of the above embodiments without departing from the scope of the gist of the invention.

For example, the constructions of the first through fourth embodiments described above (including the modifications of the embodiments) may be arbitrarily combined with each other.

Further, in the first through third embodiments described above, the tourbillon with constant-force device 30, 230, 330 is composed of two carriages (the outer carriage 32, 232, 332 and the inner carriage 33, 233), and, in the fourth embodiment described above, the tourbillon with constant-force device 430 is composed of three carriages (the outer carriage 232, the inner carriage 233, and the third carriage 404).

This, however, should not be construed restrictively; the tourbillon with constant-force device may be composed of four or more carriages. Also in this case, any construction is acceptable so long as the constant-force spring 59 is provided between at least two adjacent carriages, and the rotation axes of the at least two carriages cross each other.

Further, in the case where the tourbillon with constant-force device is formed by four or more carriages, it is desirable to provide the constant-force spring 59 between the two adjacent carriages closest to the balance with hairspring 101. Due to this construction, it is possible to impart rotational force in a stable manner to the carriage in which the balance with hairspring 101 is provided. As a result, it is possible to suppress fluctuation in the oscillation angle of the balance with hairspring 101.

What is claimed is:

1. An operation stabilizing mechanism comprising:

a plurality of carriages arranged in a multiplex fashion and provided so as to be mutually rotatable;

a constant-force spring provided between two adjacent ones of the plurality of carriages and configured to impart a rotational force to the other of the two carriages such that the other carriage rotates with respect to the one carriage;

a stop wheel provided on the one carriage; and a stopper configured to perform engaging and releasing operations on the stop wheel upon the rotation of the other carriage, wherein the rotational axes of at least two of the plurality of carriages cross each other.

2. The operation stabilizing mechanism according to claim 1, wherein the stopper and an escapement/governor mechanism are provided in the one carriage.

3. The operation stabilizing mechanism according to claim 2, wherein there are provided two carriages;

the drive force of a train wheel is transmitted to an outer carriage arranged on the outer side, and the stop wheel is provided on the outer carriage; and the stopper and the escapement/governor mechanism are provided in an inner carriage arranged on the inner side.

4. The operation stabilizing mechanism according to claim 3, wherein the escapement/governor mechanism is equipped with an escape wheel & pinion configured to rotate on the inner carriage with the rotation of the inner carriage, and a balance with hairspring configured to rotate and oscillate on the inner carriage with the rotation of the escape wheel & pinion; and the balance with hairspring is arranged such that the rotation axis of the balance with hairspring and the rotation axis of the outer carriage cross each other.

5. The operation stabilizing mechanism according to claim 4, wherein the rotation axis of the inner carriage and the rotation axis of the balance with hairspring cross each other.

6. The operation stabilizing mechanism according to claim 4, wherein the center of gravity of the balance with hairspring is situated in at least one of the rotation axis of the inner carriage and the rotation axis of the outer carriage.

7. The operation stabilizing mechanism according to claim 3, wherein the center of gravity of the inner carriage is situated in the rotation axis of the inner carriage.

8. The operation stabilizing mechanism according to claim 3, wherein the center of gravity of the outer carriage is situated in the rotation axis of the outer carriage.

9. The operation stabilizing mechanism according to claim 3, wherein the stopper is equipped with an arm swingably provided with respect to the outer carriage and configured to swing upon the rotation of the inner carriage, and a pallet portion provided on the arm and capable of being engaged and disengaged with and from the stop wheel;

the swing axis of the arm is set in a direction crossing the rotation axis of the stop wheel; and setting is made such that the vector of a mesh-engagement force generated when the stop wheel and the pallet portion are engaged with each other extends along the direction of the swing axis of the arm.

10. The operation stabilizing mechanism according to claim 3, wherein the stopper is equipped with an arm swingably provided with respect to the outer carriage and configured to swing upon the rotation of the inner carriage, and a pallet portion provided on the arm and capable of being engaged and disengaged with and from the stop wheel;

the swing axis of the arm is set so as to extend along the rotation axis of the stop wheel; and setting is made such that the vector of a mesh-engagement force generated when the stop wheel and the pallet portion are engaged with each other passes on the swing axis of the arm.

11. The operation stabilizing mechanism according to claim 9, wherein the arm is equipped with a balancer; and the center of gravity of the arm is situated in the swing axis of the arm.

12. The operation stabilizing mechanism according to claim 1, wherein there is provided a regulating portion regulating the relative rotation amount of the two carriages connected by the constant-force spring.

13. The operation stabilizing mechanism according to claim 12, wherein, of the two carriages connected by the constant-force spring, the carriage on the outer side is provided with a constant-force spring winding-up wheel for winding up the constant-force spring;

the constant-force spring winding-up wheel is provided with a regulating plate;

of the two carriages connected by the constant-force spring, the carriage on the inner side is provided with an engagement pin that can be engaged with the regulating plate; and the regulating plate and the engagement pin constitute a regulating portion.

14. The operation stabilizing mechanism according to claim 1, wherein the respective rotation cycles of the plurality of carriages are set to mutually indivisible numbers.

15. The operation stabilizing mechanism according to claim 14, comprising:

a stationary wheel provided separately from the plurality of carriages; and a stop wheel driving wheel integrally fixed to the stop wheel and in mesh with the stationary wheel, wherein the number of teeth of the stationary wheel and the number of teeth of the stop wheel driving wheel are set to mutually indivisible numbers.

16. A movement equipped with an operation stabilizing mechanism as claimed in claim 1.

17. A mechanical timepiece equipped with a movement as claimed in claim 16.

* * * * *